US008517381B2

(12) United States Patent
Bontempo et al.

(10) Patent No.: US 8,517,381 B2
(45) **Date of Patent: *Aug. 27, 2013**

(54) GAMING SYSTEM, DEVICE AND METHOD INVOLVING A PLURALITY OF ROTORS INTERCHANGEABLY OPERABLE IN A DECOUPLED MODE AND A COUPLED MODE

(75) Inventors: David K. Bontempo, San Francisco, CA (US); Mark C. Nicely, Daly City, CA (US); Benjamin J. Zoltewicz, Mill Valley, CA (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/551,244

(22) Filed: Jul. 17, 2012

(65) Prior Publication Data

US 2012/0282991 A1 Nov. 8, 2012

Related U.S. Application Data

(63) Continuation of application No. 13/187,669, filed on Jul. 21, 2011, now Pat. No. 8,226,085, which is a continuation of application No. 12/914,578, filed on Oct. 28, 2010, now Pat. No. 8,006,978, which is a continuation of application No. 12/257,059, filed on Oct. 23, 2008, now Pat. No. 7,850,171.

(51) Int. Cl.
*A63F 5/04* (2006.01)

(52) U.S. Cl.
USPC ..... 273/142 HA

(58) Field of Classification Search
USPC ..... 273/142 H, 142 HA; 463/17, 18, 463/20, 22
See application file for complete search history.

(56) References Cited

U.S. PATENT DOCUMENTS

| | | | |
|---|---|---|---|
| 3,017,532 | A | 1/1962 | Talmey |
| 3,810,628 | A | 5/1974 | Vigan |
| 4,421,310 | A | 12/1983 | Williams |
| 4,674,748 | A | 6/1987 | Wismer |
| 4,906,005 | A | 3/1990 | Manabe |
| 5,102,135 | A | 4/1992 | Addiechi |
| 5,184,821 | A | 2/1993 | Korenek |
| 5,636,838 | A | 6/1997 | Caro |
| 5,755,440 | A | 5/1998 | Sher |
| 5,839,955 | A | 11/1998 | Mangano et al. |
| 6,039,648 | A | 3/2000 | Guinn et al. |
| 6,053,823 | A | 4/2000 | Mathews |

(Continued)

FOREIGN PATENT DOCUMENTS

| | | |
|---|---|---|
| EP | 0956111 | 11/1999 |
| EP | 1226851 | 7/2002 |

(Continued)

OTHER PUBLICATIONS

Alfastreet D8 description, Alfa street Gamin Instruments, available on or before Nov. 13, 2006.

(Continued)

*Primary Examiner* — William Pierce
(74) *Attorney, Agent, or Firm* — Neal, Gerber & Eisenberg LLP

(57) ABSTRACT

A gaming table, method and device including a plurality of rotors interchangeably operable in a decoupled mode and a coupled mode. The system includes a rotor coupler and a coupler actuator. The system provides an award associated with an indication of a combination of symbols of the rotors.

20 Claims, 36 Drawing Sheets

(56) References Cited

U.S. PATENT DOCUMENTS

| | | | |
|---|---|---|---|
| 6,059,658 | A | 5/2000 | Mangano et al. |
| 6,082,887 | A | 7/2000 | Feuer et al. |
| 6,152,448 | A | 11/2000 | Cudlipp |
| 6,209,869 | B1 | 4/2001 | Mathews |
| 6,217,022 | B1 | 4/2001 | Astaneha |
| 6,309,299 | B1 | 10/2001 | Weiss |
| 6,497,409 | B2 | 12/2002 | Mathews |
| 6,659,462 | B1 | 12/2003 | Scott |
| 6,663,106 | B1 | 12/2003 | Cosmi |
| 6,705,944 | B2 | 3/2004 | Luciano |
| 6,733,390 | B2 | 5/2004 | Walker et al. |
| 6,869,359 | B1 | 3/2005 | Mathews |
| 6,890,255 | B2 | 5/2005 | Jarvis et al. |
| 6,988,731 | B2 | 1/2006 | Inoue |
| 6,988,805 | B2 | 1/2006 | Belliveau |
| 7,094,150 | B2 | 8/2006 | Ungaro et al. |
| RE39,659 | E | 5/2007 | Luciano et al. |
| 7,533,885 | B2 | 5/2009 | Nicely et al. |
| 7,549,637 | B2 | 6/2009 | Lease |
| 7,553,233 | B2 | 6/2009 | Jarvis et al. |
| 7,571,910 | B1 | 8/2009 | Launzel |
| 7,674,172 | B2 | 3/2010 | Miltenberger et al. |
| 7,708,630 | B2 | 5/2010 | Nicely |
| 8,152,171 | B2 | 4/2012 | Miltenberger et al. |
| 8,177,234 | B2 | 5/2012 | Nicely |
| 2002/0119824 | A1 | 8/2002 | Allen |
| 2002/0169017 | A1 | 11/2002 | Visoenik |
| 2003/0094752 | A1 | 5/2003 | Mathews |
| 2004/0127284 | A1 | 7/2004 | Walker et al. |
| 2005/0009600 | A1 | 1/2005 | Rowe et al. |
| 2005/0119043 | A1 | 6/2005 | Berman et al. |
| 2005/0215307 | A1 | 9/2005 | Jarvis et al. |
| 2006/0030959 | A1 | 2/2006 | Duhamel |
| 2006/0030960 | A1 | 2/2006 | Duhamel et al. |
| 2006/0046821 | A1 | 3/2006 | Kaminkow et al. |
| 2006/0148565 | A1 | 7/2006 | Gauselmann et al. |
| 2006/0157928 | A1 | 7/2006 | O'Halloran |
| 2006/0170154 | A1 | 8/2006 | Matsuno et al. |
| 2006/0170155 | A1 | 8/2006 | Silverman |
| 2006/0237905 | A1 | 10/2006 | Nicely et al. |
| 2006/0240887 | A1 | 10/2006 | Walker et al. |
| 2006/0249899 | A1 | 11/2006 | Lease |
| 2006/0287053 | A1 | 12/2006 | Yokota |
| 2007/0069459 | A1 | 3/2007 | Guindulain Vidondo |
| 2007/0075488 | A1 | 4/2007 | Pececnik |
| 2007/0120320 | A1 | 5/2007 | Miltenberger et al. |
| 2007/0135203 | A1 | 6/2007 | Nicely |
| 2007/0135204 | A1 | 6/2007 | Nicely |
| 2008/0214264 | A1 | 9/2008 | Griswold et al. |

FOREIGN PATENT DOCUMENTS

| | | | |
|---|---|---|---|
| EP | 1671684 | | 6/2006 |
| EP | 1710000 | | 10/2006 |
| EP | 1721642 | | 11/2006 |
| EP | 1736215 | | 12/2006 |
| EP | 1769828 | | 4/2007 |
| GB | 2358591 | | 8/2001 |
| GB | 2395139 | | 5/2004 |
| GB | 2431362 | | 4/2007 |
| JP | 60099278 | | 6/1985 |
| JP | 3000350 | | 5/1994 |
| JP | 06-304294 | A | 11/1994 |
| JP | 2008-023040 | | 2/2008 |
| WO | WO 97/38766 | | 10/1997 |
| WO | WO 00/33269 | | 6/2000 |
| WO | WO 2006/015442 | | 2/2006 |
| WO | WO 2006/061616 | | 6/2006 |
| WO | WO 2006/078219 | | 7/2006 |
| WO | WO 2006/094398 | | 9/2006 |
| WO | WO 2006/097007 | | 9/2006 |
| WO | WO 2007/024202 | | 3/2007 |
| WO | WO 2007/033430 | | 3/2007 |
| WO | WO 2007/077449 | | 7/2007 |

OTHER PUBLICATIONS

Althstreet M8 description, Alfa street Gaming Instruments, available on or before Nov. 13, 2006.

Double Roulette Wheel Excerpt, Loose Change magazine, Oct. 1993, p. 26.

Megastar Family description, Aristocrat Technologies, Inc., available on or before Nov. 13, 2006.

Letter from Reina Kakimoto of Mots Law dated Jan. 17, 2012 regarding Third Party Submission in Published Application Under 37 C.F.R. 1.99 filed for U.S. Appl. No. 13/187,669 (1 page).

Third Party Submission in Published Application Under 37 C.F.R. 1.99 filed for U.S. Appl. No. 13/187,669, dated Jan. 17, 2012 (3 pages).

Partially highlighted JP 06-304294A and English translation of paragraph [0007] of same submitted with Third Party Submission in Published Application Under 37 C.F.R. 1.99 for U.S. Appl. No. 13/187,669 (3 pages).

Partially highlighted JP 3000350U and English translation of paragraphs [0011], [0012], and [0014] of same submitted with Third Party Submission in Published Application Under 37 C.F.R. 1.99 for U.S. Appl. No. 13/187,669.

Partially highlighted JP 2008-023040A and English translation of paragraphs [0008] and [0016] of same submitted with Third Party Submission in Published Application Under 37 C.F.R. 1.99 for U.S. Appl. No. 13/187,669 (6 pages).

26a
30
30

26b
31b
32b
32b 26c
31c
32c
32c 26d
31d
32d
32d

GAMING SYSTEM, DEVICE AND METHOD INVOLVING A PLURALITY OF ROTORS INTERCHANGEABLY OPERABLE IN A DECOUPLED MODE AND A COUPLED MODE

PRIORITY CLAIM

This application is a continuation of, and claims priority to and the benefit of, U.S. patent application Ser. No. 13/187,669, filed on Jul. 21, 2011, which is a continuation of, and claims priority to and the benefit of, U.S. patent application Ser. No. 12/914,578, filed on Oct. 28, 2010, which issued as U.S. Pat. No. 8,006,978 on Aug. 30, 2011, which is a continuation of, and claims priority to and the benefit of, U.S. patent application Ser. No. 12/257,059, filed on Oct. 23, 2008, which issued as U.S. Pat. No. 7,850,171 on Dec. 14, 2010, the entire contents of each of which are incorporated herein by reference.

CROSS-REFERENCE TO RELATED APPLICATIONS

This application is related to the following co-owned commonly pending patent applications: U.S. patent application Ser. No. 13/543,221, filed on Jul. 6, 2012; and U.S. patent application Ser. No. 13/551,255, filed on Jul. 17, 2012.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

There are a variety of games to play in casinos and other gaming environments. Roulette is one commonly known game which includes a moving wheel and a ball which travels along the moving wheel. Depending upon where the ball stops, the player may win or lose a bet. There is a need to increase the level of interest, excitement, hit frequency and volatility associated with playing roulette-related games. There is also a need to enhance the operational functionality of roulette-related games or otherwise provide improvements to, and interesting variations of, roulette-related games.

SUMMARY

In one embodiment, the gaming table, gaming device and related method disclosed herein involve a wheel assembly and a wagering station operable for play of a roulette-related game. The wheel assembly includes a plurality of individual rotors. At least one rotor, typically an inner rotor, supports or carries a plurality of landings, such as ball landings. A plurality of secondary or outer rotors are positioned in concentric arrangement with the inner rotor. Each outer rotor supports or carries a plurality of game symbols arranged about the landings. The wagering station includes a plurality of betting options which enable one or more players to place a bet with respect to which landing will be the stopping place or receiver for a ball, indicator or other suitable graphical or mechanical object. Several players can simultaneously place bets on the wagering station. In one embodiment, one or more players each has access to the player's own individual wagering station.

In one embodiment, a dealer or croupier spins the rotors in one direction after the bets are placed. In an embodiment, the dealer or croupier spins the rotors physically by hand. In another embodiment, the dealer causes the rotors to spin through use of a suitable device or mechanism. Then, the dealer launches the ball or indicator above or onto the rotors, typically in the opposite direction The ball or indicator stops at or is received by one of the landings. The ball or indicator indicates a game symbol on each outer rotor that is radially aligned with this landing. In one embodiment, each indicated game symbol is associated with, or otherwise corresponds to, an independent game outcome. That is, the ball or indicator indicates a plurality of independent game outcomes in a single spin of the rotors. Bets placed at the wagering station are settled or resolved based on such indicated game outcomes. Indicating a plurality of game outcomes for each spin gives the players more opportunities to win and increases the excitement, enjoyment and volatility for the players. For example, if the player bets on a numeral twenty-eight, the gaming device provides an award if the ball lands so as to indicate the numeral twenty-eight on any of the rotors. In another example, if the player bets on a numeral combination including numerals twenty-eight, twenty-nine and thirty, the gaming device provides an award if the ball lands so as to indicate the numeral combination of twenty-eight, twenty-nine or thirty on any of the rotors.

The roulette-related game can be played at a gaming table with a live dealer, through a gaming system with a live dealer and player specific bet stations, through a stand alone gaming machine, or through a computer network such as the Internet. As described above, the roulette-related game is administered by a dealer which can be a human dealer, a human dealer operating in a casino, a feed or transmission of a video of a dealer operating in a live game, through a real-time video feed of a live casino game, a computerized dealer, a virtual dealer of a casino, a gaming device, a processor, a gaming establishment, or a gaming system provided through a data network such as the internet.

In one embodiment, the wheel assembly has bowl, and the dealer spins each of the secondary or outer rotors independently and at substantially the same time. Then the dealer launches the ball or indicator onto the bowl, above the outer rotors. In this embodiment, the ball landings are supported by an inner static ring or display rather than a moving rotor. Each outer rotor stops spinning such that one game symbol on each outer rotor aligns with one of the landings of the inner ring. The ball or indicator stops in, or is received by, one of the landings. The landing which receives the ball or indicator indicates an independent game outcome on each outer rotor aligned with this landing. The dealer settles any bets placed on the wagering station based on the indicated game outcomes.

In another embodiment, the dealer spins each of the secondary or outer rotors independent of, and relative to, the inner rotor. The dealer can spin the outer rotors substantially simultaneously, or sequentially. Each outer rotor stops spinning so that one game symbol aligns with one of the landings on the inner rotor. After the outer rotors stop spinning, the dealer launches the ball or indicator onto the stopped outer rotors. The landing which receives the ball or indicator indicates an independent game outcome on each outer rotor aligned with this landing. The dealer then settles any bets placed on the wagering station based on the indicated game outcomes. In another embodiment, the dealer launches the ball or indicator above or onto the outer rotors while the outer rotors are still spinning.

In one embodiment, the dealer spins each of the inner and outer rotors relative to one another. That is, the inner rotor and the outer rotors spin in this embodiment. The inner and outer rotors stop spinning so that each landing on the inner rotor aligns with one game symbol on each outer rotor. After the landings align with the game symbols of the outer rotors, the dealer launches the ball or indicator onto the stopped inner and outer rotors. The landing which receives the ball or indicator indicates an independent game symbol on each outer rotor. The dealer then settles any bets placed on the wagering station based on the indicated game symbols. In another embodiment, the dealer launches the ball or indicator onto the rotors while (i) the inner rotor is spinning, (ii) one or more of the secondary or outer rotors are spinning, or (iii) any combination of the inner rotor and the outer rotors are spinning.

In another embodiment, the dealer spins each of the inner and outer rotors relative to one another. At least one of the inner and outer rotors continues to spin so that each landing on the inner rotor aligns with one game symbol on each outer rotor while at least one of the inner and outer rotors is spinning. After the ball landings align with the game symbols of the outer rotors, the dealer launches the ball or indicator above or onto the inner and outer rotors. The landing which receives the ball or indicator indicates a game symbol on each outer rotor. The dealer then settles any bets placed on the wagering station based on the indicated game symbols.

In one embodiment, one or more of the secondary or outer rotors and the inner rotor spin together. That is, at least one of the outer rotors and the inner rotor are mechanically or graphically coupled together so as to spin as a single rotor. Such single rotor enables the game symbols of the outer rotor to spin together with the landings of the inner rotor. Such single rotor spins independent of any other outer rotors included in the wheel assembly. For example, the wheel assembly includes one inner rotor and five outer rotors. The inner rotor and one of the outer rotors are coupled together so as to form parts of a single rotor. The landings of the inner rotor spin together with the game symbols of the outer rotor. The four remaining outer rotors spin independent of, and relative to, the single rotor. That is, the game symbols of the four remaining outer rotors rotate relative to the landings and the game symbols of the single rotor.

In one embodiment, the inner rotor and each of the outer rotors rotate independently. The dealer launches the ball or indicator above or onto the inner and outer rotors. When the ball or indicator lands at one of the landings, the inner rotor and each of the outer rotors align to move synchronously. In one embodiment, the inner rotor and each of the outer rotors lock or couple together after a designated event occurs, and they then move synchronously as a single unit. In one embodiment, the landing which receives the ball or indicator indicates a line of game symbols extending radially from the inner rotor through all of the outer rotors.

In another embodiment, all of the secondary or outer rotors are coupled together so as to spin as one, single rotor. That is, the plurality of outer rotors form parts of a secondary single rotor which rotates relative to the inner rotor. Alternatively, a plurality (but not all) of the outer rotors form parts of a single rotor which rotates relative to the inner rotor. In one embodiment, such a single rotor can display a randomly change in the indicia or symbols of the single rotor. Depending upon the embodiment, such change can occur before or during the time when such single rotor is rotating.

In one embodiment, the wheel assembly of the gaming device includes an inner or primary rotor that carries or supports a plurality of landings, such as ball landings. The wheel assembly also includes a plurality of outer or secondary rotors which each carry or support a plurality of game symbols. In this embodiment, the wheel assembly provides one or more players a plurality of wagering opportunities for each spin of the outer rotors. That is, each outer rotor cooperates with the landings carried by the inner rotor to form an independent game outcome. The one or more players have the opportunity to place at least one wager on the wagering station. In one embodiment, the players place betting markers, such as chips or tokens, on the wagering station to indicate desired wagers on the independent game outcome for any of the outer rotors. For example, if the wheel assembly includes three outer rotors, each player wager constitutes a separate wager on each of the three outer rotors. In this example if the player bets on a numeral fourteen, the gaming device provides an award if the ball lands so as to indicate the numeral fourteen on one, a plurality of or all of the outer rotors. In one embodiment, the award changes depending on how many times a numeral wagered on by a player is indicated by the outer rotors. For example, the gaming device increases a payout or award in proportion to the number of rotors which indicate a designated win or numeral on the outer rotors. In one embodiment, the gaming device provides a first award (e.g., of a designated value) if the numeral wagered on by the player is indicated by two of the outer rotors, and provides a second award (e.g., of a higher value) if the numeral wagered on by the player is indicated by three of the outer rotors. In one embodiment, the award changes depending on how many times any given numeral is indicated by the outer rotors, irrespective of whether or not a player has a wager specifically covering such numeral. For example, the gaming device offers a payout or award in proportion to the number of rotors upon which matching numerals are indicated. In one embodiment, the gaming device provides a first award (e.g., of a designated value) if any numeral matches on two of the outer rotors, and provides a second award (e.g., of a higher value) if any numeral matches three of the outer rotors. In one embodiment, the award for a designated matching outcome is a progressive award. In one embodiment, the award for a designated matching outcome is entry into a bonus game.

In an additional embodiment, the gaming device provides an award for ascending or descending numeral sequences indicated by the outer rotors, such as 4-5-6 or 8-9-7. In the example described above with three outer rotors, the three outer rotors can align so that the numeral 4 is indicated by an innermost outer rotor, the numeral 5 is indicated by a middle outer rotor and the numeral 6 is indicated by an outermost outer rotor. In one embodiment, the award for a designated sequence outcome is a progressive award. In one embodiment, the award for a designated sequence outcome is entry into a bonus game.

In one embodiment, the gaming device provides an award when the outcomes indicated on all of the rotors are of the same color. In one embodiment, the value of the award for a designated matching color outcome varies relative to the specific color. In one embodiment, an award is provided for matching outcome colors only if the player places a wager for that specific color to match. In one embodiment, the award for a designated color matching outcome is a progressive award. In one embodiments, the award for a designated matching color outcome is entry into a bonus game.

In operation of an example play, the dealer spins the five outer rotors and launches an indicator, such as a ball or other graphical or mechanical object, above the secondary rotors.

In different embodiments, the dealer launches the indicator while at least one of the outer rotors is stopped or while at least one of the outer rotors are spinning. When the indicator stops or lands in one of the landings, a game symbol on each of the outer rotors aligns with the indicator. The stopping point indicates five separate and independent game outcomes (i.e., one game outcome for each outer rotor) to the one or more players. In one embodiment, the indicator indicates the game outcomes that align with the indicator along an invisible or visible outcome axis or outcome line. In one embodiment, the outcome line can be visually, graphically or mechanically displayed to the one or more players. Game outcomes aligned along the outcome line define winning game outcomes for that spin of the outer rotors. The dealer settles any wagers placed on the wagering station based on the five game outcomes aligned with and indicated by the indicator along the outcome one.

In another embodiment, the wheel assembly of the gaming device includes: (a) an inner rotor which carries the landings, (b) a primary outer rotor for play of a primary game, and (c) one or more bonus outer rotors for play of a bonus game. If a triggering event occurs in the primary game, the gaming device activates one or more of the bonus outer rotors for a play of one or more bonus games. In one embodiment, the bonus outer rotor displays at least one numeral or symbol which is different from the numerals and symbols of the other rotors. In one embodiment, the bonus outer rotor has at least one bonus landing associated with a bonus triggering event or a bonus award. Depending upon the embodiment, the bonus landing may have a size or shape which is the same as or different from the size or shape of the other ball landings of the bonus outer rotor.

In one embodiment, the gaming device incorporates one or more structure and functional elements (i.e., rotor and ball dynamics) of traditional Roulette, while indicating multiple independent game outcomes in a single play of a multi-rotor game. Indicating a plurality of independent game outcomes for each play of the game gives the players more opportunities to win and increases the excitement, enjoyment and interaction for the players. Additionally, the gaming device enables the players to place extra wagers based on the multiple game outcomes associated with multiple rotors.

In another embodiment, the inner rotor and each of the outer rotors described above include separate sets of wells or ball landings. In one such embodiment, the ball or indicator can land in any one of the wells or ball landings of the inner rotor or one of the outer rotors. The landing which receives the ball or indicator indicates a game symbol on the respective inner or outer rotor.

In different embodiments, the gaming device incorporates a plurality of indicators or balls into any of the embodiments described above. Multiple indicators or balls, along with the inner and outer rotors described above, increase the level of excitement and hit frequency associated with the gaming device.

In one embodiment, the gaming system includes a plurality of rotors, including one rotor positioned within a perimeter of another rotor. The rotors share a common center point, and each one of the rotors has a plurality of game symbols. Each game symbol is indicatable by an indicator. The rotors are configured to be interchangeably operable in a plurality of modes, including: (a) a decoupled mode in which the rotors are rotatable independent of each other; and (b) a coupled mode in which the rotors are coupled to each other and move as one unit. The gaming system includes a rotor coupler configured to cause a change from the decoupled mode to the coupled mode. Also, the gaming system includes a coupler actuator configured to: (i) receive an input while the rotors are rotating in the decoupled mode; and (ii) actuate the rotor coupler in response to the received input. The actuation of the rotor coupler changes the decoupled mode to the coupled mode. The gaming system has an award condition which is satisfied after: (x) the rotors rotate for a period in the decoupled mode; (y) the rotors rotate for a following period in the coupled mode; and (z) the indicator indicates a combination of the game symbols while the rotors are rotating in the coupled mode, where the combination includes at least one game symbol of each one of the rotors. The gaming system has an award which is available as a result of the award condition being satisfied. The award is based on a wager.

In another embodiment, the gaming system includes a plurality of motors, and each one of the motors is operatively coupled to one of the rotors. The gaming system has a processor which is operatively coupled to the motors.

In another embodiment, the gaming system includes a single motor which drives a rotating platter or flywheel concentric to, and located beneath, a plurality of rotors. One or more rotors can be rotated manually relative to the rotating platter or flywheel.

In one embodiment, each one of the rotors has a plurality of ball landings, and each one of the ball landings is associated with one of the symbols. Also, the indicator includes a ball.

In one embodiment, the indicator includes a pointer coupled to the circular housing, and the pointer has a rotor engager configured to engage at least one of the rotors.

In one embodiment, the gaming system includes a circular indicator centered about the common center point. The circular indicator has: (a) a perimeter; (b) a plurality of indication areas arranged about the perimeter; and (c) at least one energy source configured to cause a visual output to sequentially appear at each one of the indication areas.

In one embodiment, the gaming system includes a plurality of light sources, where each one of the lights sources is associated with one of the indication areas.

In one embodiment, the gaming system includes a display screen, and the indications areas are images generated by the display screen.

In one embodiment, the gaming system includes a marker symbol generator which is configured to generate at least one marker symbol associated with at least one of the rotors.

In one embodiment, the gaming system includes a plurality of rotors, including one rotor positioned within a perimeter of another rotor. The rotors share a common center point or common axis, and each one of the rotors has a plurality of game symbols. Each one of the game symbols is indicatable by a ball, and the rotors are configured to be interchangeably operable in a plurality of modes, including: (a) a decoupled mode in which the rotors are rotatable independent of each other; and (b) a coupled mode in which the rotors are coupled to each other and rotatable as one assembly. The gaming system includes a rotor coupler configured to cause a change from the decoupled mode to the coupled mode. The rotor coupler has a game symbol aligner. The gaming system has a coupler actuator configured to: (i) receive an input while the rotors are rotating in the decoupled mode; and (ii) actuate the rotor coupler in response to the received input, where the actuation of the rotor coupler changes the decoupled mode to the coupled mode. The gaming system includes an award condition which is satisfied after: (x) the rotors rotate for a period in the decoupled mode; (y) the rotors rotate for a following period in the coupled mode; and (z) the ball indicates a combination of the symbols while the rotors are rotating in the coupled mode, where the combination includes at least one symbol of each of one of the rotors. The gaming system includes an award which is available as a result of the award condition being satisfied. The award is based on a wager.

Depending upon the embodiment, at least one of the rotors can have a plurality of ball landings, each one of the rotors can have a plurality of ball landings, or the gaming system can include a separate ball landing support sharing the common center point with the rotors.

In one embodiment, the rotor coupler has a plurality of rotor engagers, and each one of the rotor engagers is configured to engage one of the rotors.

Depending upon the embodiment, the rotor engagers can include at least one device selected from the group consisting of; (a) a gear, wherein a portion of at least one rotor has a plurality of gear teeth; and (b) a finger, wherein a portion of at least one rotor defines an engagement hole sized to receive the finger.

Depending upon the embodiment, the rotor coupler can include: (a) an electro-magnet; or (b) an air pressure source configured to produce an air pressure chamber positioned between the bottom of at least one of the rotors and the adjacent base support.

Depending upon the embodiment, the coupler actuator can include a motor, a stepper motor, a solenoid, an electric circuit, a voltage generator, a battery, a pump, a compressor, or an air pressurizer.

Depending upon the embodiment, the coupler actuator can include a wheel, a flywheel, a latch, a linkage, a spring, a crank, a cam, a pushrod, an extension, a pulley, a drive, a belt, a chain, a band, a shaft, a gear, a worm gear, a grasp or a handle.

Additional features and advantages are described herein, and will be apparent from, the following Detailed Description and the figures.

DETAILED DESCRIPTION

Gaming Device in General

Figure 1:
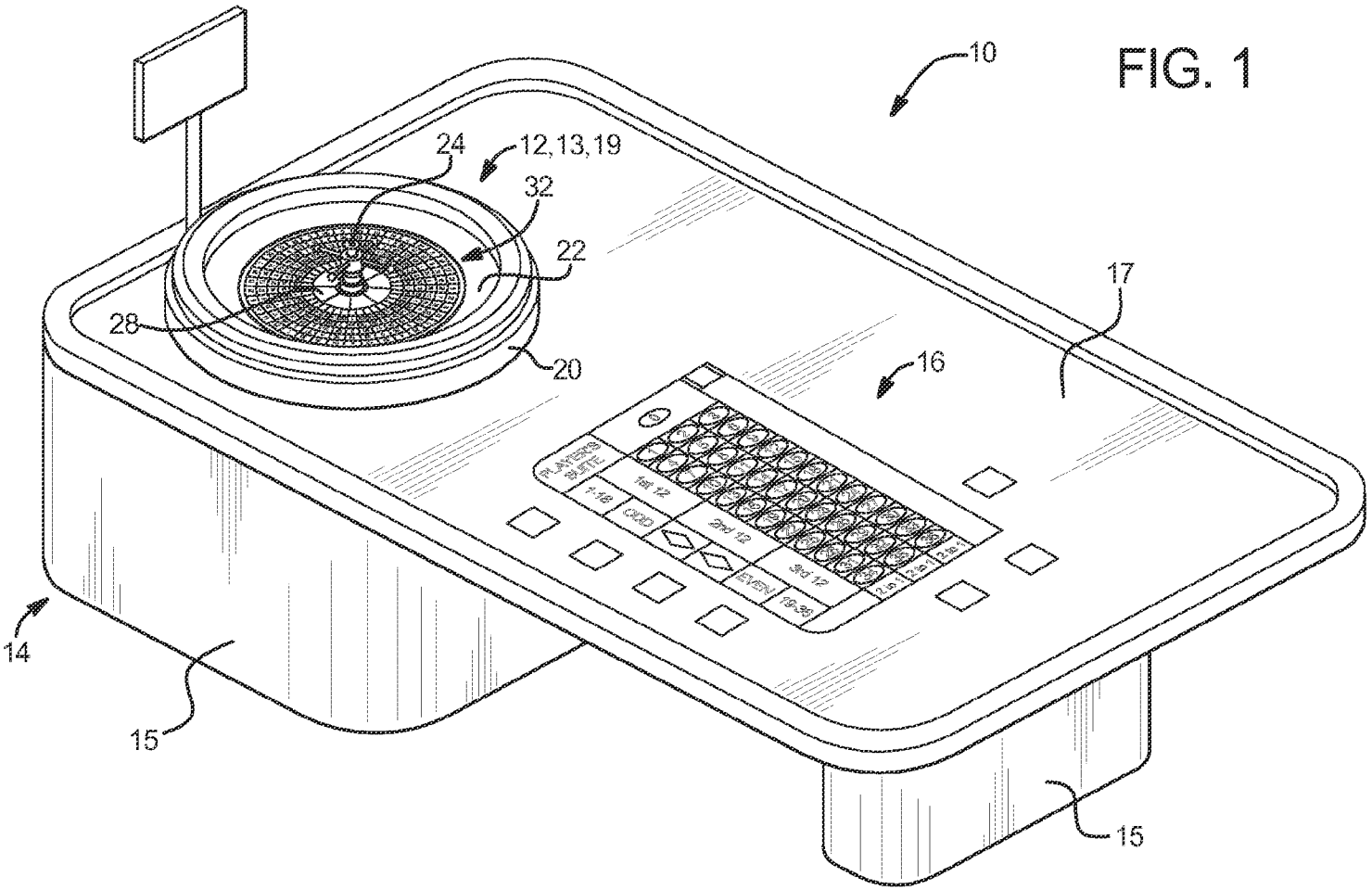
FIG. 1 is a perspective view of one embodiment of the gaming device.
Figure 2:
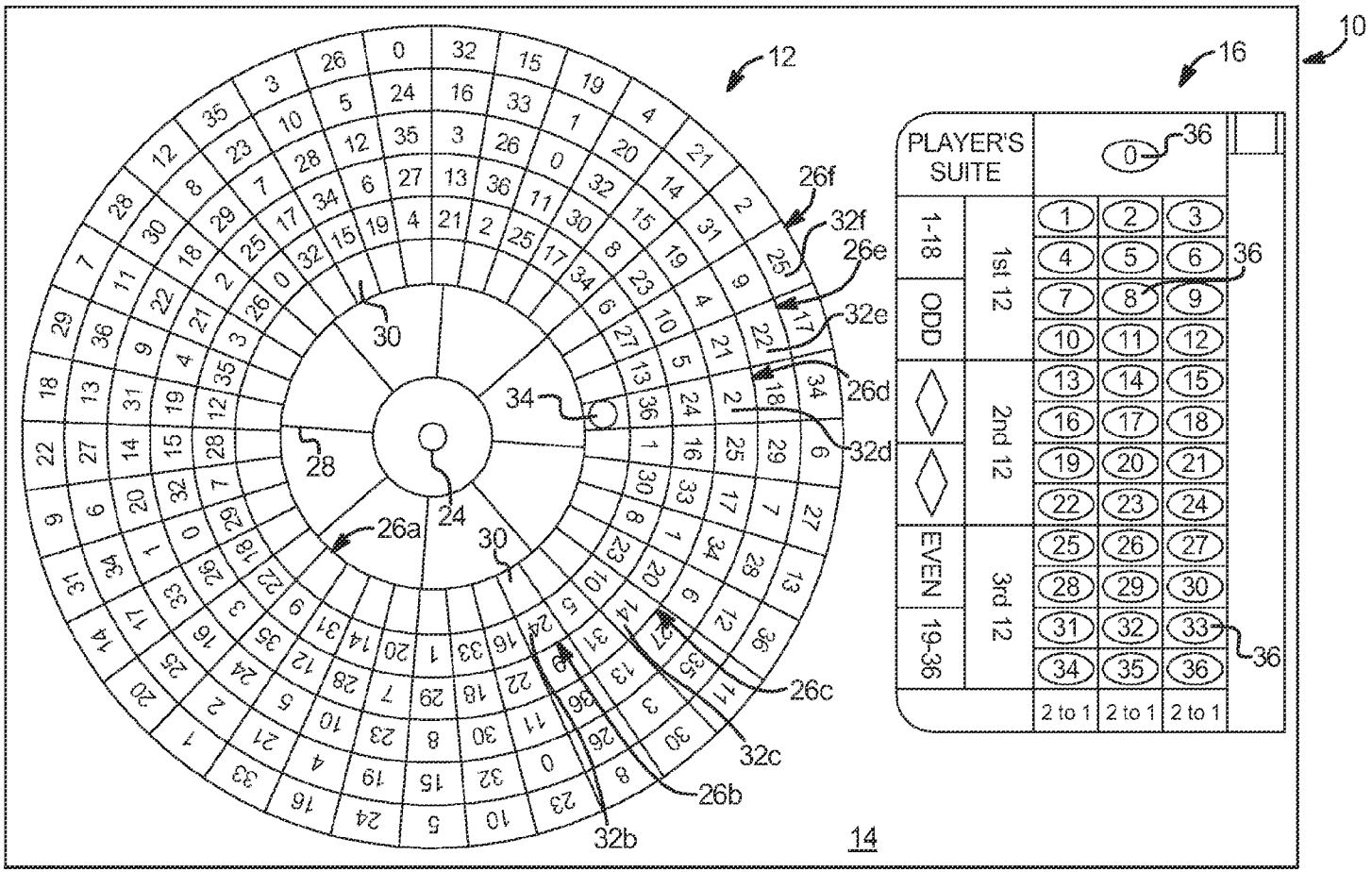
FIG. 2 is top view of the gaming device of FIG. 1.

Referring now to FIGS. 1 and 2, gaming table, gaming device or system 10, in one embodiment, includes a wheel assembly 12 supported by a support structure 14, such as a table or console. In on embodiment, the gaming table 10 includes: (a) a support structure 14 which has a plurality of legs 15; and (b) and a playing surface or tabletop 17 supported by the legs 15. The tabletop 17 has or displays a common wagering station 16.

The gaming table, device or system 10 is operable for the play of a roulette-related, multi-rotor primary game. Multiple players can play the roulette-related primary game at the same time. The wheel assembly 12 includes a plurality of rings, discs or substantially circular rotors 26*a*, 26*b*, 26*c*, 26*d*, 26*e*, and 26*f* which cooperate to determine multiple independent game outcomes for the bets placed by the players on the wagering station 16. The wheel assembly 12 and the wagering station 16 can be configured for the play of various types of roulette, including, but not limited to, American style roulette, European style roulette or any suitable variation of such styles.

Depending upon the embodiment, the multi-rotor game can be implemented in a mechanical, electro-mechanical or virtual form, as described in greater detail below. In one embodiment, a human dealer or computerized dealer can facilitate the operation of the rotors. In another embodiment, a computerized dealer can also facilitate the operation of the rotors through a data network or internet. It should be appreciated that a processor of the gaming device 10 or a central controller of a gaming system including the gaming device 10 can serve as the computerized dealer depending upon the embodiment. Irrespective of the implementation of the multi-rotor game, in one embodiment described further below, the multi-rotor game includes a plurality of rotors which provide additional game outcomes and additional winning opportunities to one or more players for each play of the multi-rotor game. The additional winning opportunities increase the excitement, enjoyment and volatility for the players. Additionally, extra wagering opportunities based on the additional game outcomes may be provided to the players in addition to, or in replacement of, one or more of the conventional wagering opportunities in the various types of Roulette games.

Figure 6:
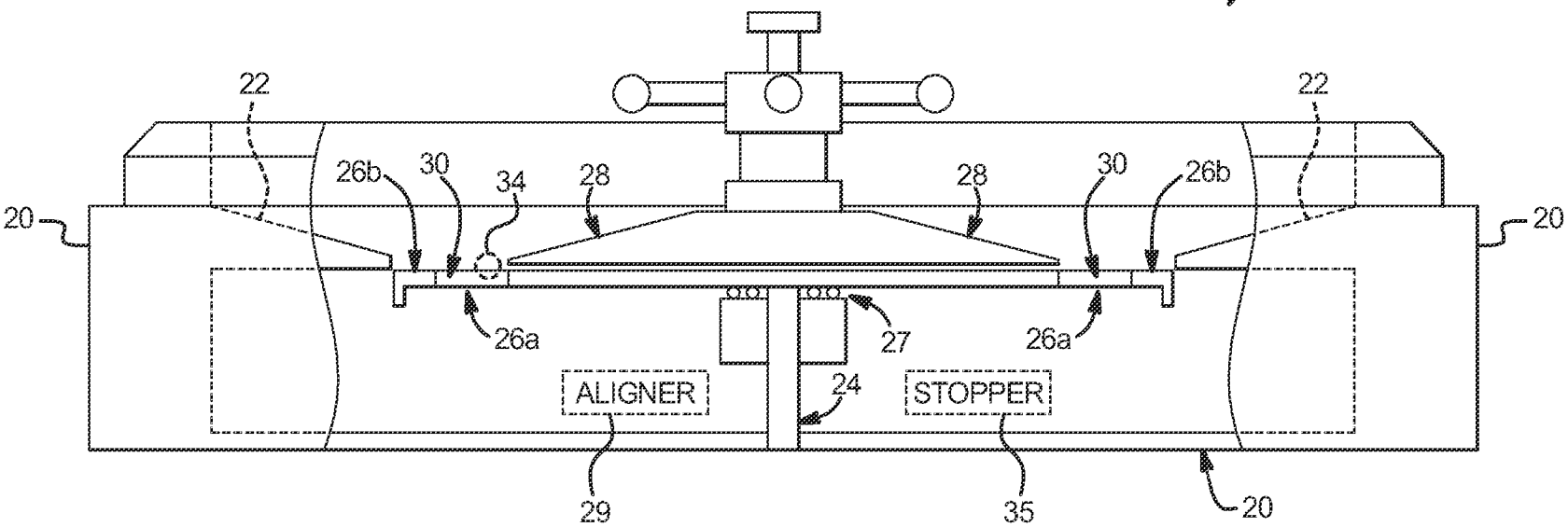
FIG. 6 is a side elevation, schematic view of a portion of the wheel assembly of FIG. 1.
Figure 7:
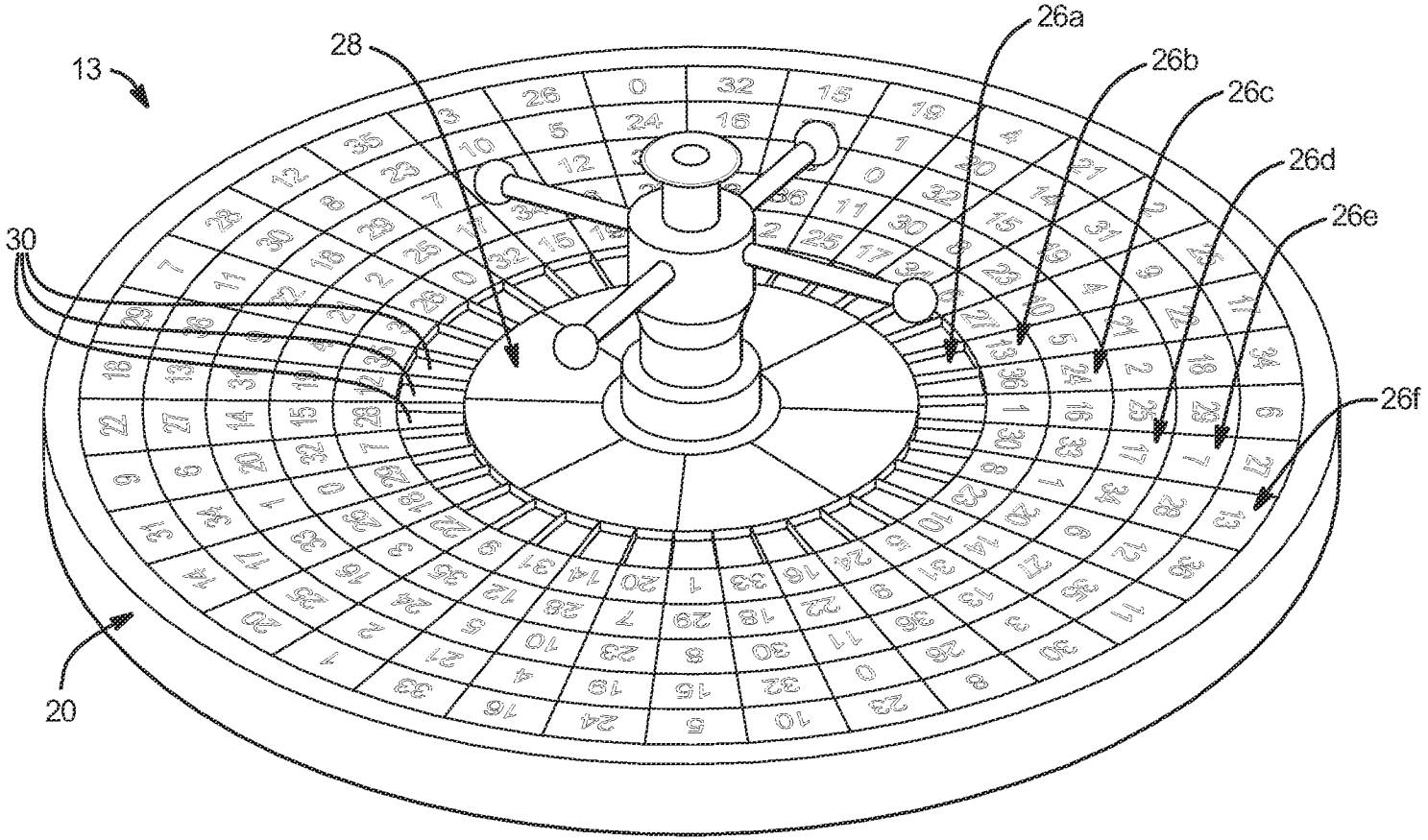
FIG. 7 is a top perspective view of a wheel assembly having first and second rotors in one embodiment of the gaming device.

In one embodiment illustrated in FIGS. 1, 2, and 6, the wheel assembly 12 includes a rotor assembly support or frame 20 that supports a sloped wall or bowl 22. A rod or spindle 24 extends vertically upward from a center of the frame 20. A bushing, set of bearings or other friction reducer 27 is connected to the spindle 24. A first or inner rotor 26*a* and a plurality of second or outer rotors 26*b*, 26*c*, 26*d*, 26*e*, and 26*f* are coupled to the friction reducer 27 and positioned concentrically within the substantially circular sloped wall 22. The inner rotor 26*a* and the outer rotors 26*b*-26*f* are rotatably supported by the frame 20 to rotate about the center. Referring to FIG. 6, an aligner, an alignment assembly or an alignment device 29, such as a gear assembly or stepper motor, aligns the inner rotor 26*a* with each of the second rotors 26*b*-26*f*. A conical plate 28 is connected to the spindle 24 to cover the inner portion of the rotor 26*a*. In one embodiment, the wheel assembly includes a housing that covers the frame 20. In another embodiment, the wheel assembly includes a substantially transparent or clear covering of any suitable shape that covers the frame 20 and the sloped wall 22.

Figures 3A, 3B, 3C, 3D:
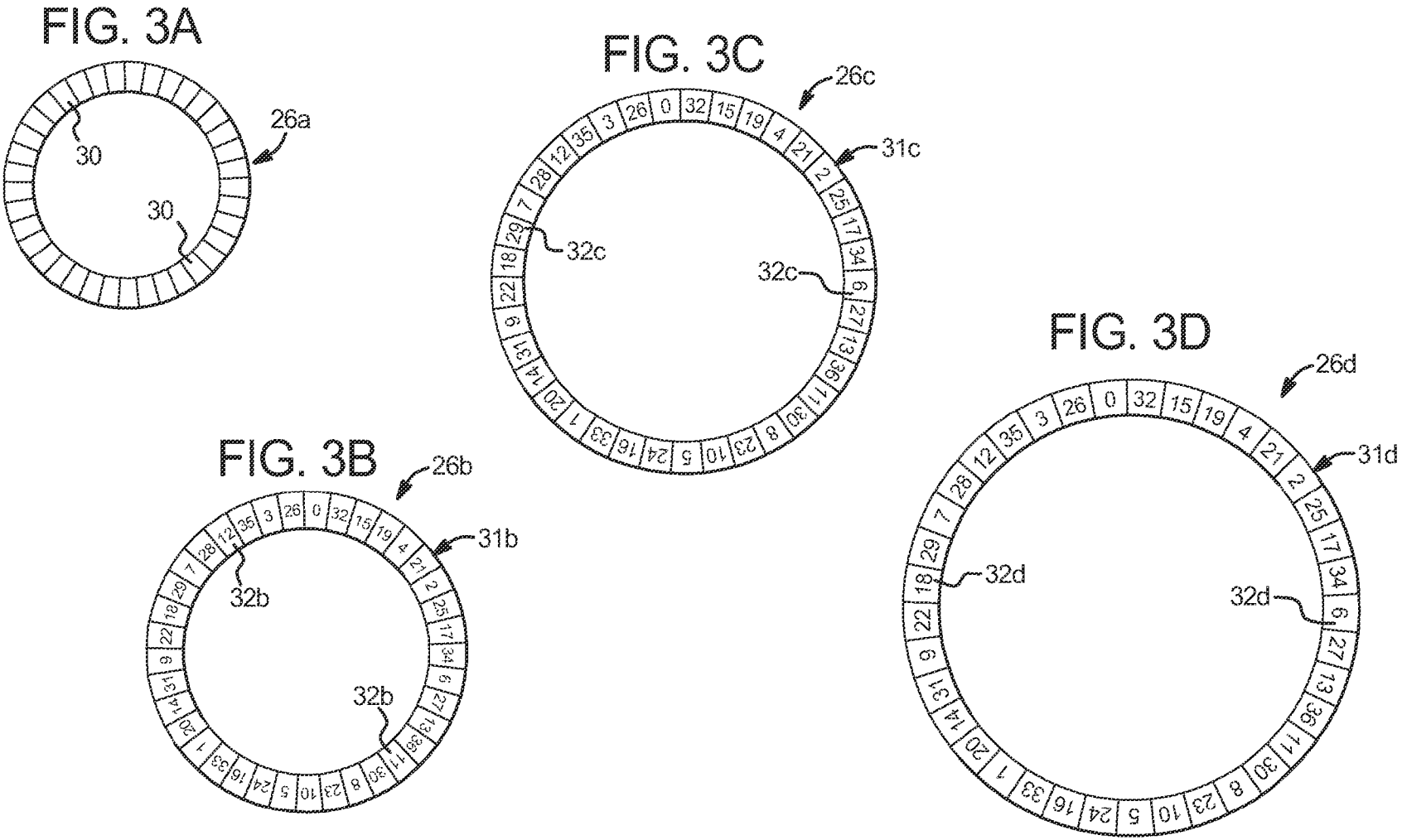
FIG. 3A is an enlarged top view of one embodiment of an inner rotor of the gaming device.
FIG. 3B is an enlarged top view of one embodiment of a first outer rotor of the gaming device.
FIG. 3C is an enlarged top view of one embodiment of a second outer rotor of the gaming device.
FIG. 3D is an enlarged top view of one embodiment of a third outer rotor of the gaming device.
Figure 3F:
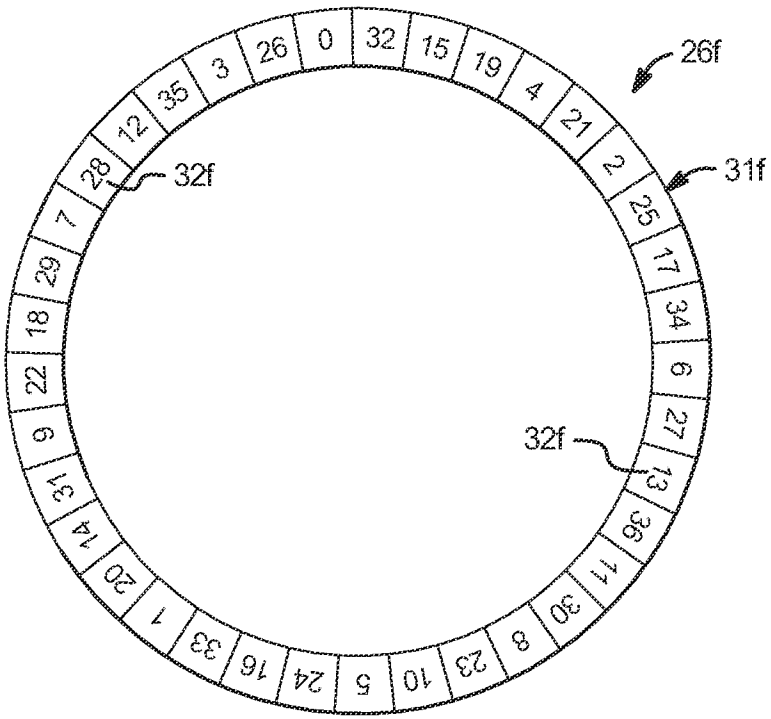
FIG. 3F is an enlarged top view of one embodiment of a fifth outer rotor of the gaming device, wherein the inner rotor of FIG. 3A and the outer rotors of FIGS. 3B to 3F constitute a wheel assembly in one embodiment of the gaming device.
Figure 3E:
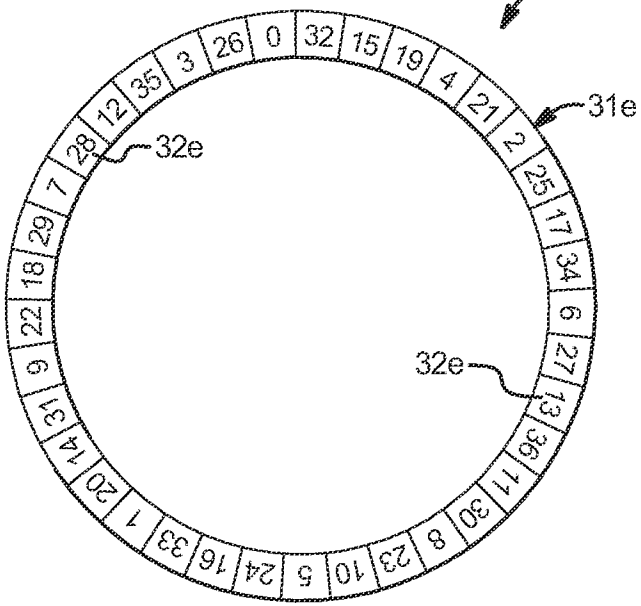
FIG. 3E is an enlarged top view of one embodiment of a fourth outer rotor of the gaming device.
Figure 4:
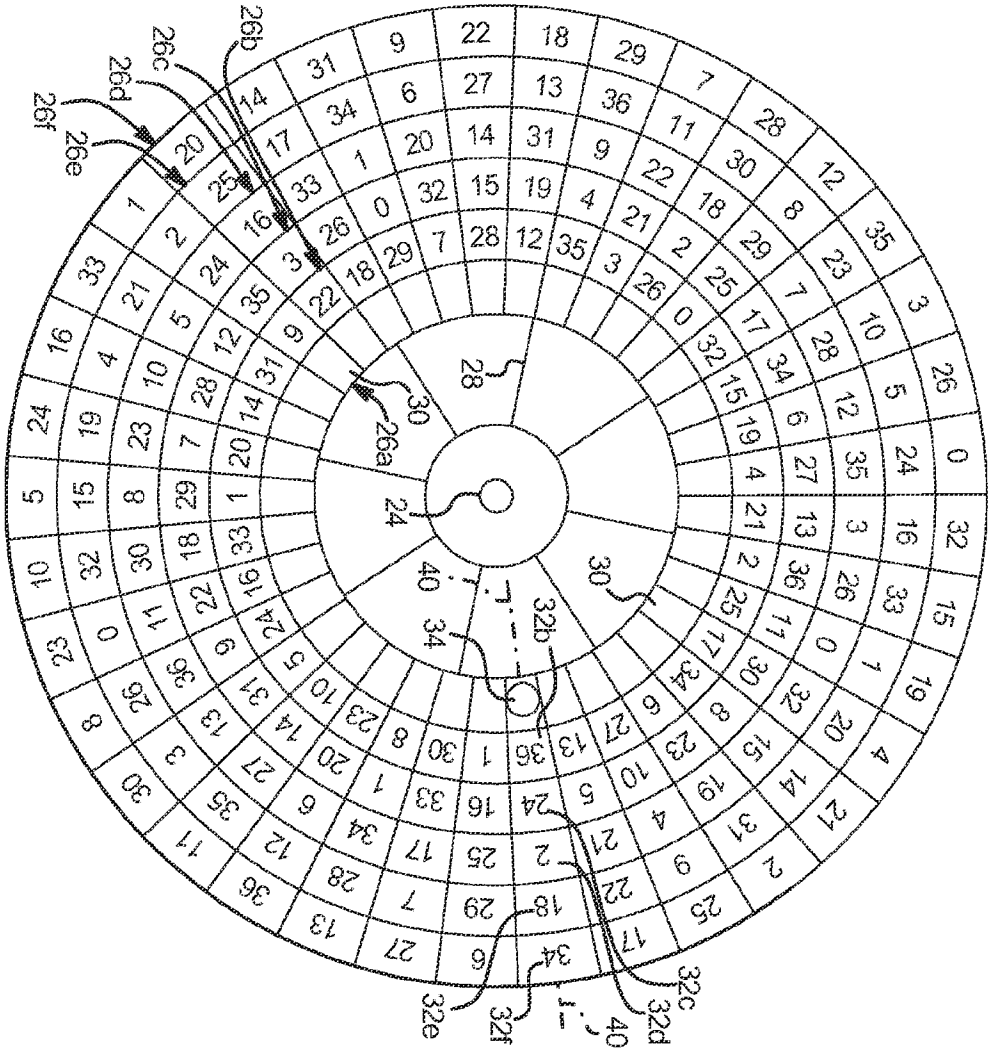
FIG. 4 is an enlarged top view of one embodiment of a wheel assembly of the gaming device, wherein the wheel assembly includes a plurality of outer rotors in a first position.
Figure 5:
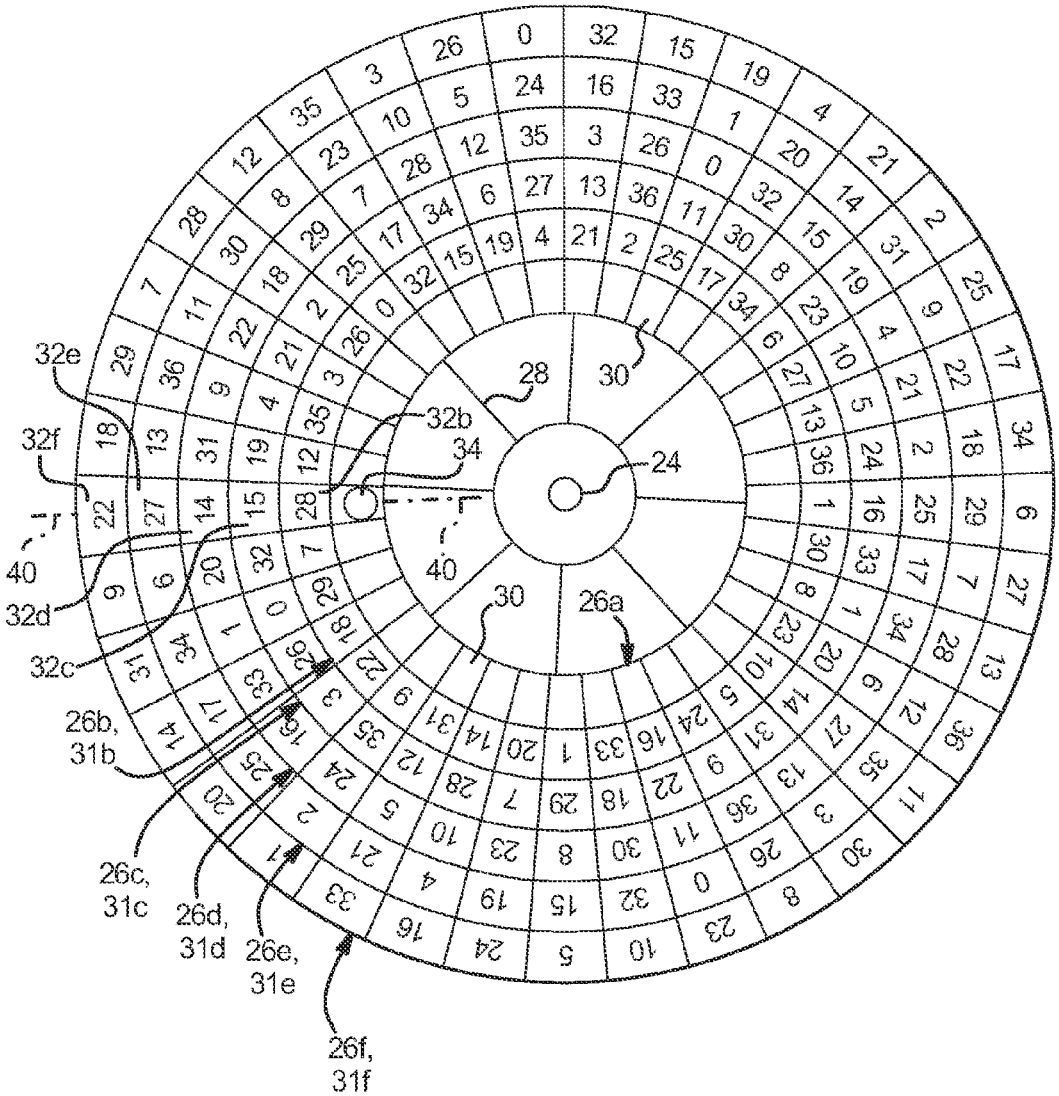
FIG. 5 is an enlarged top view of one embodiment of the wheel assembly of FIG. 4 with the plurality of outer rotors in a second position.

Referring now to FIGS. 3A through 5, a first or inner rotor 26*a* carries or supports a plurality of landings 30. A plurality of second or outer rotors 26*b*-26*f* encircle the inner rotor 26*a*. In one embodiment, the plurality of landings 30 define a center about which the rotors 26*a*-26*f* rotate. The inner rotor 26*a* is rotatably supported by the frame 20 so that the landings 30 are positioned adjacent to the conical plate 28. As illustrated in FIGS. 4 and 5, each landing 30 is sized to receive an indicator 34, such as a ball or any other suitable graphical or mechanical object. In one embodiment, the landings 30 are ball landings 30. The landing of the indicator or ball 34 on one of the landings 30 results in the simultaneous indication of multiple primary game outcomes associated with multiple rotors 26*b*-26*f* as described below.

In the embodiment illustrated in FIG. 3A, the inner rotor 26*a* carries or supports thirty-seven landings 30 circumferentially arranged about the inner rotor 26. It should be appreciated that the inner rotor 26*a* can carry or support any suitable number of landings 30. In one embodiment, not illustrated, the landings 30 are supported by an inner static ring rather than the rotatable rotor 26*a*.

Referring now to FIGS. 3B through 3F, each outer rotor 26*b*-26*f* carries or supports a symbol set 31*b*-*f* which includes a plurality of game symbols 32*b*-32*f*, respectively. In the illustrated embodiment, each symbol set 31*b*-*f* includes game symbols 32*b*-32*f* which each include numerals 1 to 36 and 0. It should be appreciated that the game symbols 32*b*-32*f* can include more or less numbers, such as 00, depending on the style or type of Roulette game. Depending upon the embodiment, the gaming device 10 may include more or less than the number of outer rotors 26*b*-26*f* and symbols 32*b*-32*f*.

In different embodiments, the game symbols 32*b*-32*f* include characters, numerals or symbols which may be identical or different. For example, one or more of the symbol sets 31*b*-31*f* may also include numerals 00,000 or any other suitable numeral or character. The game symbols 32*b*-32*f* are, at times, generally referred to herein as game symbols 32. Although the game symbols 32 are represented by numerals, it should be appreciated that the game symbols 32 may be displayed as alphanumeric characters or any other suitable character or image. In one embodiment, the game symbols 32 are associated with one or more colors, such as red, black or green, or other suitable characteristics. It should be appreciated that the rotors 26*a*-26*f*, the landings 30, and the game symbols 32 may be displayed in any suitable format and in any suitable spatial relationship or order by the gaming device 10. For example, the inner rotor 26*a* and the outer rotor 261 could be interchanged so that the inner rotor 26*a* and the landings 30 encircle the outer rotors 26*e*, 26*d*, 26*c*, 26*b*, and 26*f*. In this example, the outer rotor 26*f* is positioned adjacent to the conical plate 28 and the outer rotor 26*e* is positioned adjacent to the landings 30

With continued reference to FIGS. 4 and 5, the rotor 26*b* encircles the rotor 26*a* and positions the game symbols 32*b* adjacent to the landings 3*a* Rotor 26*c* encircles the rotor 26*b* and positions the game symbols 32*c* adjacent to the game symbols 32*b* of the rotor 26*b*. Rotor 26*d* encircles the rotor 26*c* and positions the game symbols 32*d* adjacent to the game symbols 32*c* of the rotor 26*c*. Rotor 26*e* encircles the rotor 26*d* and positions the game symbols 32*e* adjacent to the symbols 32*d* of the rotor 26*d*. Rotor 26*f* encircles the rotor 26*e* and positions the game symbols 32*f* adjacent to the symbols 32*e* of the rotor 26*e*. As illustrated, the rotors 26*b*-26*f* are concentrically arranged about the landings 30 of the inner rotor 26*a*. Accordingly, each landing 30 aligns with one of the game symbols 32*b*, 32*c*, 32*d*, 32*e*, and 32*f* on each outer rotor 26*b*-26*f*.

In one embodiment illustrated in FIG. 4, the outer rotors 26*b*-26*f* are in the same relative position. That is, the game symbols 32*b*, 32*c*, 32*d*, 32*e*, and 321 of each outer rotor 26*b*-26*f* rotor are aligned. For example, a first game symbol 32*b* (e.g., numeral "34") of the outer rotor 26*b* is aligned with a corresponding first game symbol 32*c*, 32*d*, 32*e*, and 32*f* (e.g., numerals "34") of the outer rotors 26*c*, 26*d*, 26*e*, and 26*f*. In this embodiment, the numerals 2 to 36 and 0 on the outer rotor 26*b* are aligned with the same numerals on the outer rotors 26*c*, 26*d*, 26*e*, and 26*f*. As illustrated, the indicator 34 is positioned in one of the landings 30 to indicate the numerals "34" of the outer rotors 26*b*-26*f*. Indicated game symbols 32 correspond to, or are otherwise associated with, in an independent game outcome.

In one embodiment illustrated in FIG. 5, the outer rotors 26*b*-26*f* are moved to different positions. Accordingly, the game symbols 32*b*-32*f* of each outer rotor 26*b*-26*f* rotor are moved to different positions. For example, a first game symbol 32*b* (e.g., numeral "22") of the outer rotor 26*b* is aligned with a first game symbol 32*c* (e.g., numeral "11") of the outer rotor 26*c*. The first game symbol 32*c* (e.g., numeral "11") of the outer rotor 26*c* is aligned with a first game symbol 32*d* (e.g., numeral "20") of the outer rotor 26*d*. The first game symbol 32*d* (e.g., numeral "20") of the outer rotor 26*d* is aligned with a first game symbol 32*e* (e.g., numeral "22") of the outer rotor 26*e*. The first game symbol 32*e* (e.g., numeral "22") of the outer rotor 26*e* is aligned with a first game symbol 32*f* (e.g., numeral "12") of the outer rotor 32*f*. As illustrated, the indicator 34 is positioned in one of the landings 30 to respectively indicate the numerals "22", "11", "20", "22", and "12" on the outer rotors 26*b*-26*f*. Indicated game symbols 32 correspond to, or are otherwise associated with, in an independent game outcome. That is, the gaming device 10 independently evaluates the numerals "22", "11", "20", "22", and "12" on the outer rotors 26*b*-26*f* to determine whether or not to provide an award or other outcome to a player.

Referring to FIG. 6, the wheel assembly 12 includes the alignment assembly or device 29 which radially aligns each landing 30 on the inner rotor 26*a* with a game symbol 32 on each second or outer rotor 26*b*-26*f*. In the embodiment illustrated, only outer rotor 26*b* is shown. Depending upon the embodiment, the alignment device 29 can be an instruction of a computer program or a mechanical element. In one embodiment, the alignment device 29 includes recesses or indentations in the inner and outer rotors 26*a*-26*f*. The recesses or indentations cooperate with abutments or other protrusions on the rotor assembly support or frame 20 to stop the inner rotor 26*a* and the outer rotors 26*b*-26*f* in specific, discrete positions. The abutments or protrusions extend from the rotor assembly support or frame 20 to engage the recesses or indentations in the inner and outer rotors 26*a*-26*f*. This engagement causes each landing 30 to align with a plurality of the game symbols 32.

In another embodiment, the alignment device 29 includes a gear assembly that limits movement of the rotors 26*a*-26*f* to specific, discrete positions. Alternatively, the alignment device 29 includes a motor with specific, discrete stops, such as a stepper motor, which limits the movement of the rotors 26*a*-26*f* to the specific, discrete positions. In such embodiments, the rotors 26*a*-26*f* stop so that one landing 30 or game symbol 32 is aligned on each rotor 26*a*-26*f*.

In the embodiment illustrated in FIG. 6, the wheel assembly includes a stopper or spin preventing mechanism 35 that holds stationary, or deactivates, one or more of the outer rotors 26*b*-26*f*. For example, the stopper 35 holds stationary the outer rotor 26*f* while the other outer rotors 26*b*-26*e* spin. Alternatively, in another embodiment, the stopper 35 holds the inner rotor 26*a* and the landings 30 stationary in lieu of, or in addition to, holding one or more of the outer rotors 26*b*-26*f* stationary. In one embodiment, the rotors 26*a*-26*f* remain stationary or deactivated for a designated number of spins (e.g., 1) or for a designated amount of time (e.g., 1 minute).

Referring back to FIGS. 1 and 2, the gaming device 10 includes a betting station or wagering station 16, which is sometimes referred to as the betting layout. In one embodiment, the wagering station 16 enables the player to place wagers with respect to one or more of the outer rotors 26*b*-26*f* for a single play of the game as described below. In another embodiment described below, the wagering station 16 is associated with a rotor tracker or rotor indicator that indicates which of the outer rotors 26*b*-26*f* the player placed a wager. In one embodiment, the wagering station 16 is operable to indicate wagers placed with respect to individual symbols 32 or a combination of symbols 32 which may appear on separate outer rotors 26*b*-26*f* as further described below.

In one embodiment, the wagering station 16 includes a plurality of wagering regions 36 which constitute a template which specifies a grid of numbers and betting options. The numbers in the grid correspond to the numbers or game symbols 32 on the outer rotors 26*b*-26*f*. The players place their wager markers or betting markers, such as at least one chip or token having a designated or desired denomination, on desired locations on the wagering station 16 in a conventional manner. Each said location corresponds to one or more specific numbers and, whose corresponding payout is based upon the quantity of numbers associated with that location. In one embodiment, locations that correspond to one specific number (e.g., twenty or "20") are associated with a payout that is greater than locations that correspond to a plurality of specific numbers (e.g., Black or Odd) as further described below.

Each player can control the risk and potential award levels by selecting one or more of the wagering regions 36 and a wager denomination, such as one dollar. Examples of the wagering regions 36 include inside bets or wagers and outside bets or wagers.

Inside bets include a single bet or wager in which each player can place the single bet to cover between one and six numbers. Examples of inside bets include:

| Inside Bet | Bet Description |
|---|---|
| Straight Bet: | Place a chip on one symbol on the wagering layout (e.g., 0, 00 (if available), 1, 12 or 23). |
| Split Bet: | Place a chip between two adjacent numbers on the wagering layout (e.g., 14 and 15). |
| Trio Bet: | Place a chip at an edge of a row to bet on the three numbers along a row on the wagering layout (e.g., 7, 8 and 9). |
| Corner Bet: | Place a chip on the corner of four adjacent numbers on The wagering layout (e.g., 22, 23, 25, and 26). |
| Four Number Bet: | Place a chip on an edge of the wagering layout between two adjacent rows of numbers containing 0, 1, 2, and 3. |
| Five Number Bet: | Place a chip on an edge of the wagering layout between two adjacent rows of numbers containing 0, 00 (if available), 1, 2, and 3. |
| Six Number Bet: | Place a chip on an edge of the betting layout between two adjacent rows of numbers (e.g., 16, 17, 18, 19, 20, and 21). |

Outside bets include a single initial bet or wager in which each player can place a single bet to cover an entire category of numbers. Outside bets include even money bets and two to one money bets. Examples of even money bets include:

| Even Money Bet | Bet Description |
|---|---|
| Even: | Any even valued number (e.g., 2, 4, 6, etc.) excluding 0 and 00 (if available). |
| Odd: | Any odd valued number (e.g., 1, 3, 5, etc.) excluding 0 and 00 (if available). |
| Red: | Any red number. |
| Black: | Any black number. |
| Low (1-18): | Any number 18 or lower, excluding 0 and 00 (if available). |
| High (19-36): | Any number 19 or greater, excluding 0 and 00 (if available). |

Two to one money bets include a dozens bet, wherein a player can place a single wager on three different sets of table rows to bet on, and a column bet, wherein a player can place a single wager on a column of numbers in the betting layout. Examples of dozens bets include:

| Dozens Bet | Bet Description |
|---|---|
| 1st 12: | Any number 1 through 12. |
| $2^{nd}$ 12: | Any number 13 through 24. |
| $3^{rd}$ 12: | Any number 25 through 36. |

Examples of column bets include:

| Column Bets | Bet Description |
|---|---|
| $1^{st}$ Column: | Any number of 1, 4, 7, 10, 13, 16, 19, 22, 25, 28, 31, and 34. |
| $2^{nd}$ Column: | Any number of 2, 5, 8, 11, 14, 17, 20, 23, 26, 29, 32 and 35. |
| $3^{rd}$ Column: | Any number of 3, 6, 9, 12, 15, 18, 21, 24, 27, 30, 33, and 36. |

In one embodiment, additional betting options are provided to the player. Such additional betting options include wagering areas 36 that enable a player to place bets on certain groups of numbers or certain sections of the outer rotors 26*b*-26*f*. For example, one wager area could group the numbers "9", "22", "18", "29" and "7". Accordingly, if a player wagers $25 on this wager area, the player effectively wagers $25 on each number of "9", "22", "18", "29" and "7". Sometimes these wagering options are referred to as neighbor bets or French bets. It should be appreciated that different quantities of numbers and different sections of the outer rotors 26*b*-26*f* could be used. This provides the players with a convenient way to place bets on a grouping or plurality of numbers at the same time.

In one embodiment, the betting options include wagering areas 36 that enable a player to place bets on certain numbers for each of the outer rotors 26*b*-26*f*. Each player wager constitutes a separate wager on each of the outer rotors 26*b*-26*f*. In this example, if the player bets on a numeral twenty-eight, the gaming device provides an award if the numeral twenty-eight is indicated on any of the outer rotors 26*b*-26*f*. In another embodiment, the betting options include wagering areas 36 that enable a player to place bets with respect to certain outer rotors 26*b*-26*f*. For example, if the player bets on outer rotors 26*b* and 26*d* and bets on a numeral one, the gaming device provides an award if the numeral one is indicated on the outer rotor 26*b*, the outer rotor 26*d*, or both.

In one embodiment, the award changes depending on how many times a numeral wagered on by a player is indicated by the outer rotors. For example, the gaming device increases a payout or award in proportion to the number of rotors which indicate a designated win or numeral on the outer rotors. In one embodiment, the gaming device provides a first award (e.g., of a designated value) if the numeral wagered on by the player is indicated by two of the outer rotors, and provides a second award (e.g., of higher value) if the numeral wagered on by the player is indicated by all of the outer rotors.

In one embodiment, the betting options include wagering areas 36 that enable a player to place bets on combinations of numbers of the outer rotors 26*b*-26*f*, For example, the player bets on a numeral combination including numerals four, five, and six, the gaming device provides an award if the ball lands so as to indicate the numeral combination of four, five, and six on any of the outer rotors 26*b*-26*f*. The order of the numeral combination may or may not factor into or change the award. For example, the gaming device provides an award for ascending or descending numerical sequences indicated by the outer rotors, such as 4-5-6 or 8-9-7. It should be appreciated that the sequences can be of any length and include any of the numerals associated with the outer rotors 26*b*-26*f*. In the above example with an ascending sequence, such as 4-5-6, three of the outer rotors 26*b*-26*f* align so that the numeral 4 is indicated by a first outer rotor (e.g., outer rotor 26*b*), the numeral 5 is indicated by a second outer rotor (e.g., outer rotor 26*c*) and the numeral 6 is indicated by a third outer rotor (e.g., outer rotor 26*d*).

In another embodiment, such additional betting options include wagering regions 36 that enable a player to place bets on a quantity of indications of a generic game outcome. In such embodiments, the gaming device increases a payout or award in proportion to the number of rotors which indicate a designated win or outcome on the outer rotors. For example, "MATCH ANY 2", "MATCH ANY 3", "MATCH ANY 4" or "MATCH ANY 5" could be available betting options with respective payouts based on the player's bet for outer rotors 26*b*-26*f*. In the following example, the gaming device includes three outer rotors 26*b*, 26*c*, and 26*d*. In this example, "MATCH ANY 2" and "MATCH ANY 3" are available betting options for specific numerals (e.g., "1", "3" or "30") with respective payouts of 10× and 100× of the player's bet. For such betting options, a player does not need to specify which numeral will be matched on the outer rotors 26*b*-26*d*. Instead, the player specifies how many times any of the numerals will be indicated on the outer rotors 26*b*-26*d*. For example, if the player wagers on "MATCH ANY 2", the player will win an award (e.g., 10× the player bet) if any numeral is indicated on at least two of the outer rotors 26*b*-26*f*. That is, if the player wagers on "MATCH ANY 2", the gaming device provides an award if any numeral is indicated on two of the outer rotors 26*b*-26*d*. For a "MATCH ANY 3" wager, the player will win an award (e.g., 100× the player bet) if any numeral is indicated on each of the outer rotors 26*b*-26*f*. 26*d*.

In another embodiment, such additional betting options include wagering regions 36 that enable a player to place bets on an increasing or decreasing order from the innermost rotor (e.g., outer rotor 26*b*) to the outermost rotor (e.g., outer rotor 26*f*). Such wagering options may include "INCREASING," "DECREASING," or any other suitable indication. For example, if a player wagers on "INCREASING," and the outer rotors 26*b*-26*f* indicate the numerals "5," "17," "20," "28" and "32" then the player would be provided an award based on the player's wager. In this example, outer rotor 26*b* indicates the smallest numeral (e.g., "5"), outer rotor 26*c* indicates the second smallest numeral (e.g., "17"), outer rotor 26*d* indicates the third smallest numeral (e.g., "20"), outer rotor 26*e* indicates the fourth smallest numeral (e.g., "28") and outer rotor 26*f* indicates the largest numeral (e.g., "32"). The "DECREASING" wagering option would work in a similar manner, but the numerals indicated by outer rotors 26*b*-26*f* would have to decrease in value.

In different embodiments, the "MATCH ANY 2", "MATCH ANY 3", "MATCH ANY 4" or "MATCH ANY 5" betting options are adapted for both the inside bets or wagers and the outside bets or wagers described above. For example, if the same numeral is indicated on each of the outer rotors 26*b*-26*d*, then the gaming device provides an award of 50× the player wager and if the same color or odd/even value is indicated on each of the outer rotors 26*b*-26*d*, then the gaming device provides an award of 3× the player wager.

It should be appreciated that the betting options described above could be adapted for both the inside bets or wagers and the outside bets or wagers described above. For example, a player can bet on the color black and the award will change depending on how many times a black symbol wagered on by a player is indicated by the outer rotors. In this example, the gaming device increases a payout or award in proportion to the number of rotors which indicate a designated win (e.g., a black symbol or numeral) on the outer rotors.

In one embodiment, the operation of the gaming device 10 is based on a system of game play corresponding to a Roulette game. In one embodiment, the object of the game system is for each player to anticipate where the ball or indicator will land on the inner rotor 26*a* and the outer rotors 26*b*-26*f* by placing desired bets. The gaming device 10 is a multi-player, multi-bet system which enables a plurality of players to simultaneously place bets.

In operation of one example game play, each player places one or more bets using the wager station 16 adjacent to the wheel assembly 12. In one embodiment, each wager corresponds to one of the outer rotors 26*b*-26*f*. Upon the placement of one or more wagers by one or more players, the dealer spins the outer rotors 26*b*-26*f* and launches the indicator or ball 34 as described below. The indicator or ball 34 stops in, or is received by one of the landings 30 on the first rotor 26*a*. When the indicator or ball 34 stops spinning, the stopped indicator or ball 34 indicates an outcome of the rotor spin (i.e., one of the game symbols 32*b*-32*f* on respective outer rotors 26*b*-26*f* and the associated landing 30 on the inner rotor 26*a*). In the embodiment illustrated in FIGS. 4 and 5, the game symbols 32*b*-32*f* carried by the outer rotors 26*b*-26*f* radially align with the indicator 34 along an outcome line 40. Depending upon the embodiment, the outcome line 40 may or may not be displayed (or otherwise may be invisible or visible) and represents a payline for the rotor spin. If an individual indicated outcome 32*b*-32*f* or a combination of indicated outcomes 32*b*-32*f* along the outcome line 40 correspond to a winning outcome (i.e., matches one or more outcomes wagered on by the player), the dealer provides an award to the player based on the placed wagers in accordance with a paytable associated with the gaming device 10. In the example illustrated in FIG. 4, the line 40 extends through game numerals six, twenty-nine, twenty-five, sixteen and one.

In different embodiments, the gaming device 10 or the dealer causes the inner rotor 26*a*, a plurality of the outer rotors 26*b*-26*f*, all of the outer rotors 26*b*-26*f* or a combination thereof to spin. Spinning or holding (i.e., not spinning) certain of the rotors 26*a*-26*f* is determined by the game implementer and/or in accordance to the game logic.

In one embodiment, the dealer spins each of the outer rotors 26*b*-26*f* independently. Each outer rotor 26*b*-26*f* spin relative to one another. The dealer can spin each of the outer rotors at substantially the same time or sequentially. Then, the dealer launches the indicator or ball 34 onto the spinning outer rotors 26*b*-26*f*. In this embodiment, the inner rotor 26*a* remains stationary so that the landings 30 do not rotate. Each outer rotor 26*b*-26*f* stops spinning such that one game symbol 32*b*-32*f* on each outer rotor 26*b*-26*f* aligns with one of the landings 30 on the first rotor 26*a*. The indicator or ball 34 stops in one of the landings 30 to indicate a game symbol 32 on each outer rotor 26*b*-26*f*. The combination of game symbols 32 indicated by and aligned with the landing 30 constitute game outcomes. For example, referring back to FIG. 5, the indicator 34 is positioned in one of the landings 30 to respectively indicate the numerals "22", "11", "20", "22", and "12" on the outer rotors 26*b*-26*f*. These numerals represent multiple game outcomes associated with the landing 30. The dealer settles any bets placed on the wagering station for each outer rotor 26*b*-26*f* based on the indicated game outcomes in accordance with a conventional Roulette paytable.

Conventional Roulette paytables associate an outcome with a respective award, such as a multiplier. For example, even money outcomes (e.g., Red or Black, Even or Odd, and High or Low) pay 1× (or one times) the player bet for each occurrence. For example, if a player wagered $1 on black for one play of each outer rotor 26*b*-26*f*, and black game symbols 32 occur on the outer rotors 26*b*, 26*d*, and 26*f*, the gaming device 10 provides the player with $3 (e.g., 3×$1=$3) as well as the original bet on each of the three winning rotors for a total of $6 returned to the player. Similarly, straight outcomes (e.g., a single numeral) pay 35× (or thirty-five times) the player bet for each occurrence. For example, the gaming device 10 provides the player with $175 (e.g., 35×$1×5=$175) if the player wagered on the numeral "34" for one play of each outer rotor 26*b*-26*f*, and the numeral "34" occurs on the outer rotors 26*b*-26*f*. In other words, gaming device provides the player with 35× (or thirty-five times) the player bet for each occurrence of the numeral "34" on the outer rotors 26*b*-26*f*. In this example, the gaming device provides the player with an award of $175 (e.g., 1×$35+1×$35+1×$35+1×$35+1×$35=$175) or (e.g., 5×$35=$175) for each $1 wager placed on each of outer rotors 26*b*-26*f*, and the player would also receive the player's bet ($1) back on each of the five rotors for a total payback of $180.

In different embodiments, it should be appreciated that any suitable paytable can be associated with the gaming device 10. Such paytables can be stored by the gaming device. Alternatively, such paytables are stored remotely at a central server or controller and accessible to the gaming device as needed (e.g., upon the occurrence of a specific game event). In one embodiment, the paytable associated with the gaming device 10 is predetermined, randomly determined, determined or weighted based on the player's wager, determined or weighted based on the status of one or more players (such as determined through a player tracking system), determined based on time, or determined based on any other suitable factor.

Figure 9:
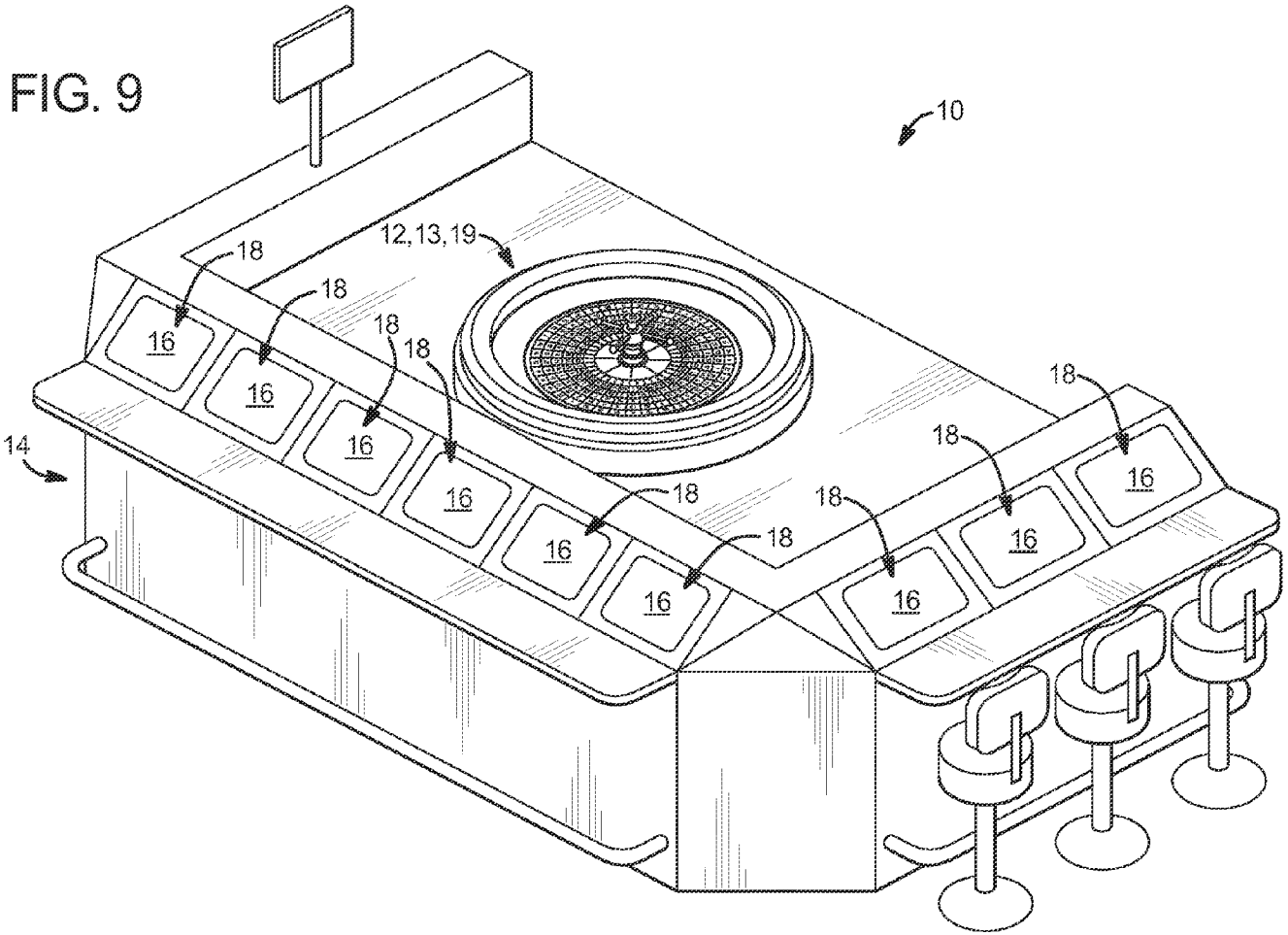
FIG. 9 is a front perspective view of an electromechanical configuration of one embodiment of the gaming device.

In one alternative embodiment, such as the embodiment illustrated in FIGS. 1 and 9, a threshold number of indications of certain game outcomes on the outer rotors 26*b*-26*f* qualifies the player for an award. For example, the gaming device provides a first award (e.g., of low value) if the game outcome wagered on by the player is indicated by two of the outer rotors 26*b*-26*f*, provides a second award (e.g., of moderate value) if the game outcome wagered on by the player is indicated by three or four of the outer rotors 26*b*-26*f*, and provides a large award (e.g., of high value) if the numeral wagered on by the player is indicated by all of the outer rotors 26*b*-26*f*. In such embodiments, the size of the award is based on the designated number of indications.

In one embodiment, such as the embodiment illustrated in FIG. 9, the gaming device 10 has a rotor tracker or other suitable indicator operable to visually display which of the outer rotors 26*b*-26*f* are active for a particular player. The rotor tracker can graphically or mechanical indicate the number of outer rotors 26*b*-26*f* that are active as well as identify which of the outer rotors 26*b*-26*f* are active. In one embodiment, the rotor tracker displays five tracking regions or positions on the wagering station 16. Each tracking region corresponds to a different one of the outer rotors 26*b*-26*f*. In one embodiment, players place a marker, such as a chip or token in mechanical or graphical form, on one or more of the tracking regions to activate the corresponding outer rotor 26*b*-26*f* (or to show which of the outer rotors 26*b*-26*f* are active) for a play of the game for each player. In one embodiment, different colors or other characteristics are associated with the markers to distinguish between players. Depending upon the embodiment, the rotor tracker and/or the tracking regions can be displayed in any suitable graphical or mechanical form. In one embodiment, the rotor tracker includes a plurality of indicator lights corresponding to each of the outer rotors 26*b*-26*f*. The indicator lights illuminate to show which of the rotors 26*b*-26*f* are active for a play of the game. In one embodiment, a different set of indicator lights is provided for each player so that the outer rotors 26*b*-26*f* activated by each player for the play of the game can be indicated or determined.

It should be appreciated that the awards may include any suitable type of award such as a bonus award, a progressive award, a bonus game, a free spin, a bonus spin of one of the rotors 26*a*, 26*b*, 26*c*, 26*d*, 26*e*, and 26*f*, a free or discounted game, and a triggering event for another game or award. The awards may be fixed, such as a predetermined percentage or amount relative to the award associated with the indicated game outcome in the paytable.

In an additional embodiment, the gaming device provides an award if the sum of the outcomes of the multiple rotors is within a range of sums selected by the player. In another embodiment, the gaming device provides an award if the sum of the outcomes of the multiple rotors is an even number. In another embodiment, the gaming device provides an award if a majority of the outcomes of the multiple rotors are even numbers. In another embodiment, the gaming device provides an award if the sum of the outcomes of the multiple rotors is an odd number. In another embodiment, the gaming device provides an award if a majority of the outcomes of the multiple rotors are odd numbers.

In another embodiment, the gaming device provides an award if a player-selected color is the outcome of exactly k number of rotors, wherein $k \leqq n$, and n is the total number of rotors. In another embodiment, the gaming device provides an award if a player-selected color is the outcome of k or more number of rotors, wherein $k<n$, and n is the total number of rotors.

In another embodiment, the gaming device provides an award if the outcome of each one of the multiple rotors is an even number. In another embodiment, the gaming device provides an award if the outcome of each one of the multiple rotors is an odd number.

In another embodiment, the gaming device provides an award if a certain sequence or pattern of outcomes occurs within a given play of the game. In another embodiment, the gaming device provides an award if a certain sequence or pattern of outcomes occurs over two or more plays of the game. In one embodiment, such pattern is formed and recordable on a Keno grid. In another embodiment, such pattern is formed and recordable on an American-style bingo grid. In another embodiment, such pattern is formed and recordable on a European-style bingo grid. In another embodiment, such pattern is formed and recordable on a grid depicting the board game of Battleship.

In one embodiment, the gaming device or gaming system includes logic which enables the player to select how many of the rotors to be active for the player's play of the game. For example, if the wheel assembly 12 has rotors A, B and C, the player may select or activate rotors A and C for the player's play. Next, the player may place wagers for the outcomes of rotors A and C. The gaming device then provides an outcome to the player based on the spinning and stopping of rotors A and C. This embodiment provides a player with the opportunity to selectively activate or deactivate one or more of the multiple rotors.

In different embodiments, the wheel assembly 12 is operated in a variety of sequences. Each sequence provides for different implementations or operations of the rotors 26*a*-26*f*. It should be appreciated that in different sequences the inner rotor 26*a* and each outer rotor 26*b*-26*f* are configured to (i) start spinning at substantially the same time or at different times depending upon the embodiment, (ii) stop spinning at substantially the same time or at different times depending upon the embodiment, (iii) be held stationary (or deactivated) for one or more spins or be spun (or activated) for one or more spins depending upon the embodiment, or (iv) spin at the same speed or at different speeds depending upon the embodiment. In different embodiments, each of these factors are predetermined, randomly determined, determined or weighted based on the player's wager, determined or weighted based on the status of one or more players (such as determined through a player tracking system), determined based on time, or determined based on any other suitable factor as determined by the game logic.

It should be appreciated that one or more players have the opportunity to place wagers on a plurality of game outcomes (such as symbol combinations) on a plurality of outer or secondary rotors. That is, the sequences provide one or more players a plurality of wagering opportunities for each spin of the outer or secondary rotors. For example, if the sequence involves a wheel assembly that includes five outer or secondary rotors, each player wager constitutes a separate wager on each of the five outer or secondary rotors. For example, if the player bets on a numeral seven, the player wager constitutes a separate wager on the numeral seven for each of the five outer or secondary rotors. If the numeral seven is indicated on any of the outer rotors, the gaming device provides an award to the player. In another example, the player bets on a numeral combination including numerals four, five, and six. If the numeral combination of four, five, and six is indicated on the outer rotors (in exact order or in any other order), the gaming device provides an award to the player.

It should also be appreciated that the sequences can involve one or more bonus games or sub-games. For example, each sequence provides one primary game which includes the landings and at least one outer or secondary rotor. Each sub-game includes at least one additional outer rotor that cooperates with the landings. In one such embodiment, the primary game includes a series of landings and a rotor that carries a series of game symbols. Each bonus game adds an additional rotor that carries an additional series of game symbols to the primary game.

For example, the wheel assembly includes a primary rotor for the play of the primary game and a bonus rotor for play of one bonus game. In this example, the bonus rotor carries an additional series of bonus game symbols. In one embodiment, the bonus game symbols include at least one of: (a) a blank symbol, (b) a bonus symbol which triggers another bonus game or sequence, (c) a modifier symbol, such as "2× pay" to double an award or "half pay" to halve an award, (d) a respin symbol, which enables the player to respin one or more rotors 26*b*-26*f* either selectively or randomly, (e) a knockout symbol that reduces the number of possible game outcomes for one or more spins (e.g., remove the "0" or "00" numerals from at least one of the rotors 26*b*-26*e* for one or more spins), and (f) a whammy symbol which causes any wager on any indicated outcome to be a losing wager for that particular spin.

In one embodiment, the gaming system includes an escalating advancement system. According to the escalating advancement system, the player places a wager on a desired outcome. At the beginning of play, all of the rotors are inactive. Once play begins, only the first rotor activates and spins, while the other rotors remain inactive. If the ball or indicator indicates the wagered upon outcome, the player receives a first award. Then, the second rotor automatically activates for the second spin requiring no additional wager from the player. During the spin of the second rotor, all of the other rotors remain inactive. If the ball or indicator indicates the wagered upon outcome, the player receives a second award. Depending upon the embodiment, the second award can be greater than the first award. This process of activating rotors one by one continues until a termination event occurs. In one embodiment, the termination event is the ball or indicator indicating a numeral other than the wagered upon numeral. Put another way, the game is terminated once the player's whining streak is broken.

In one example, the player bets on the numeral twelve. For this example, the rotors will be described as rotor one, rotor two, rotor three and rotor four, moving from inward to outward, where rotor one is the far most inner rotor. After the bet is placed, rotor one spins. When rotor one stops, the ball indicates the numeral twelve, so the player wins fifty credits. Automatically, rotor two becomes active and spins as a free spin, that is, without requiring any additional wager from the player. The player wins the same bet (i.e., the numeral twelve) on rotor two. In this example, the player wins one hundred credits, double the first award. Automatically, rotor three becomes active and spins as a free spin, that is, without requiring any additional wager from the player. In this example, the player ball or indicator indicates the numeral fifteen on rotor three, breaking the player's winning streak. Therefore, the game is terminated. If the player had won the same bet (i.e., the numeral twelve) on rotor three, the player would have received one hundred fifty credits, triple the amount of the first award.

Referring back to FIGS. 1-9, in a first example sequence, the dealer causes each of the outer rotors 26*b*-26*f* to spin independent of, and relative to, the inner rotor 26*a*. Depending upon the embodiment, the outer rotors 26*b*-26*f* are spinnable as a set or separately. Each outer rotor 26*b*-26*f* stops spinning so that one game symbol 32 aligns with one of the landings 30 on the inner rotor 26*a*. After the outer rotors 26*b*-261 stop spinning, the dealer causes the indicator or ball 34 to be launched onto the stopped outer rotors 26*b*-26*f*. The landing 30 which receives the indicator or ball 34 indicates a game outcome 32 on each outer rotor 26*b*-26*f* aligned with this landing 30. The dealer then settles any bets placed on the wagering station 16 (i.e., provides any awards to the players) based on the indicated game outcomes 32. In another embodiment, the dealer causes the indicator or ball 34 to be launched onto the outer rotors 26*b*-26*f* while the outer rotors are still spinning.

In a second example sequence, the dealer causes each of the inner and outer rotors 26*a*-26*f* to spin relative to one another. That is, the inner rotor 26*a* and the outer rotors 26*b*-26*f* independently spin in this embodiment. The inner and outer rotors 26*a*-26*f* stop spinning so that each landing 30 on the inner rotor 26*a* aligns with one game symbol 32 on each outer rotor 26*b*-26*f*. After the landings 30 align with the game symbols 32 of the outer rotors 26*b*-26*f*, the dealer launches the indicator or ball 34 onto the stopped inner and outer rotors 26*a*-26*f*. The landing 30 which receives the indicator or ball 34 indicates a game outcome 32 on each outer rotor 26*b*-26*f*. The dealer then settles any bets placed on the wagering station 16 based on the indicated game outcomes 32. In another embodiment, the dealer causes the indicator or ball 34 to be launched onto the rotors 26*a*-26*f* while (i) the inner rotor 26*a* is spinning, (ii) one or more of the outer rotors 26*b*-26*f* are spinning, or (iii) any combination of the inner rotor and the outer rotors 26*a*, 26*b*, 26*c*, 26*d*, 26*e*, and 261 are spinning.

In a third example sequence, the dealer spins the inner rotor 26*a* and the outer rotors 26*b*-26*f* relative to one another. At least one of the inner and outer rotors 26*a*-26*f* continues to spin so that each landing 30 on the inner rotor 26*a* aligns with one game symbol 32 on each second rotor 26*b*-26*f*. The landings 30 align with the game symbols 32 of the second rotors 26*b*-26*f* while at least one of the first and second rotors 26*a*-26*f* is spinning. After the landings 30 align with the game symbols 32 of the outer rotors 26*b*-26*f*, the dealer launches the indicator or ball 34 onto the inner and outer rotors 26*a*, 26*b*, 26*c*, 26*d*, 26*e*, and 26*f*. The landing 30 which receives the indicator or ball 34 indicates a game symbol 32 on each second rotor 26*b*-26*f*. The dealer then settles any bets placed on the wagering station 16 based on the indicated game symbols 32.

In a fourth example sequence, the innermost rotor 26*a* and one or more of the rotors 26*b*-26*f* are mechanically or graphically linked or coupled to each other and do not move relative to one another. For example, the outer rotor 26*b* and the inner rotor spin 26*a* are coupled so as to be spinnable together as a single rotor. Such single rotor enables the game symbols 32*b* of the outer rotor 26*b* to spin together with the landings 30 of the inner rotor 26*a*. Such single rotor spins independent of any other outer rotors 26*c*-26*f* included in the wheel assembly 12. That is, the remaining outer rotors 26*c*-26*f* spin independent of, and relative to, such single rotor (i.e., rotors 26*a* and 26*b*). That is, the game symbols 32*c*-32*f* of the outer rotors 26*c*-26*f* spin or rotate relative to the landings 30 and the game symbols 32*b* of such single rotor.

In a fifth example sequence, all of the outer rotors 26*b*-26*f* are coupled together so as to spin as one, single rotor. That is, the plurality of outer rotors form parts of a single rotor which spins or rotates relative to the inner rotor 26*a*. Alternatively, a plurality (but not all) of the outer rotors 26*b*-26*f* form parts of a single rotor which spins or rotates relative to the inner rotor 26*a*.

In the above sequences, the number of outer rotors activated, or otherwise used to determine an award, can vary based on the wager or bet placed by each player. For example, to activate one of the rotors 26*b*-26*f*, a player places a wager for that rotor. To activate another one of the rotors 26*b*-26*f*, the player places another wager for that rotor. It should be appreciated that the number of outer rotors activated, or otherwise used to determine an award, can vary randomly, based on wager amount, or based on a predetermined event.

In another embodiment, it should be appreciated that a player identification or a player status (as determined by a suitable player tracking system) can vary the number of outer rotors activated, or otherwise used to determine an award. In one example of this embodiment, the gaming device includes five outer rotors. The gaming device identifies players and activates (or deactivates) one or more outer rotors based on an identification or a player status (as determined by a suitable player tracking system) of the player. That is, the player's status or identification determines how many, or which of, the outer rotors are activated for that game. For example, if a player is uncarded or unidentifiable, the gaming device activates only two of five available outer rotors. If the player is identified to have a bronze player status, the gaming device activates three outer rotors. If the player is identified to have a silver player status, the gaming device activates four outer rotors. If the player is identified to have a gold player status, the gaming device activates all five outer rotors.

In one embodiment, where several players have different player statuses, the gaming device activates all of the outer rotors and determines any award based only on those rotors which apply to each player. For example, if different players of the game have different identifications or player statuses, the gaming device activates all five of the outer rotors. For uncarded players, only the game outcomes indicated by two of the five available outer rotors (e.g., the two innermost outer rotors 26*b* and 26*c*) determine an award for these players. That is, the three outermost outer rotors (e.g., outer rotors 26*d*, 26*e*, and 26*f*) are ignored for award purposes with the uncarded players. For bronze status players, only the game outcomes indicated by the three innermost outer rotors (e.g., outer rotors 26*b*, 26*c*, and 26*d*) determine an award for these players. That is, the outermost two outer rotors (e.g., outer rotors 26*e* and 26*f*) are ignored for award purposes with the bronze status players. In such example, the application of the outer rotors is player-specific.

In one embodiment, a player must place a designated type or amount of wager to qualify for one or more additional outer rotors. This can be referred to as a buy-a-pay or a buy-a-rotor proposition. For example, a bronze status player can place a side wager or an additional wager to activate the remaining two outer rotors (e.g., rotors 26*e* and 26*f*) for award purposes. In one embodiment illustrated in FIG. 7, the wheel assembly 13 is the same as wheel assembly 12 except that wheel assembly 13 includes additional outer rotors 26*c*-26*f*. Wheel assembly 13 includes: (a) inner rotor 26*a* which includes a plurality of pockets or ball landings 30; and (b) outer rotors 26*b*-26*f*. Rotor 26*a* is positioned adjacent to the conical plate 28 and concentric with the other rotors 26*b*-26*f*. Each of such rotors is supported by a sloped wall or bowl 20. The landing of a ball on one of the landings 30 determines at least one outcome for the players, as described above.

Figure 8:
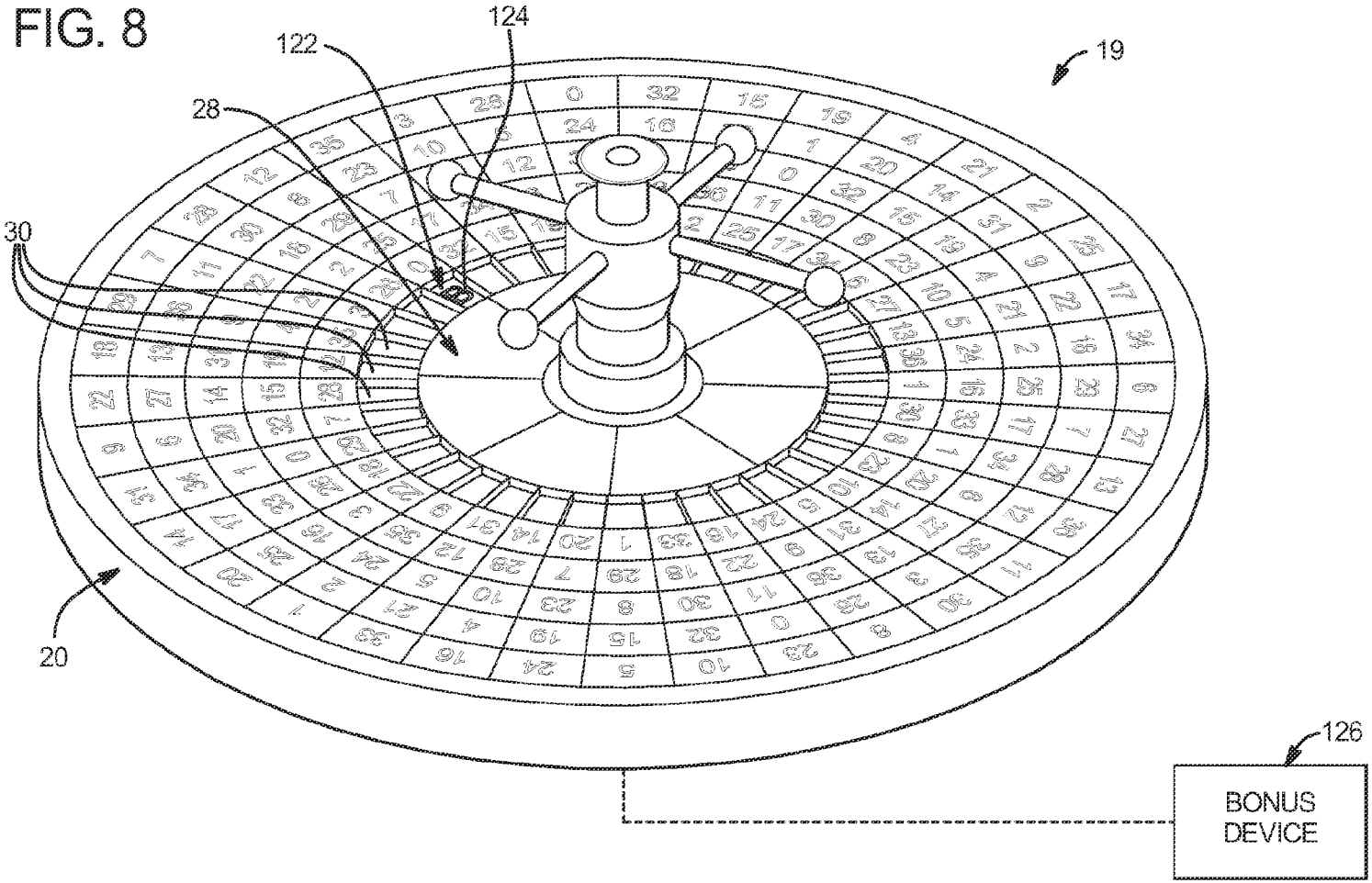
FIG. 8 is a top perspective view of a wheel assembly having a bonus landing in one embodiment of the gaming device.

In one embodiment, such as the embodiment illustrated in FIG. 8, the rotor 26*a* of wheel assembly 19 includes a bonus landing 122 and a bonus symbol 124. In this embodiment, the wheel assembly 19 is coupled to a bonus device 126, which can include any suitable apparatus which is operable to determine a secondary or bonus outcome, including, but not limited to, a mechanical outcome generating device, an electromechanical outcome generating device, a pseudo-random outcome generating device and a computer. In one embodiment, the landing of the indicator or ball (not shown) on a bonus landing 122 triggers the operation of the bonus device 126. In another embodiment, the indication of a bonus symbol 124 on one of the outer rotors 26*b*-26*f* triggers the operation of the bonus device 126. Once activated, the bonus device 126 produces or determines one or more bonus outcomes or secondary outcomes. In one embodiment, the bonus device 126 also includes at least one visual aid or output device which visually indicates or displays the secondary outcome determined by the bonus device 126.

In the embodiment illustrated in FIG. 8, the bonus device 126 includes a plurality of display devices 128 controlled by a processor, such as the processor or central controller 312 (FIG. 14) described in greater detail below. Each display device 128, mounted on the cone 28, is operable to display a plurality of images under the control of the processor 312. The images can include representations of numerals, values, symbols or awards. When a designated triggering event occurs in the primary game, the processor 312 determines the secondary outcome and causes one or more of the display devices 128 to indicate the determined outcome to the player. In this embodiment, each display device 128 can include a liquid crystal display (LCD) device, a light emitting diode (LED) device, or any other suitable display apparatus.

In one embodiment, the inner rotor 26*a* includes one or more detectors or landing sensors, which are operable to automatically sense which ball landing 30 the indicator or ball 34 has landed. The landing sensors can include a light sensor, a motion detector, a pressure sensor or any other suitable sensing apparatus which generates a signal when the ball lands in a landing.

Additional Embodiments of Gaming Device

Figure 10:
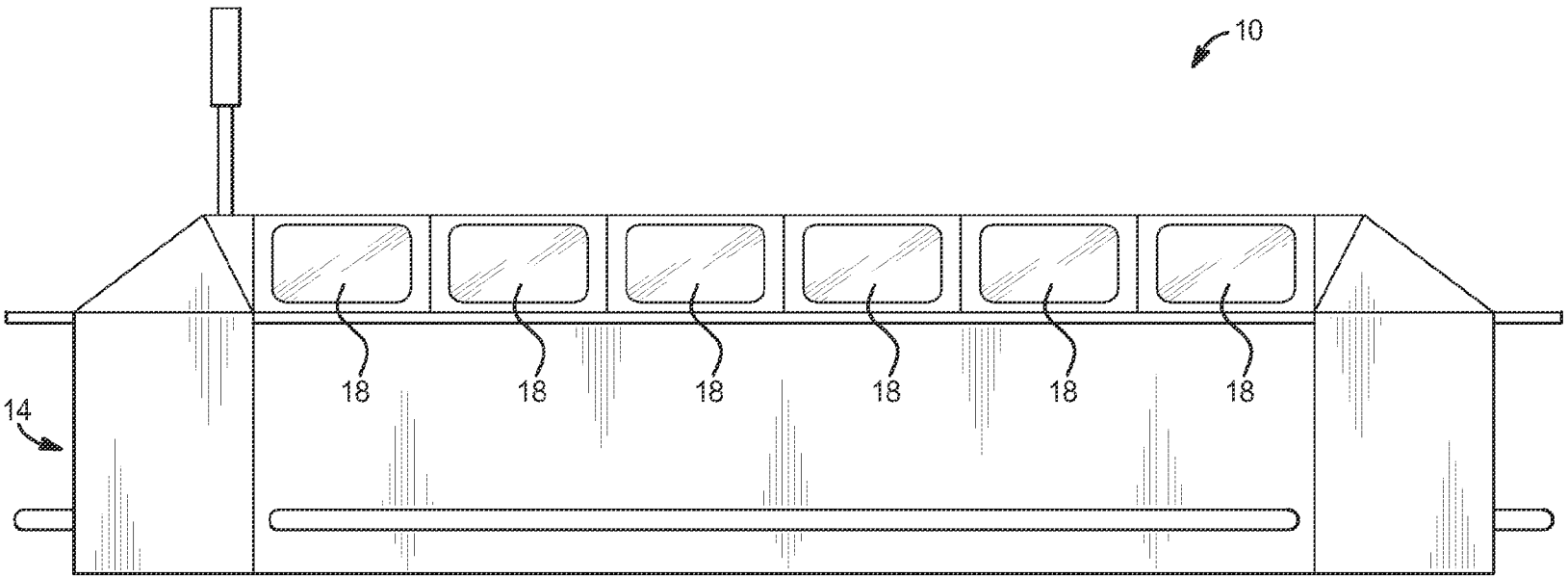
FIG. 10 is a side view of the electromechanical configuration of FIG. 9.

In another embodiment illustrated in FIGS. 9 and 10, the gaming device 10 includes a plurality of display devices 18. Each display device 18, when activated, displays a computer-generated wagering station 16. Each graphical wagering station or layout enables a player to select desired numbers and betting combinations for their wagers. In one embodiment, both a standard table layout and computer-generated wagering stations can share or support the same wheel assembly 12, 13 or 19. In each such embodiment, after the players have placed their bets, the dealer operates the wheel assembly 12 resulting in multiple outcomes for the primary game, as described above. It should be appreciated that the dealer can be a human operator or a computer which automatically controls the operation of the wheel assembly 12.

In one embodiment, some or all of the components, structure, functionality and other elements of the wheel assembly 12, wager station 16, rotors 26*a*-26*f*, and indicator or ball 34 described above (collectively referred to as "rotor-related elements") have a video, simulated, animated or virtual form, where such elements are formed by computerized graphical representations of actual physical objects. In one such embodiment, the rotor-related elements may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 11:
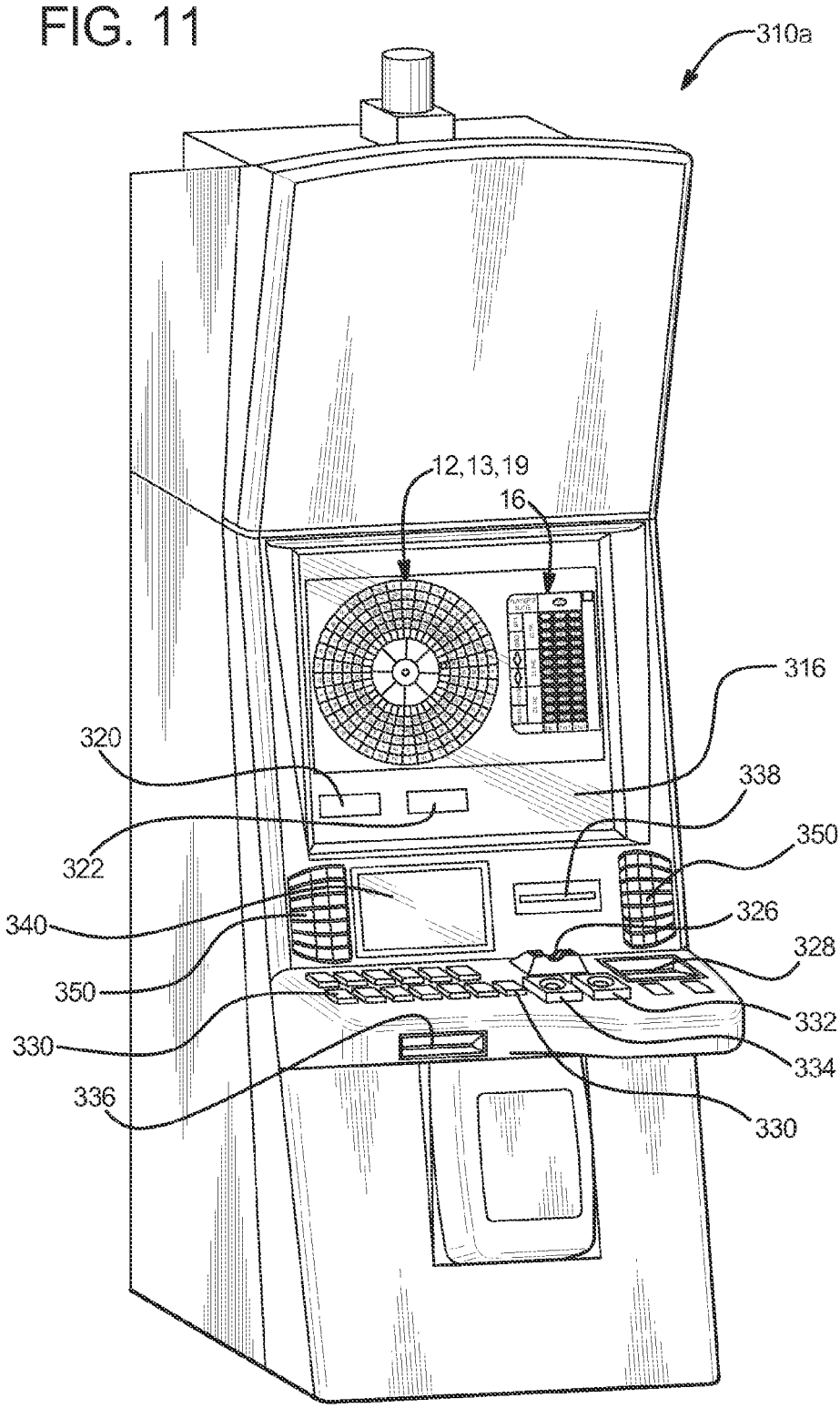
FIG. 11 is a front perspective view of one embodiment of the gaming device.
Figure 12:
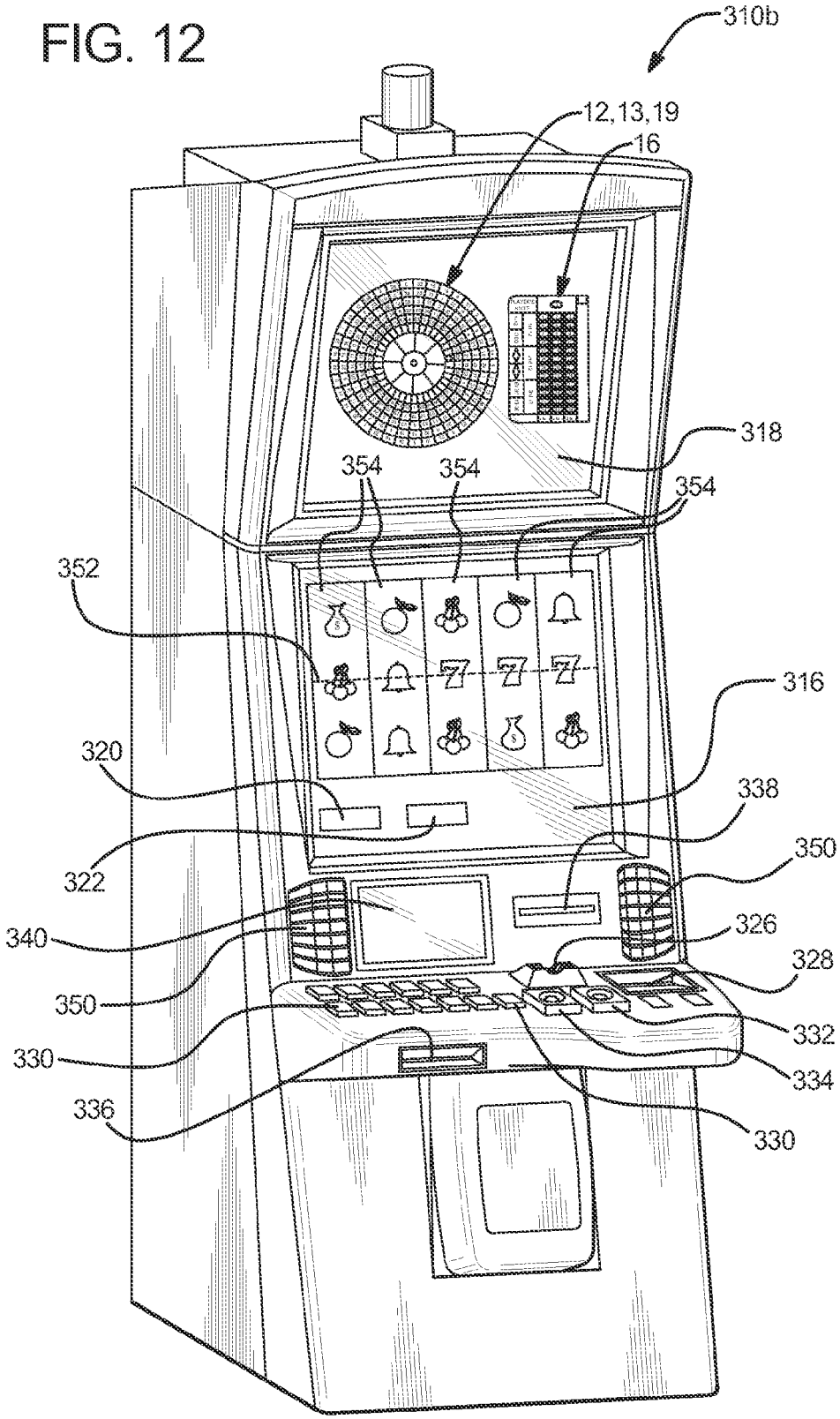
FIG. 12 is a front perspective view of another embodiment of the gaming device.

Referring now to the drawings, two example alternative embodiments of the gaming device which implements the rotor-related elements disclosed herein are illustrated in FIGS. 11 and 12 as gaming device 310*a* and gaming device 310*b*, respectively. Gaming device 310*a* and/or gaming device 310*b* are generally referred to herein as gaming device 310.

In the embodiments illustrated in FIGS. 11 and 12, gaming device 310 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 11 and 12, the gaming device may have varying cabinet and display configurations.

Figure 13:
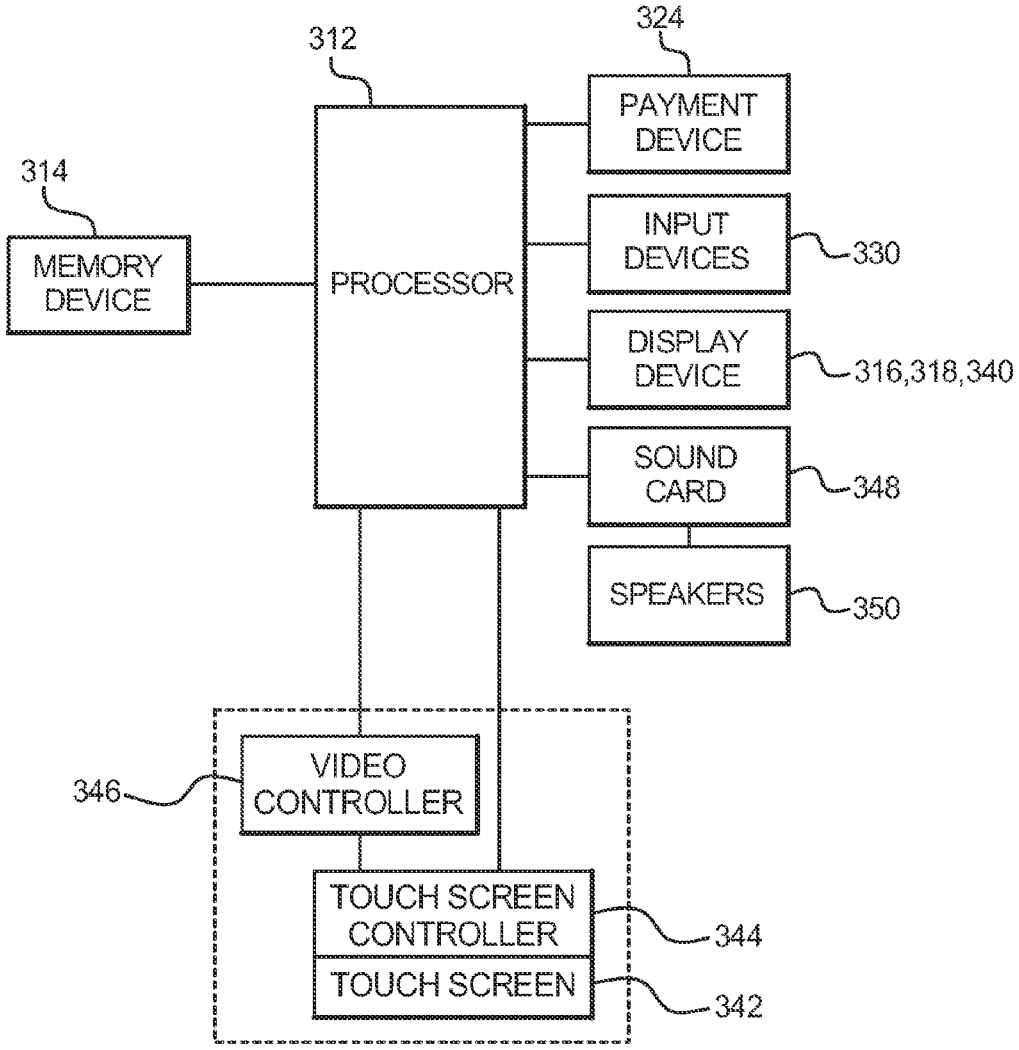
FIG. 13 is a schematic view of an electronic configuration of one embodiment of the gaming device.

In one embodiment, as illustrated in FIG. 13, the gaming device preferably includes at least one processor 312, such as a microprocessor, a microcontroller-based platform, a suitable integrated circuit or one or more application-specific integrated circuits (ASIC's). The processor is in communication with or operable to access or to exchange signals with at least one data storage or memory device 314. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, where the rotor-related elements have a video, simulated, animated, or virtual form, as described above, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In the embodiment where the rotor-related elements have a video or virtual form, the gaming device randomly generates awards or other game outcomes based on probability data stored in at least one memory device. In one such embodiment, this random determination is provided through utilization of a random number generator (RNG), such as a true random number generator, a pseudo random number generator or other suitable randomization process. In the embodiment where the rotor-related elements have a mechanical form, the gaming device has one or more stepper motors operable to control the rotor-related elements. In one embodiment, each stepper motor is mounted to a cabinet or frame of the gaming device and includes a driveshaft or coupler coupled to at least one of the rotors. In one embodiment, one stepper motor is coupled to all of the rotors. In another embodiment, each rotor is coupled to a separate stepper motor. The one or more motors control the movement of the rotor-related elements to generate one or more game outcomes.

In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 13, the gaming device includes one or more display devices controlled by the processor. The display devices are preferably connected to or mounted to the cabinet of the gaming device. The embodiment shown in FIG. 11 includes a central display device 316 which displays a primary game. This display device may also display any suitable secondary game associated with the primary game as well as information relating to the primary or secondary game. The alternative embodiment shown in FIG. 12 includes a central display device 316 and an upper display device 318. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 11 and 12, in one embodiment, the gaming device includes a credit display 320 which displays a player's current number of credits, cash, account balance or the equivalent. In one embodiment, the gaming device includes a bet display 322 which displays a player's amount wagered. In one embodiment, as described in more detail below, the gaming device includes a player tracking display 340 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 13, in one embodiment, the gaming device includes at least one payment device 324 in communication with the processor. As seen in FIGS. 11 and 12, a payment device such as a payment acceptor includes a note, ticket or bill acceptor 328 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 112, and 13, in one embodiment, the gaming device includes at least one and preferably a plurality of input devices 330 in communication with the processor. The input devices can include any suitable device which enables the player to produce an input signal which is received by the processor. In one embodiment, after appropriate funding of the gaming device, the input device is a game activation device, such as a play button 332 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 334. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 13, one input device is a touch-screen 342 coupled with a touch-screen controller 344, or some other touch-sensitive display overlay to allow for player interaction with the images on the display. The touch-screen and the touch-screen controller are connected to a video controller 346. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 13, the gaming device includes a sound generating device controlled by one or more sounds cards 348 which function in conjunction with the processor. In one embodiment, the sound generating device includes at least one and preferably a plurality of speakers 350 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented. In one embodiment, the gaming device incorporates the rotor-related elements into one of the games described above as either a primary or base game or as a secondary or bonus game.

In one embodiment, as illustrated in FIGS. 11 and 12, a base or primary game may be a slot game with one or more paylines 352. The paylines may be horizontal, vertical, circular, diagonal, angled or any combination thereof. In this embodiment, the gaming device includes at least one and preferably a plurality of reels 354, such as three to five reels 354, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 354 are in video form, one or more of the display devices, as described above, display the plurality of simulated video reels 354. Each reel 354 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same whining symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game. In one embodiment, the bonus sequence of the rotor-related elements gives players the opportunity to win credits in an ancillary bonus or secondary game or an ancillary bonus or secondary round. The ancillary bonus or secondary game enables the player to obtain a prize or payout in addition to the prize or payout, if any, obtained from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 11 and 12. In other embodiments, the triggering event or qualifying condition may be by exceeding a certain amount of game play (such as number of games, number of credits, amount of time), or reaching a specified number of points earned during game play.

In another embodiment, the gaming device processor 312 or central server 356 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. For example, in one embodiment, the gaming system or gaming device is operable with a different device. The different device is configured to randomly produce an bonus triggering outcome which corresponds to one of the rotors of the gaming device. The bonus triggering outcome triggers the spinning of the corresponding rotor of the gaming device.

In another embodiment, after the player has qualified for a bonus game, the player may subsequently enhance the player's bonus game participation through continued play on the base or primary game. Thus, for each bonus qualifying event, such as a bonus symbol, obtained by the player, the player may accumulate a given number of bonus game wagering points or credits. In one embodiment, the gaming device has a bonus meter programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 14:
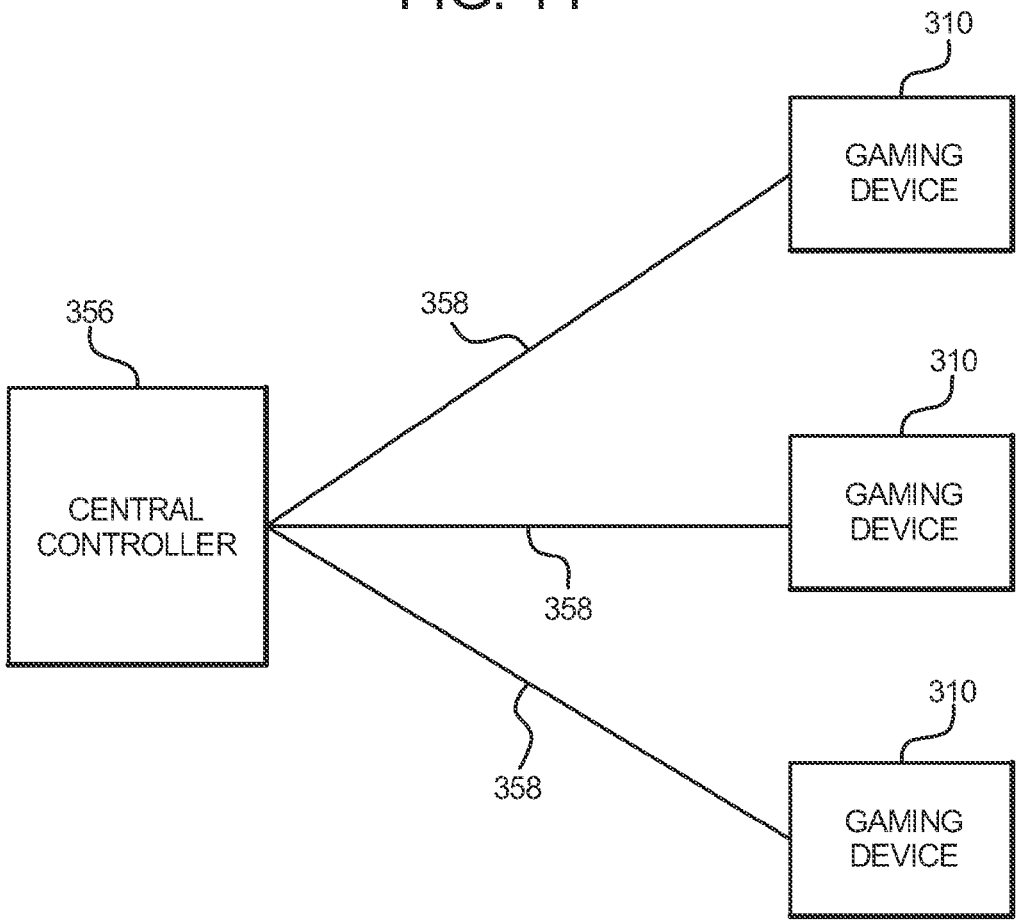
FIG. 14 is a schematic view of a central controller coupled to a plurality of embodiments of the gaming device.

In one embodiment, as illustrated in FIG. 14, one or more of the gaming devices 310 are in communication with each other and/or at least one central server, central controller or remote host 356 through a data network or remote communication link 358. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller. In one embodiment, the game outcome involving the rotor-related elements of any of the games described above is determined by the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an Internet or intranet. In this embodiment, the operation of the gaming device can be viewed at the gaming device with at least one Internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an Internet game page from any location where an Internet connection and computer, or other Internet facilitator is available. The expansion in the number of computers and number and speed of Internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaining sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaining tournament for one or more awards. In another embodiment, a plurality of players at a plurality of linked gaming devices play for one or more awards wherein an outcome generated by one gaming device affects the outcomes generated by one or more linked gaming devices. In one embodiment, the gaming device 10 includes any one of the embodiments described above. In another embodiment, the gaming device 10 includes any suitable combination of such embodiments. In a further embodiment, the gaming device 10 includes any suitable combination of one or more portions of such embodiments.

Figure 15:
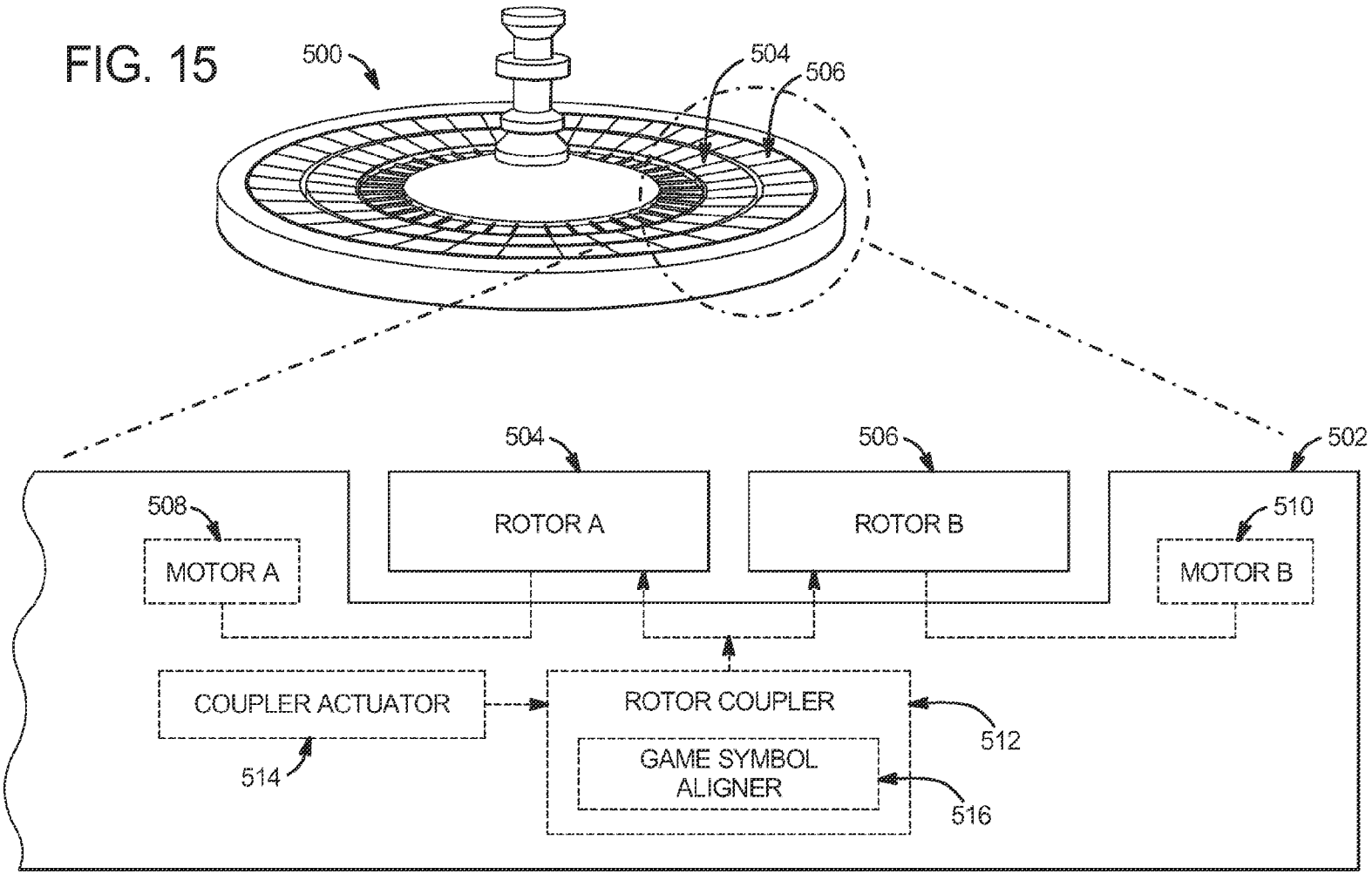
FIG. 15 is a side elevation, schematic, fragmentary view of one embodiment of the gaming system.

Referring to FIG. 15, in one embodiment, the gaming system 500 includes a housing 502, the right portion of which is shown in an enlarged, fragmentary, diagrammatic view in FIG. 15. The housing 502 supports: (a) an inner rotor 504; (b) an outer rotor 506; (c) a motor 508 coupled to rotor 504; (d) a motor 510 coupled to rotor 506; (e) a rotor coupler 512 which is operatively coupled to rotors 504 and 506; and (f) a coupler actuator 514 which is operatively coupled to rotor coupler 512.

In one embodiment, rotor coupler 512 includes a game symbol aligner 516. In operation, motor 508 drives rotor 504 independent of rotor 506. Motor 510 drives rotor 506 independent of rotor 504. This independent rotation of rotors 504 and 506 occurs for a period of time after the start of the game. In this independent or decoupled mode, the rotors 504 and 506 rotate at different speeds or in different directions. Depending upon the embodiment, the rotors 504 and 506 may or may not be in contact with or engaged with each other during the decoupled mode. When a designated event occurs or when an input is received, the coupler actuator 514 actuates the rotor coupler 512. At that time, the rotor coupler 512 couples the rotors 504 and 506 together. The rotors 504 and 506 then move as one unit or one assembly. In addition, the game symbol aligner 516 aligns the game symbols (shown in FIGS. 21-30) of the rotors 504 and 506. The alignment occurs by the time the rotors 504 and 506 are coupled together. Therefore, when the rotors 504 and 506 are rotating as one unit, the symbols on the rotors 504 and 506 are radially aligned with one another. In one embodiment, each motor 508 and 510 includes a one or more motor controllers such as one or more stepper motor controllers. Each motor controller choreographs the motions required for the given operating mode. In one embodiment, the system 500 includes rotor position sensors that form a dosed-loop control path to the motor controller to establish correct inter-rotor positioning or alignment. In one embodiment, especially for systems whose motors are stepper motors, the system 500 relies upon a dead-reckoning protocol to establish inter-rotor alignment. The dead-reckoning protocol specifies an association between a quantity of electrical pulses and an angle of rotation of the associated rotor. For example, four hundred motor pulses may correspond to two, three hundred sixty degree rotations of the rotor by the motor, or one hundred motor pulses may correspond to a rotation of ninety degrees of the rotor by the motor. In one embodiment, though the system relies upon dead-reckoning to establish inter-rotor alignment, the system also includes a plurality of rotor position sensors which form an open-loop control path to the motor controller, thereby causing a tilt condition or taking other action in the event of a mismatch between dead-reckoning expected position and the actual position.

In one embodiment described below, the gaming system 500 includes concentric axial columns, similar to a clock mechanism, and each separate stepper motor or independent stepper motor gear engages one of the axial columns. In another embodiment described below, each rotor 504 and 506 lies on its own track, and each separate stepper motor or stepper motor gear separately engages one of the rotors 504 and 506. For example, a stepper motor can be connected to a gear whose teeth intermesh with mating teeth on the bottom or side of a rotor 504 or 506.

Depending upon the embodiment, the rotor coupler 512 can include various devices operable to interlock or couple the rotors 504 and 506 together in an aligned fashion, some of which are described below with respect to FIGS. 31-35. In one embodiment, the rotor coupler 512 includes a mechanical device, such as a gear, lever, linkage, clutch, drive assembly, shaft, flywheel, cam or wheel which is operable to interchangeably couple the rotors 504 and 506 together. In another embodiment, the input device 542 includes an electrical, electronic, or electromechanical device, such as a set of stepper motors, a motor-driven drive gear, a solenoid, an electromagnetic mechanism, a hydraulic mechanism, an air pressure generator or an air suspension device. In one embodiment, the air suspension device includes an air pressure source coupled to an air dispenser. The air dispenser defines an array or matrix of air outlets. In operation, the air outlets produce a layer of air pressure suitable to suspend an object, such the rotor 504 or 506. In this regard, the air suspension device functions as an air bearing during rotation of the rotor 504 or 506. In one embodiment, when the rotors 504 and 506 are rotating independent of each other, the actuation of the rotor coupler 12 rapidly interlocks the rotors 504 and 506 to establish game symbol alignment. Once the rotors 504 and 506 are interlocked, the rotors can continue to rotate as a single unit, or the rotors can stop, depending upon the embodiment.

In one embodiment, the gaming system 500 includes at least one platter or flywheel positioned below at least one of the rotors 504 and 506. The platter or flywheel is coupled to the rotor located above it, so that the spinning of the platter or flywheel causes such rotor to spin. There are a plurality of methods by which the platter or flywheel can be spun into motion, including, but not limited to, the following:

Method A: The platter or flywheel is spun by a stepper motor or some other suitable mechanical or electromechanical device. This may be performed on a continual basis, based on a signal from the dealer, based on an impulse, or based on the expiration of a limited time period.

Method B: The platter or flywheel is manually spun by a human dealer who physically rotates the rotor connected to the platter or flywheel.

Method C: The platter or flywheel is manually spun by a human dealer who physically manipulates a lever or some other suitable device to impart a spin onto the platter or flywheel, Method D: The platter or flywheel is manually spun by a human dealer directly through an access port cut into, or defined by, the side of the housing 502.

In one embodiment, the platter or flywheel has one or more pointers or engagers designated for different rotors. The dealer manually initiates rotation of each of the rotors which is not coupled to the platter or flywheel. Based on the time from the start of the platter or flywheel rotation or based upon dealer input, one or more of the pointers or engagers ascends from the platter or flywheel to engage detents, frets or other suitable mechanisms at the bottom or side of the rotating rotor corresponding to such engagers. This causes the rotors to align with the platter or flywheel, thereby rotating at the same angular velocity as the platter or flywheel.

In one embodiment, the platter or flywheel pointer extends through a through a hole or detent space of at least one rotor to engage and interlock such rotor. In another embodiment, the gaming system includes moveable pointers designated for different rotors. Such moveable pointers are coupled to the housing 502 instead of a platter or flywheel.

In one embodiment, the rotor coupler 512 includes at least one pointer or rotor engager designated for each one of the rotors 504 and 506. Each rotor engager is connected to a pivotable shaft. The shaft is driven by a motor or other suitable driver to pivot the pointer ninety degrees between a plurality of positions. At one extreme of shaft rotation, the pointer does not engage its associated rotor, enabling the two rotors to rotate without interfering or interlocking each other. At the other extreme of the shaft rotation, each pointer engages one or both of the rotors to cause the rotors to be coupled together. The rotation of the rotatable shaft with the pointer can be controlled using a plurality of methods and mechanisms, including, but not limited to, a motor, solenoid, mechanical linkage which engages one or more moving parts which are not part of the rotors, or any other suitable mechanism.

In one embodiment, the pointer described above is housed and oriented horizontally in the spindle 642 (described below with respect to FIG. 31) or in the body of one or more of the rotors. In one embodiment, each rotor houses a spring-resisted solenoid which is configured to cause pointers to outwardly project in a horizontal plane to engage the associated rotor. The pointers can be interchangeably retracted and extended to disengage and engage the rotors for the different modes of operation of the gaming system. In another embodiment, centripetal force causes the pointer to move inward against a light spring while the spindle 642 rotates at a relatively high angular velocity. As the spindle 642 slows, the centripetal force is reduced, the light spring causes the pointer to move outward towards it's initial orientation thereby increasing its contact and friction with the adjacent rotor until the rotor slows or stops.

In one embodiment, the outer vertical walls of the rotors define at least one hole extending along a radius. When the holes of the rotors are aligned, they define a common hole. In one embodiment, the pointer described above is configured to be projected through the common hole to couple the rotors together to establish game symbol alignment. It should be appreciated that the pointer and common hole can couple, two, three or more rotors together.

In one embodiment, the rotor coupler 512 includes a motor generator such as a DC brush motor generator configured to drive a dummy load or a designated load. The motor generator is coupled to the rotors 504 and 506 to initiate slow down and establish the coupled mode. The brush motor generator is configured to control discrete rotational positions of the rotors. In one embodiment, the rotor coupler 512 has a plurality of concentric axial column supports and a plurality of spur gears, where each spur gear is attached to one of the axial column supports. The brush motor generator has a plurality of motor gears. Each motor gear is associated with one of the spur gears, and the spur gears are coupled to different rotors. When the coupled mode is to be achieved, the discrete rotational position motor gear is moved by the motor, or some other suitable mechanism, to engage its corresponding column spur gear. In another embodiment, where each rotor lies within its own support track, the underside or side of the rotor has a plurality of gear teeth. When the coupled mode is to be achieved, the discrete rotational position motor gear is moved into place to engage these teeth to slow down the rotor and assure that it stops in only certain positions, consistent with the desired interlock arrangement to establish game symbol alignment.

In one embodiment, the gaming system includes an air device with at least one set of air bearings. The set of air bearings supports at least one of the rotors which lie within a designated track. The air device is configured to produce air pressure which suspends the rotor, allowing the rotor to rotate freely. Upon a designated signal (for example, the detection of a ball having landed in a well, a signal based on an action by the dealer, or the detection of the lock up of a neighboring rotor) the airflow to the rotor is reduced. This reduction in airflow causes the rotor to lower until it engages bumps or ball bearings which have a fixed location in the rotor track. The rotor has grooves in its bottom which correspond to the ball bearings. As a result, the rotor will come to rest in only certain positions to establish game symbol alignment.

In one embodiment, the rotor track described above is attached to a common platter or flywheel. Therefore, when either rotor comes to rest within its track, such rotor will be rotating at the speed of the platter or flywheel.

In one embodiment, the number of active rotors is variable. In one such embodiment, the system enables the display of indicia on a given rotor to be selectively enabled or disabled. In one such embodiment, an inactive rotor, which does not display designated indicia, is static and does not rotate. In one such embodiment, an inactive rotor remains in constant rotation while not displaying designated indicia. The active rotors, in such embodiment, slow or stop rotating after a period of time elapses.

Figure 16:
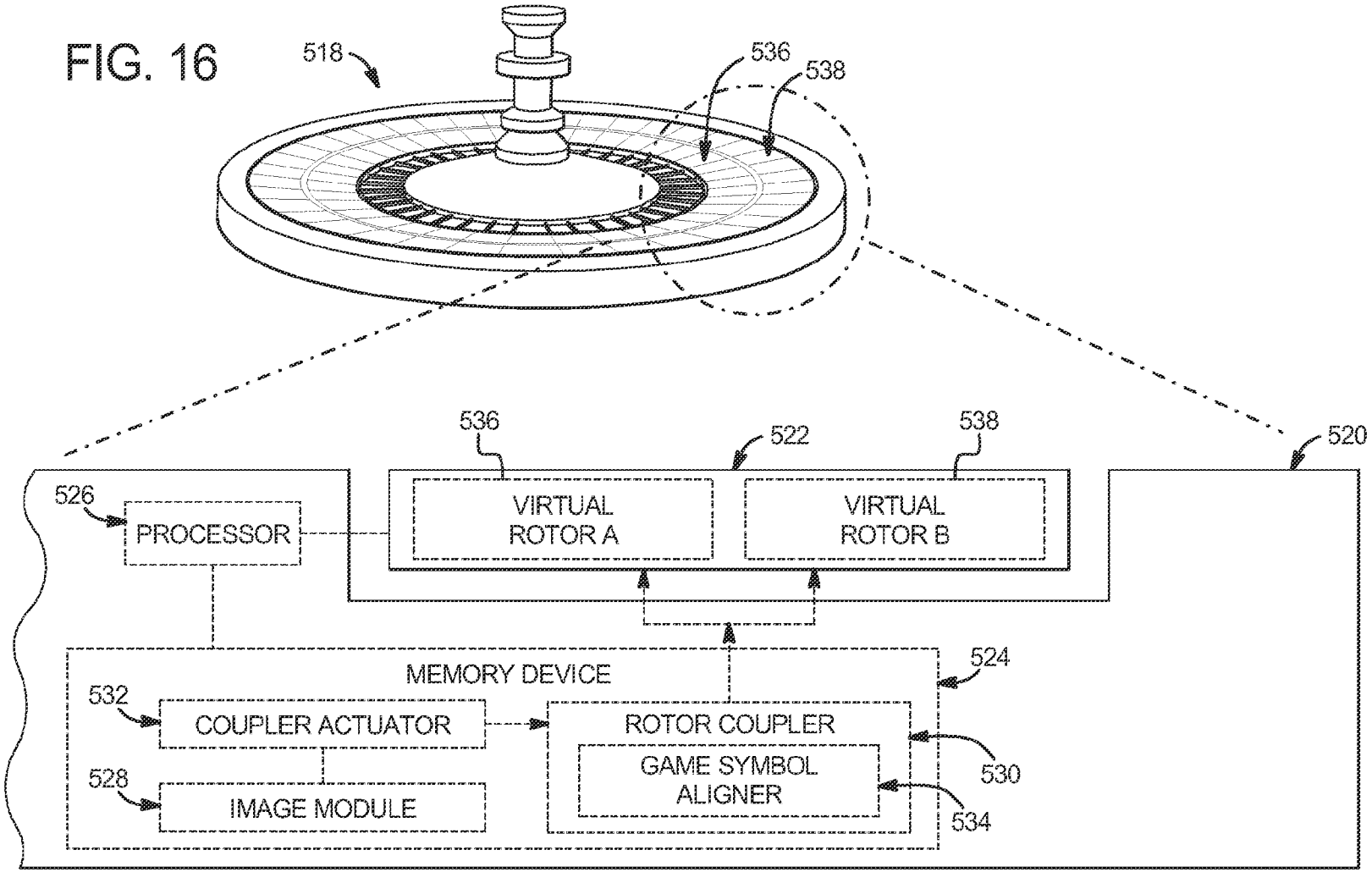
FIG. 16 is a side elevation, schematic, fragmentary view of another embodiment of the gaming system.

Referring to FIG. 16, in one embodiment, the gaming system 518 includes a housing 520, the right portion of which is shown in an enlarged, fragmentary, diagrammatic view in FIG. 16. The housing 520 supports: (a) a display device 522, such as a liquid crystal display (LCD) or a grid of light emitting diodes (LEDs); (b) a memory device 524; and (c) a processor 526 which is operatively coupled to the memory device 524 and the display device 522. In one embodiment, the memory device 524 includes: (a) an image module 528; (b) a rotor coupler 530; and (c) a coupler actuator 532. In one embodiment, the rotor coupler 530 includes a game symbol aligner 534. In this embodiment, the image module 528, rotor coupler 530, coupler actuator 532 and game symbol aligner 534 each include a plurality of computer-readable instructions and related data. The processor 526 executes these instructions and processes such data to control the functions of the gaming system 518.

In one embodiment, the processor executes the image module 528 to cause the display device 522 to display video or virtual rotors 536 and 538. In this embodiment, each rotor 536 and 538 is a video or image which simulates or represents a physical, rotatable rotor in motion. In operation, after the start of the game, the virtual rotors 536 and 538 virtually rotate independent of one another at different speeds or in different directions.

In one embodiment not shown, the gaming system is the same as gaming system 518 except it includes a plurality of display devices or LCD screens. One screen displays video rotor 536, and a separate screen displays video rotor 538. Such gaming system also includes a plurality of motors, and each motor is operatively coupled to one of the screens. In operation, the motors drive the rotation of the screens, switching between coupled mode and decoupled mode, as described below.

Referring back to FIG. 16, when the processor 526 receives a designated input, the processor 526 executes the coupler actuator 532, the rotor coupler 530 and the game symbol aligner 534. As a result, the processor 526 changes the operation of the STET rotors 536 and 538 from an independent mode or decoupled mode to a coupled mode. In the coupled mode, the STET rotors 536 and 538 rotate together as one unit, and the game symbols (not shown) of the rotors 536 and 538 are radially aligned with each other due to the game symbol aligner 534.

In such embodiment, the rotors are virtual rotors, the rotor coupler is at least one computer-readable instruction, and the coupler actuator is at least one computer-readable instruction.

Figure 17:
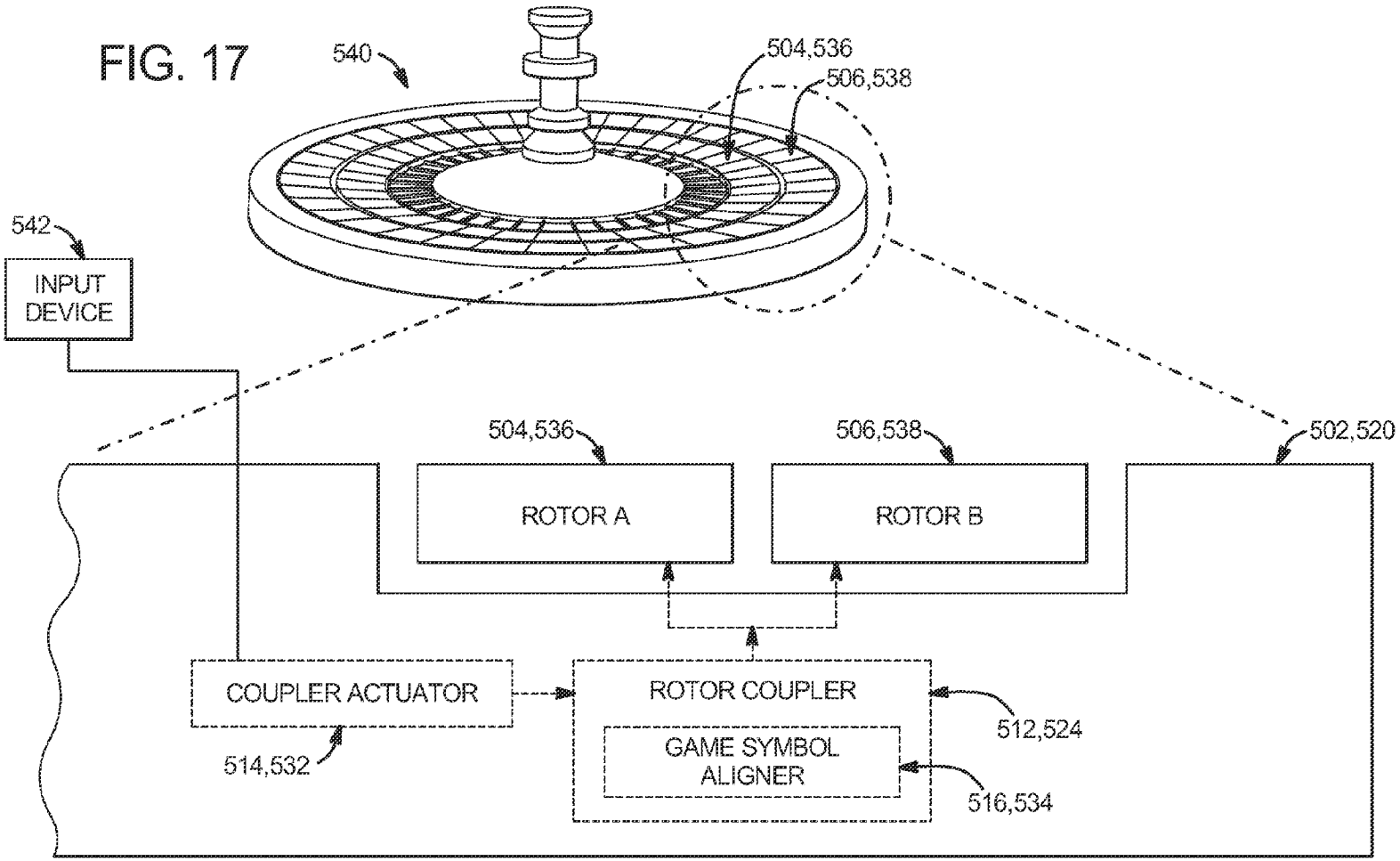
FIG. 17 is a side elevation, schematic, fragmentary view of one embodiment of the gaming system illustrating the input device.

Depending upon the embodiment, there are various methods and devices operable to activate the coupler actuator. In the embodiment illustrated in FIG. 17, the gaming system 540 includes a housing 502, 520, the right portion of which is shown in an enlarged, fragmentary, diagrammatic view in FIG. 17. The gaming system 540 also includes an input device 542. In one embodiment, the input device 542 includes a mechanical device, such as a lever, dial, knob, linkage, drive assembly or wheel, which mechanically couples a user engagement member (not shown) to the coupler actuator 514, 532. In another embodiment, the input device 542 includes an electrical, electronic, or electromechanical device which operatively couples a user engagement member (not shown) to the coupler actuator 514, 532. In such embodiment, the input device 542 can include a button, switch, dial or touch screen which, when activated, produces an input signal received by the coupler actuator 514, 532. Accordingly, depending upon the embodiment, the input device 542 can result in a mechanical input, such as a force, or an electronic input, such as signal, which is received by the coupler actuator 514, 532. Based on that input received, the coupler actuator 514, 532 actuates the rotor coupler 512, 524.

In another embodiment not shown, a delay circuit is coupled between the input device 542 and the coupler actuators 514, 532. In one embodiment, the delay between the signal and start of actuator control is approximately constant. In another embodiment, the delay between the signal and start of actuator control is of a random duration within a certain range based on a random or pseudorandom process.

Figure 18:
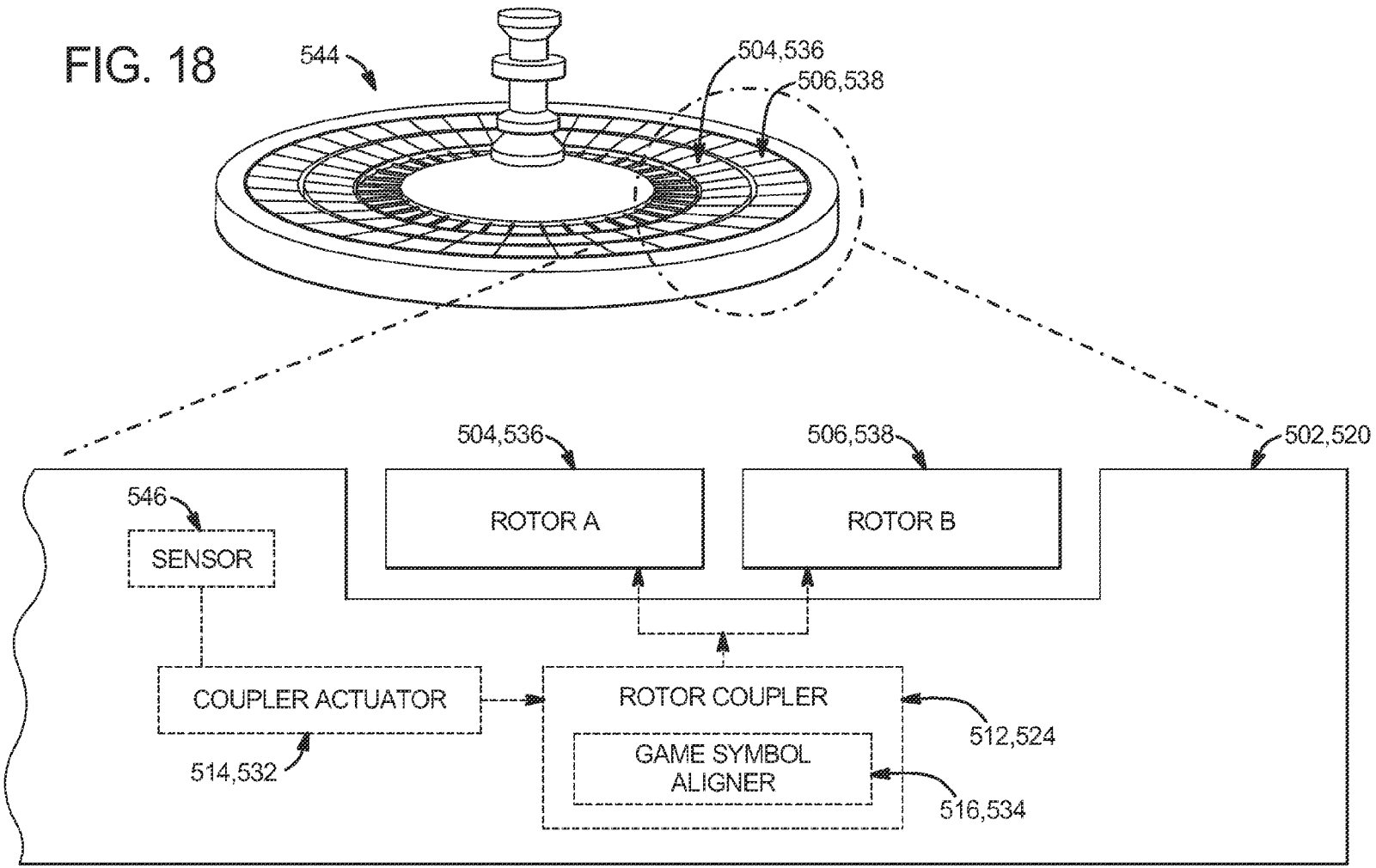
FIG. 18 is a side elevation, schematic, fragmentary view of one embodiment of the gaming system illustrating the sensor.

In one embodiment illustrated in FIG. 18, the gaming system includes a housing 502, 504, the right portion of which is shown in an enlarged, fragmentary, diagrammatic view in FIG. 18. The gaming system 544 also includes a sensor 546. In operation, the sensor 546 detects or senses a condition or event. As a result, the sensor 546 produces an input signal which is received by the coupler actuator 514, 532. Based on that signal, the coupler actuator 514, 532 actuates the rotor coupler 512, 524. Depending upon the embodiment, the sensor 546 can include: (a) a motion detector which detects the motion of one or both of the rotors 504, 536 and 506, 538; (b) a position sensor which senses the position of one or both of the rotors 504, 536 and 506, 538; (c) a pressure sensor or optical sensor which senses the presence or position of a ball traveling on the gaming system 544 as described in one embodiment below; or (d) any other sensor or detector of sound, light, or other environmental characteristics. In one embodiment, the sensor 546 includes a light source (not shown).

Figure 19:
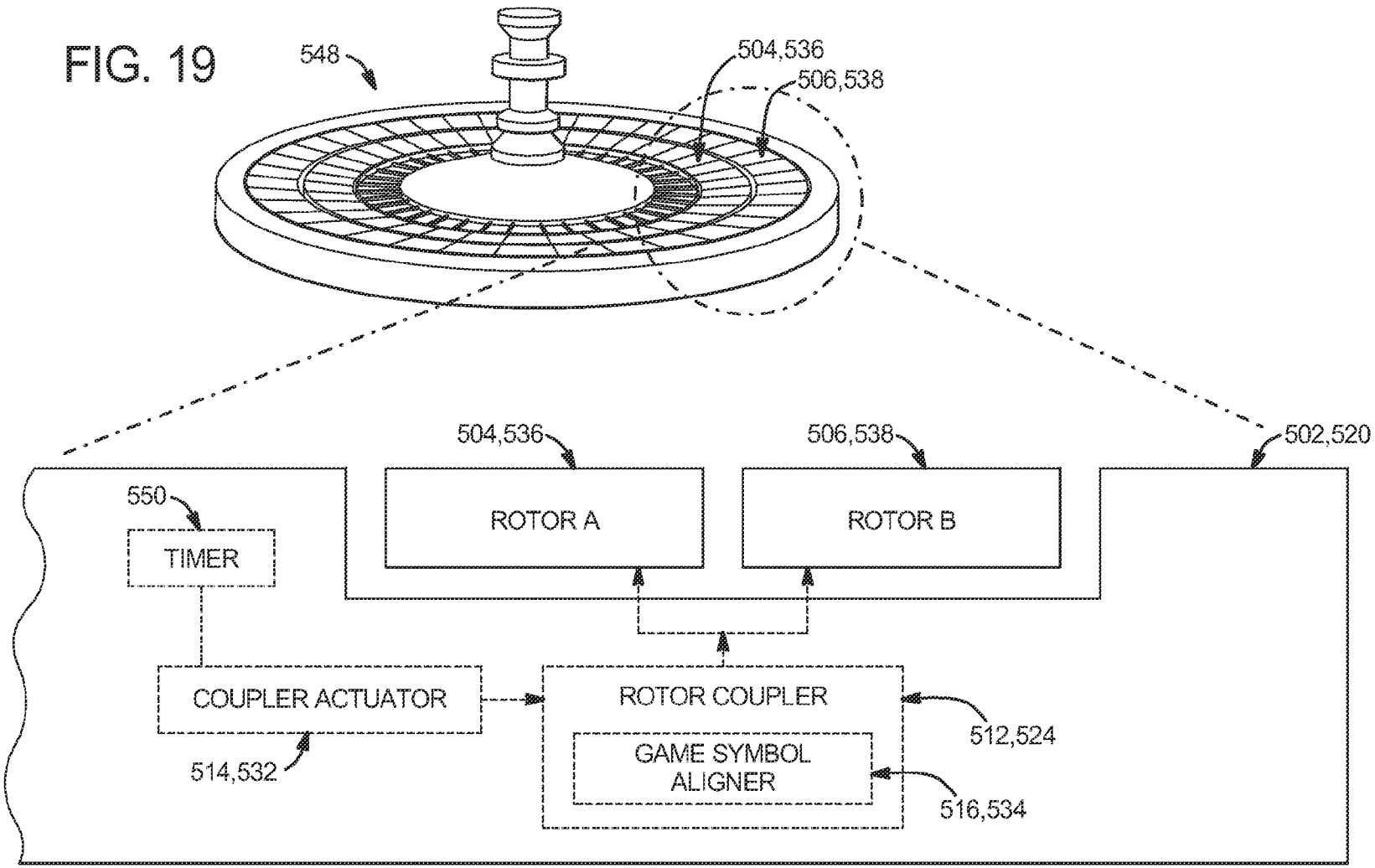
FIG. 19 is a side elevation, schematic, fragmentary view of one embodiment of the gaming system illustrating the timer.

In the embodiment illustrated in FIG. 19, the gaming system 548 includes a housing 502, 520, the right portion of which is shown in an enlarged, fragmentary, diagrammatic view in FIG. 19. The gaming system 548 also includes a timer 550. In this embodiment, the timer 550 includes a counter to keep track of time. After a designated time period elapses or expires, the timer 550 produces a signal received by the coupler actuator 514, 532. The coupler actuator 514, 532 actuates the rotor coupler 512, 524 based on the signal received.

Figure 20:
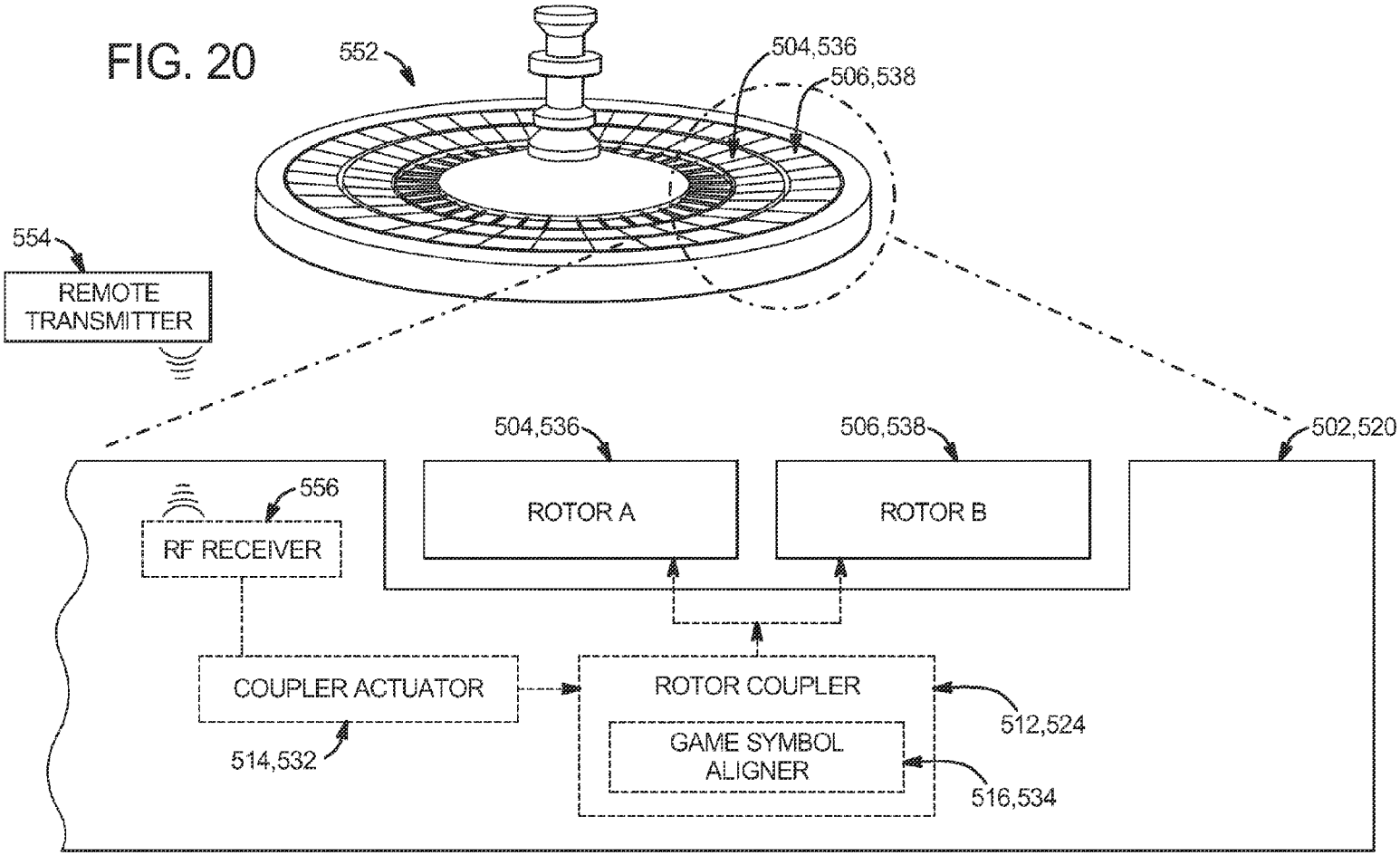
FIG. 20 is a side elevation, schematic, fragmentary view of one embodiment of the gaming system illustrating the transmitter and receiver.

In one embodiment illustrated in FIG. 20, a gaming system 552 includes housing 502, 540, the right portion of which is shown in an enlarged, fragmentary, diagrammatic view in FIG. 20. The gaming system 552 also includes a remote transmitter 554 which wirelessly communicates with a radio frequency (RF) receiver 556. In the illustrated embodiment, a receiver 556 is supported by the housing 502, 520. Depending upon the embodiment, the transmitter 554 can include one or more input devices operable by a user. When the transmitter 554 sends a radio frequency signal, the receiver 556 receives that signal. Based on the received signal, the receiver 556 produces a signal received by the coupler actuator 514, 532. As a result, the coupler actuator 514, 532 actuates the rotor coupler 512, 524.

Figure 21:
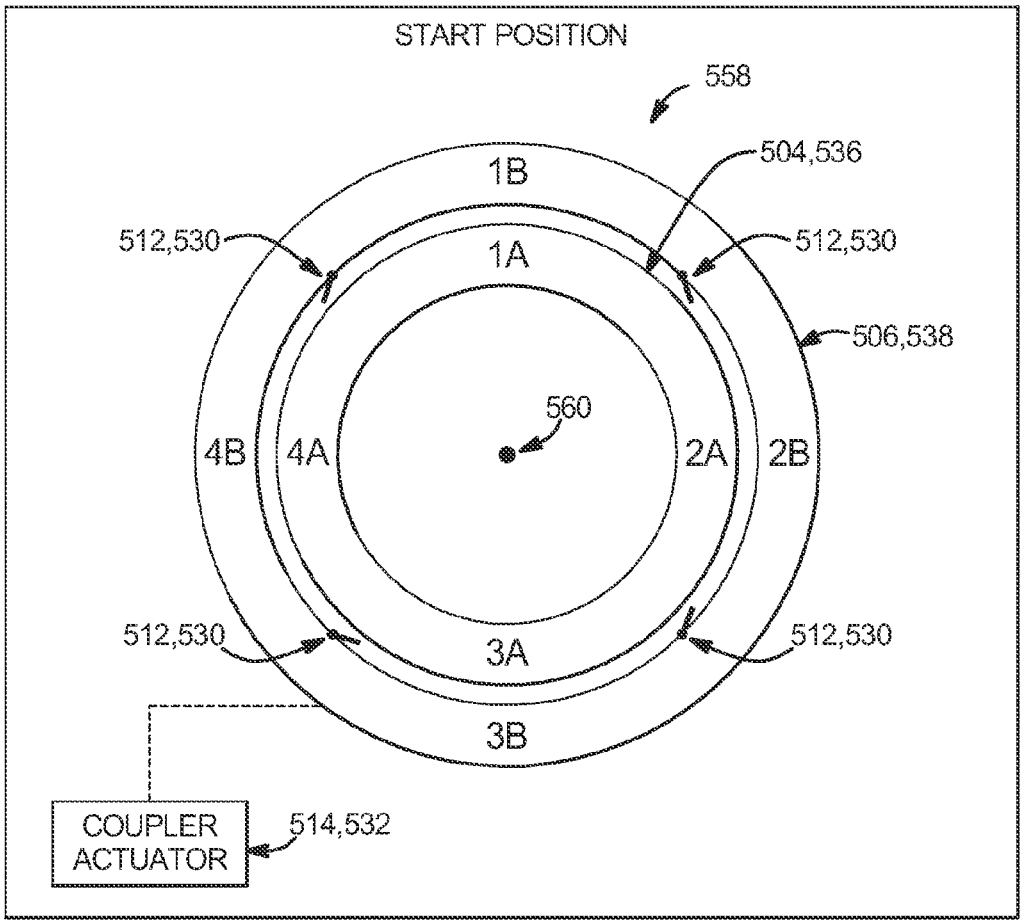
FIG. 21 is a top, schematic view of one example of one embodiment of the gaming system.

In the example illustrated in FIG. 21, gaming system 558 includes a common center point 560 shared by rotors 504, 536 and 506, 538. In the example illustrated, outer rotor 506, 538 includes symbols 1B, 2B, 3B, and 4B. Similarly, the inner rotor 504, 536 includes symbols 1A, 2A, 3A, and 4A. In this example, the symbols are arranged ninety degrees apart at the beginning of the game before any of the rotors are spun. In one embodiment not shown, the entire perimeter of each rotor 504, 536 and 506, 538 is divided into equally-sized numeral segments, and there is a different numeral displayed at each one of the segments. In one embodiment, the numeral segments are separated from each other by dividers or frets. In such embodiment, the game symbol aligner 516 is configured to cause each segment, numeral or symbol of rotor 504, 536 to be in line with each segment, numeral or symbol of rotor 504, 536. When the rotors are in decoupled mode, the segments, numerals or symbols of the rotors can become misaligned, as described below with respect to FIGS. 22-23. When the rotor coupler 512, 530 is actuated, the game symbol aligner 516 brings the segments, numerals or game symbols of the multiple rotors into alignment with each other.

In one embodiment, gaming system 558 illustrated in FIG. 21 includes all of the components, structure, elements and functions of gaming system 500. In one embodiment, gaming system 558 includes all of the components, structure, elements and functions of gaming system 518. In one embodiment, gaming system 558 includes all of the components, structure, elements and functions of gaming system 540. In one embodiment, gaming system 558 includes all of the components, structure, elements and functions of gaming system 544. In one embodiment, gaming system 558 includes all of the components, structure, elements and functions of gaming system 548. In one embodiment, gaming system 558 includes all of the components, structure, elements and functions of gaming system 552.

Figure 22:
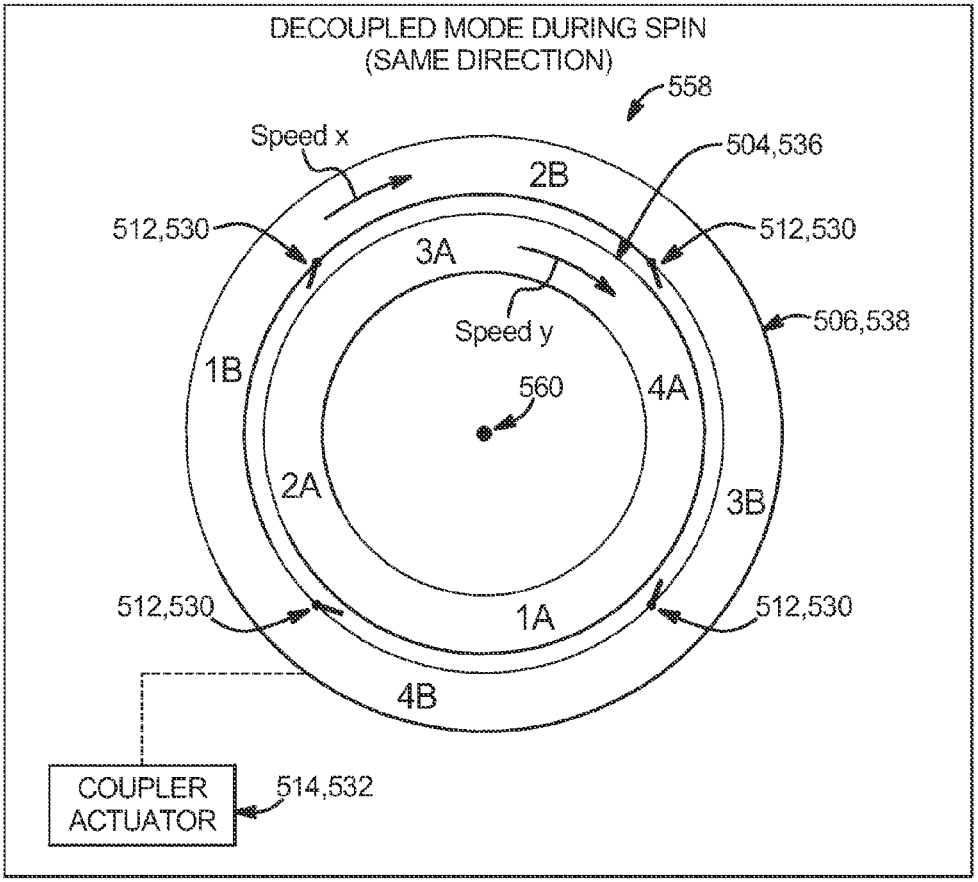
FIG. 22 is a top, schematic view of one example of one embodiment of the gaming system illustrating the decoupled mode with the rotors spinning in the same direction.
Figure 23:
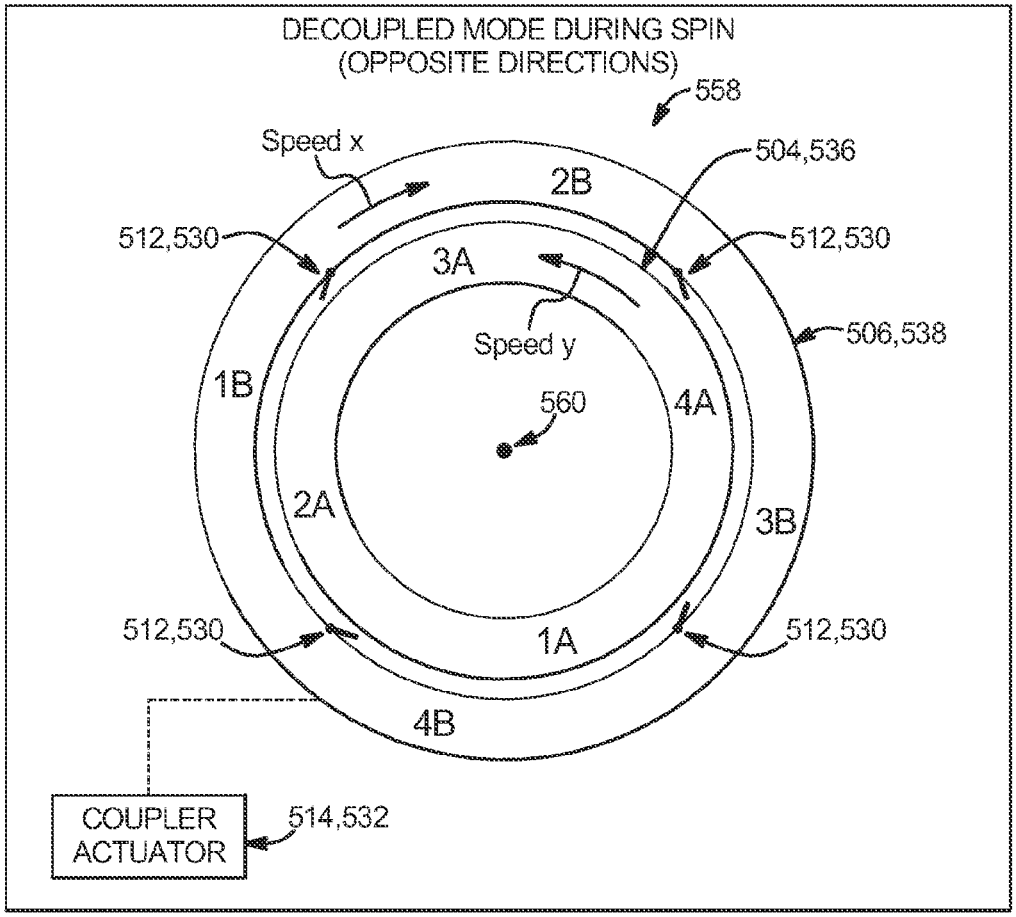
FIG. 23 is a top, schematic view of one example of one embodiment of the gaming system illustrating the decoupled mode with the rotors spinning in the opposite directions.

In the example illustrated in FIG. 22, once the game starts, the rotors 504, 536 and 506, 538 are initially rotated independent of one another in a decoupled mode. The decoupling of the rotors is indicated by the couplers 512, 524 illustrated schematically in an open state. Accordingly, in this example, the outer rotor 506, 538 is rotating clockwise at a speed x and the inner rotor 504, 536 is rotating clockwise at a different speed y. In the example illustrated in FIG. 23, the outer rotor 506, 538 is rotating at a speed x in a clockwise direction and the inner rotor 504, 536 is rotating in a counter clockwise direction at a different speed y.

Figure 24:
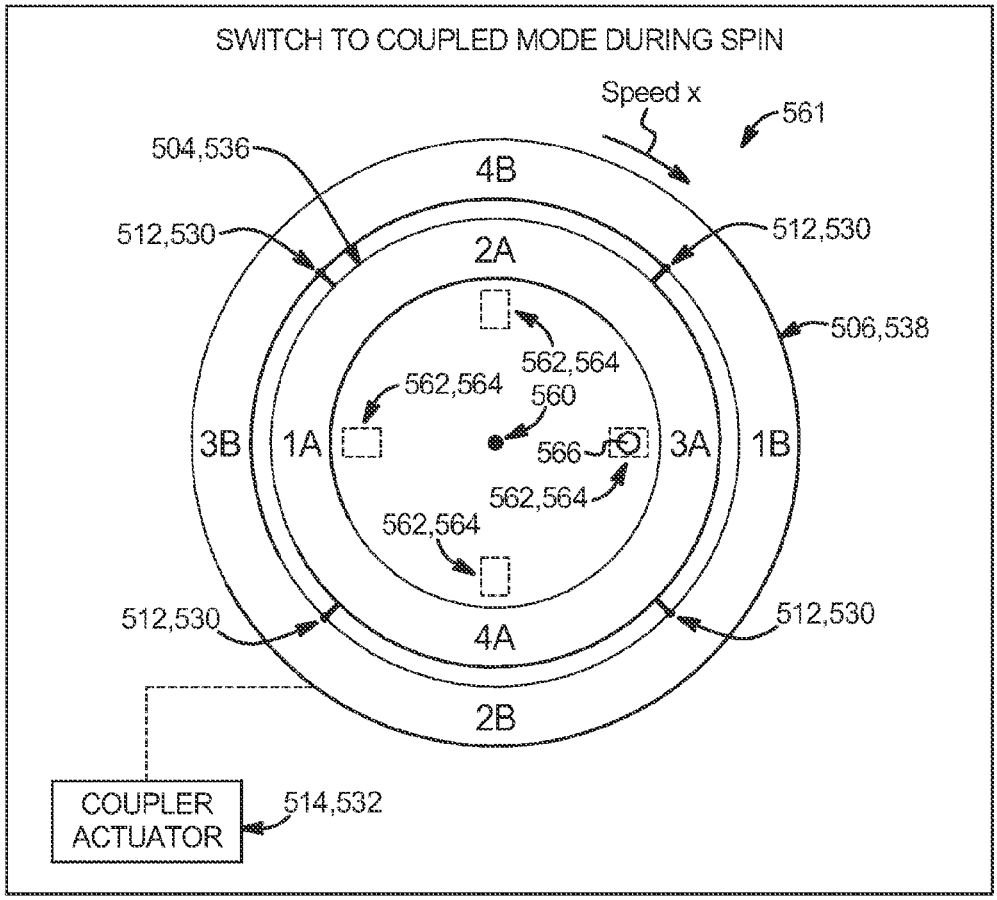
FIG. 24 is a top, schematic view of one example of one embodiment of the gaming system illustrating the switch or change to the coupled mode.

In one embodiment illustrated in FIG. 24, gaming system 561 includes an indicator system 562 in addition to all of the components, structure, elements and functions of gaming system 558. In the illustrated example, the coupler actuator 514, 532 receives an input, and based on such input, the actuator 514, 532 causes the coupler 512, 524 to couple the rotors 506, 538 and 504, 536 together. The illustrated closed state of the coupler 512, 524 schematically indicates the switching of the coupler 512, 524 to a coupled state. In the example illustrated, the rotors 506, 538 are coupled to the rotor 504, 536, and this rotor set is rotating as one unit in a clockwise direction at speed x.

In this embodiment, the indicator system 562 of gaming system 561 includes a plurality of indicator areas 564 and an indicator 566. In the illustrated example, the indicator 566 is a circle or ball. While the set of rotors is spinning or after the set of rotors stop spinning, the indicator 566 appears at one of the areas 564. The appearance of the indicator 566 at one of the areas 564 indicates the rotor symbols which are in line with, or adjacent to, the indicator 566. In the example illustrated in FIG. 24, the indicator 566 is aligned with, and indicates, symbols 3A and 1B. The combination of symbols 3A and 1B is a game outcome which may satisfy a winning condition, as described below.

Figure 25:
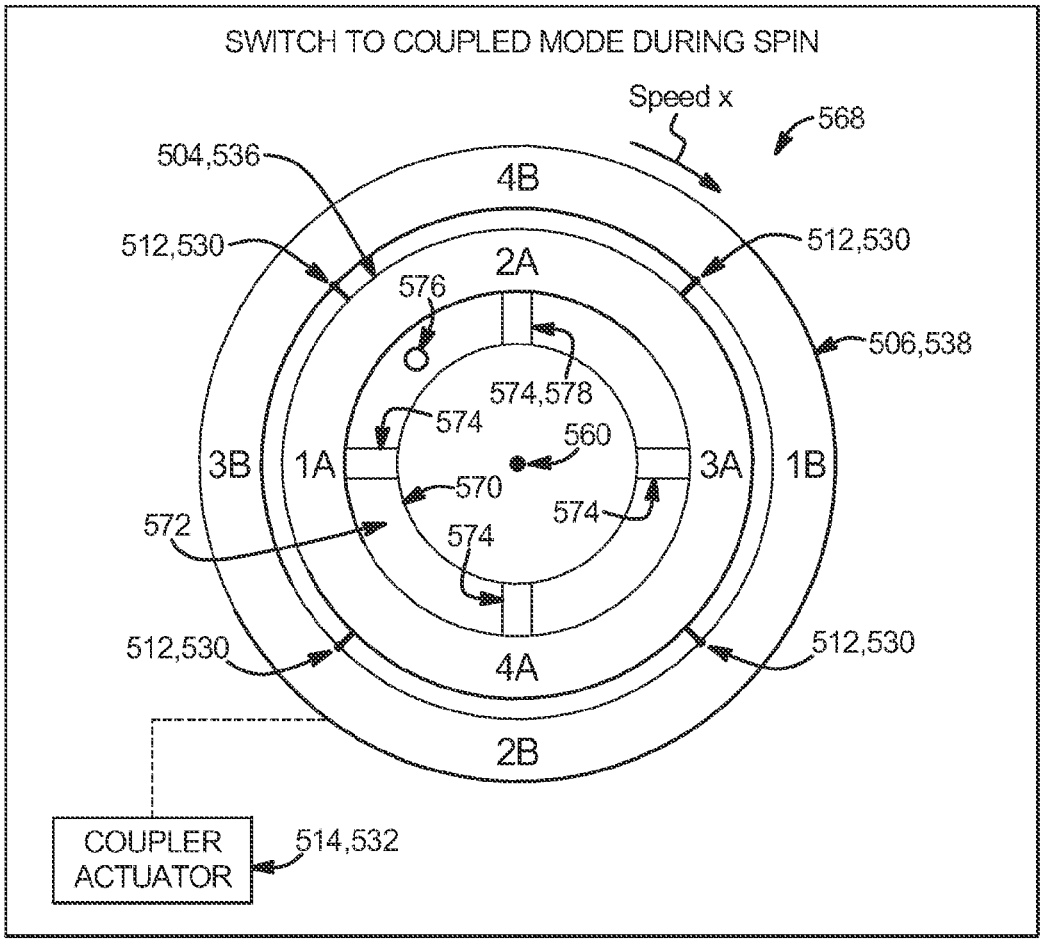
FIG. 25 is a top, schematic view of one example of one embodiment of the gaming system illustrating one indicator system.

In the example illustrated in FIG. 25, the gaming system 568 includes an indicator system 570 in addition to all of the components, structure, elements and functions of gaming system 558. The indicator system 570 includes a circular track 572. The circular track 572 includes a plurality of ball landings 574. The gaming system 568 also includes a ball 576 which is configured to land in one of the ball landings 574. Depending upon the embodiment, the ball landings 574 can include retaining, vertical walls which define a cavity or slot to retain the ball 576. In one embodiment, each ball landing 574 is a pocket or canoe having such vertical walls. In another embodiment, each ball landing 574 is a virtual landing space having an image which represents such a pocket or canoe. Depending upon the embodiment, the circular track 572 is integrally connected with, or otherwise coupled to, the inner rotor 504, 536. In another embodiment, the circular track 572 is a separate rotor which rotates independent of the rotor 504, 536. While the rotors 506, 538 and 504,536 are spinning, the ball 576 is traveling in a circular fashion along the circular track 572 until eventually the ball 576 stops and lands at or in one of the ball landings 574. In the example illustrated in FIG. 25, if the ball 576 were to land at ball landing 578 when the rotors have interlocked or stopped spinning, this would indicate symbols 2A and 4B. The combination of symbols 2A and 4B is a game outcome which may satisfy a winning condition, as described below.

In one embodiment not shown, the circular track 572 is positioned between the inner rotor 504, 536 and the outer rotor 506, 538. In one embodiment not shown, the circular track 572 is positioned adjacent to the exterior of the outer rotor 506, 538. In one embodiment illustrated in FIG. 31, the inner rotor includes a plurality of ball landings. In one embodiment not shown, the inner rotor and the outer rotor each include a plurality of ball landings.

Figure 26:
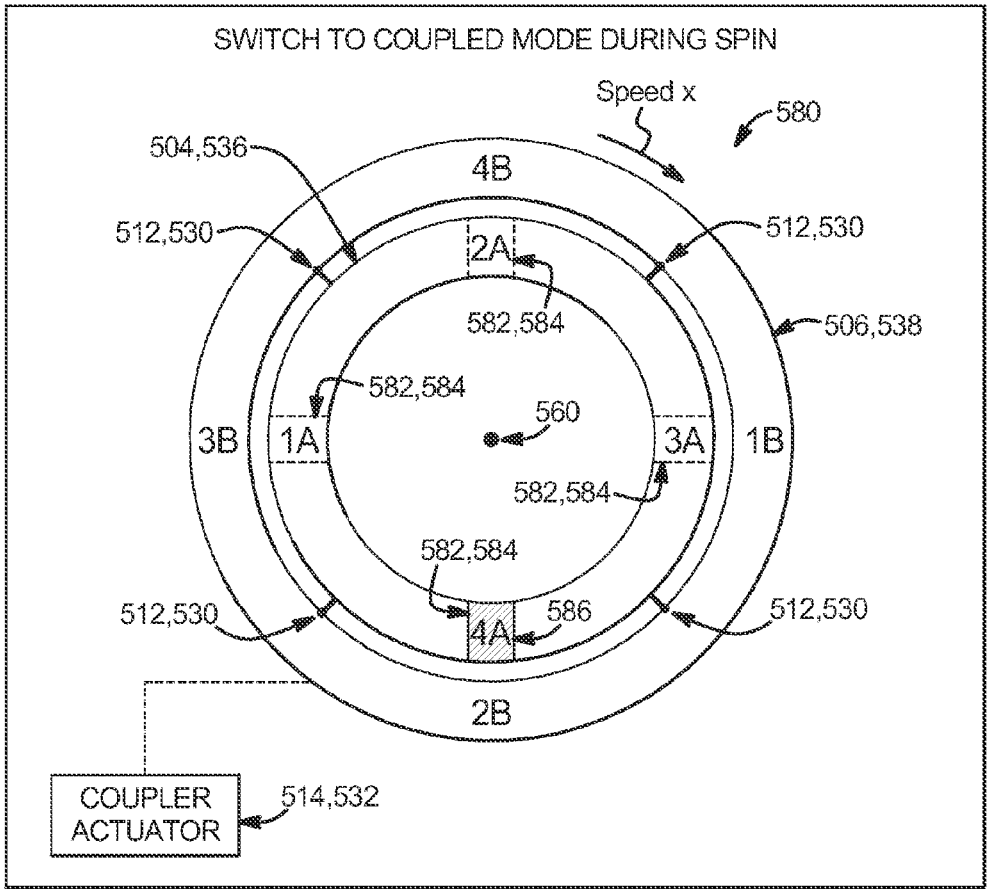
FIG. 26 is a top, schematic view of one example of one embodiment of the gaming system illustrating another indicator system.

In one embodiment illustrated in FIG. 26, the gaming system 580 includes an indicator system 582 in addition to all of the components, structure, elements and functions of gaming system 558. In this embodiment, the indicator system 582 includes at least one light source (not shown) and a plurality of light source output areas 584. In this embodiment, each output area 584 is located at, adjacent to or underneath one of the game symbols of the inner rotor 504, 536. Once the rotors 504, 536 and 506, 538 have come to a stop (or while the rotors are rotating as a set), the gaming system 580 causes one of the output areas 584 to be illuminated. In the example shown, the output area 586 is illuminated, which indicates symbol 4A on outer rotor 504, 536. Since symbol 4A is aligned with symbol 2B of inner rotor 506, 538, these symbols 4A and symbol 2B are both indicated by the output 586. The combination of symbols 4A and 2B is a game outcome which may satisfy a winning condition, as described below. In another embodiment, the output areas 584 extend across both rotors 504, 536 and 506, 538.

Figure 27:
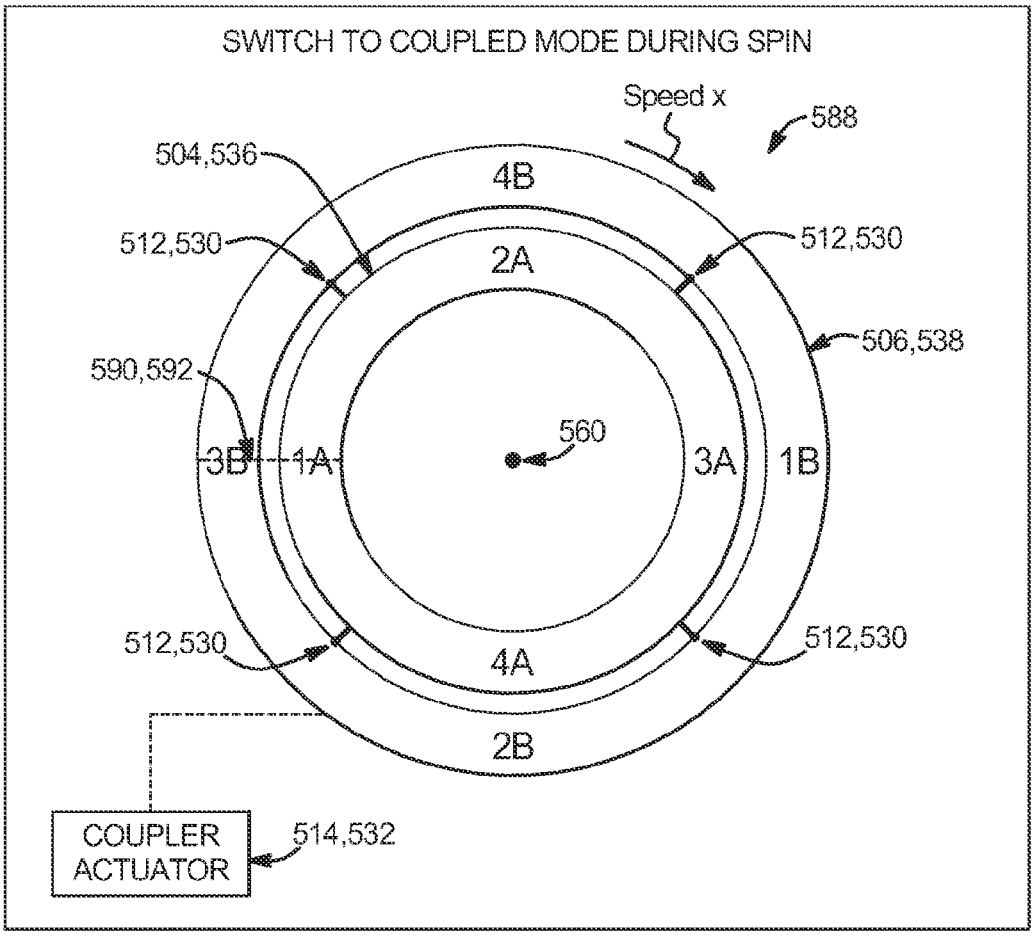
FIG. 27 is a top, schematic view of one example of one embodiment of the gaming system illustrating another indicator system.

In one embodiment illustrated in FIG. 27, the gaming system 588 includes an indicator system 590 in addition to all of the components, structure, elements and functions of gaming system 558. In one embodiment, the indicator system 590 includes a payline, win line or outcome line 592. While the rotors 504, 536 and 506, 538 are spinning as a set, or after they have come to a stop, the gaming system 588 causes the outcome line 592 to appear across both of the rotors at a plurality of the game symbols. In the illustrated example, the outcome line 592 extends through or over symbols 3B and 1A so as to indicate such symbols. The combination of symbols 3B and 1A is a game outcome which may satisfy a winning condition, as described below.

In one embodiment, the outcome line 592 is displayed on or incorporated into a transparent or semi-transparent platter (not shown) which is coupled to the housing 502, and which is located above the rotors. In one embodiment, such platter is rotatably coupled to the housing 502. The payline of such platter functions as an outcome indicator for the rotors.

Figure 28:
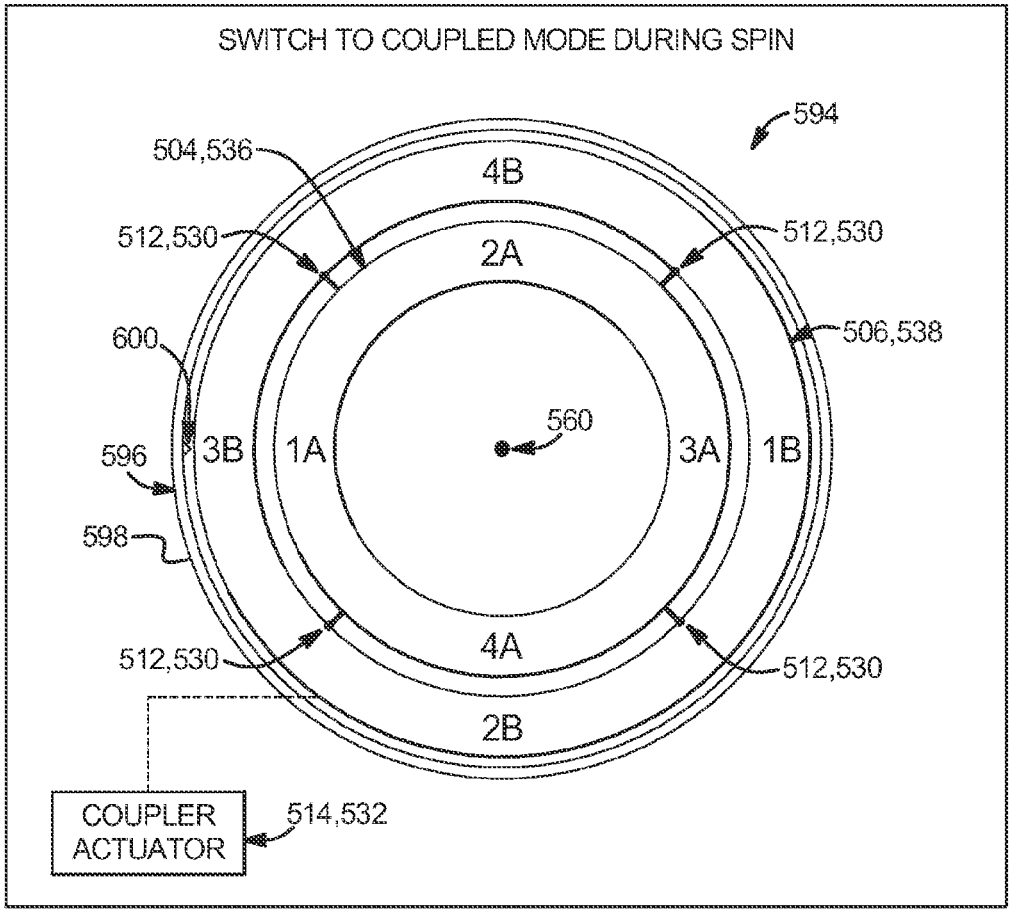
FIG. 28 is a top, schematic view of one example of one embodiment of the gaming system illustrating another indicator system.

In one embodiment illustrated in FIG. 28, the gaming system 594 includes the indicator system 596 in addition to all of the components, structure, elements and functions of gaming system 558. The indicator system 596 includes a ring 598. The ring 598 includes at least one marker or pointer 600. In one embodiment, the pointer 600 includes an elongated arm or flipper (not shown) which engages the rotor 506. In another embodiment, the pointer 600 includes an elongated arm or flipper (not shown) which engages both rotor 506 and the rotor 504. In one embodiment, the outer rotor 506, 538 has a plurality of protrusions or posts which are equally spaced about the outer portion of the perimeter of the rotor 506, 538. In such embodiment, the flipper of the pointer 600 bends and engages such posts as the rotor 506, 538 spins.

In one embodiment, the ring 598 is a portion of the housing 502, 520, and the ring 598 does not move relative to the housing 502, 520. In such embodiment, once the rotors 506, 538 and 504, 536 come to a stop, the pointer 600 points to, or indicates, a set of the symbols aligned together on the rotors. In the example illustrated, the pointer 600 indicates symbols 3B and 1A. The combination of symbols 3B and 1A is a game outcome which may satisfy a winning condition, as described below. In another embodiment, the ring 598 rotates or spins relative to the housing 502, 520. In this embodiment, a coupler 512, 524 aligns the pointer 600 with the symbols of the rotors 504, 536 and 506, 538 while the rotor set is in motion. Therefore, while the rotors are spinning, or after they stop, the pointer 600 indicates a set of the symbols on the rotors.

Figure 29:
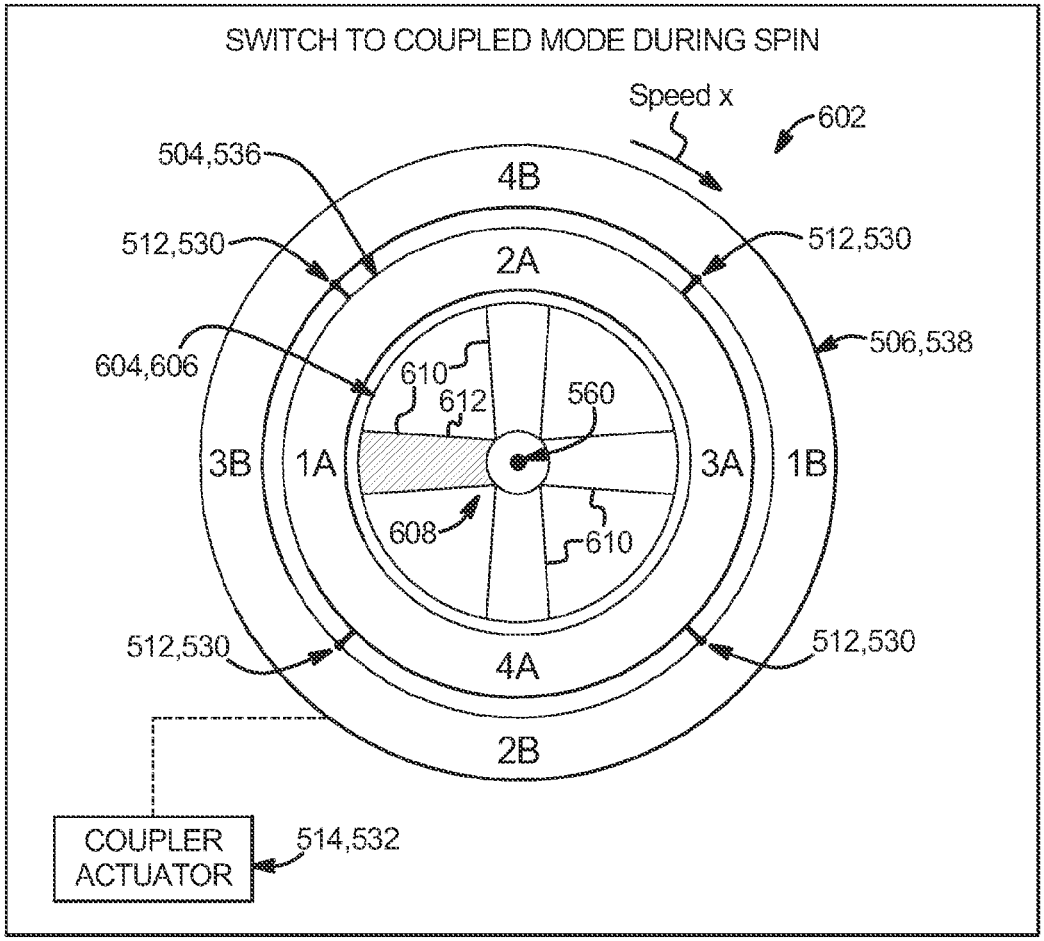
FIG. 29 is a top, schematic view of one example of one embodiment of the gaming system illustrating another indicator system.

In one embodiment illustrated in FIG. 29, the gaming system 602 includes an indicator system 604 in addition to all of the components, structure, elements and functions of gaming system 558. In this embodiment indicator system 604 includes a display device 606, such as a liquid crystal device (LCD), configured to display an image 608. The image 608, in this example, includes four branches or arms 610. The gaming system 602 causes the arms 610 to be sequentially illuminated while the rotors 504, 536 and 506, 538 are spinning or after they have stopped spinning. After a designated event occurs, the gaming system 602 causes only one of the arms 610 to be illuminated which, in this example, is arm 612. The illumination of branch 612 indicates symbols 1A and 3B on the rotors. The combination of symbols 1A and 3B is a game outcome which may satisfy a winning condition, as described below.

It should be appreciated that the gaming system 602 can cause the display device 606 to display any suitable type, shape or color of image, animation, sprite or graphical representation or a person, place or thing on the screen of the display device 606. While the rotors 506, 538 and 504, 536 are spinning, or after they have stopped spinning, the image 608 indicates, in one embodiment, multiple combinations of the game symbols on the rotors.

Figure 30:
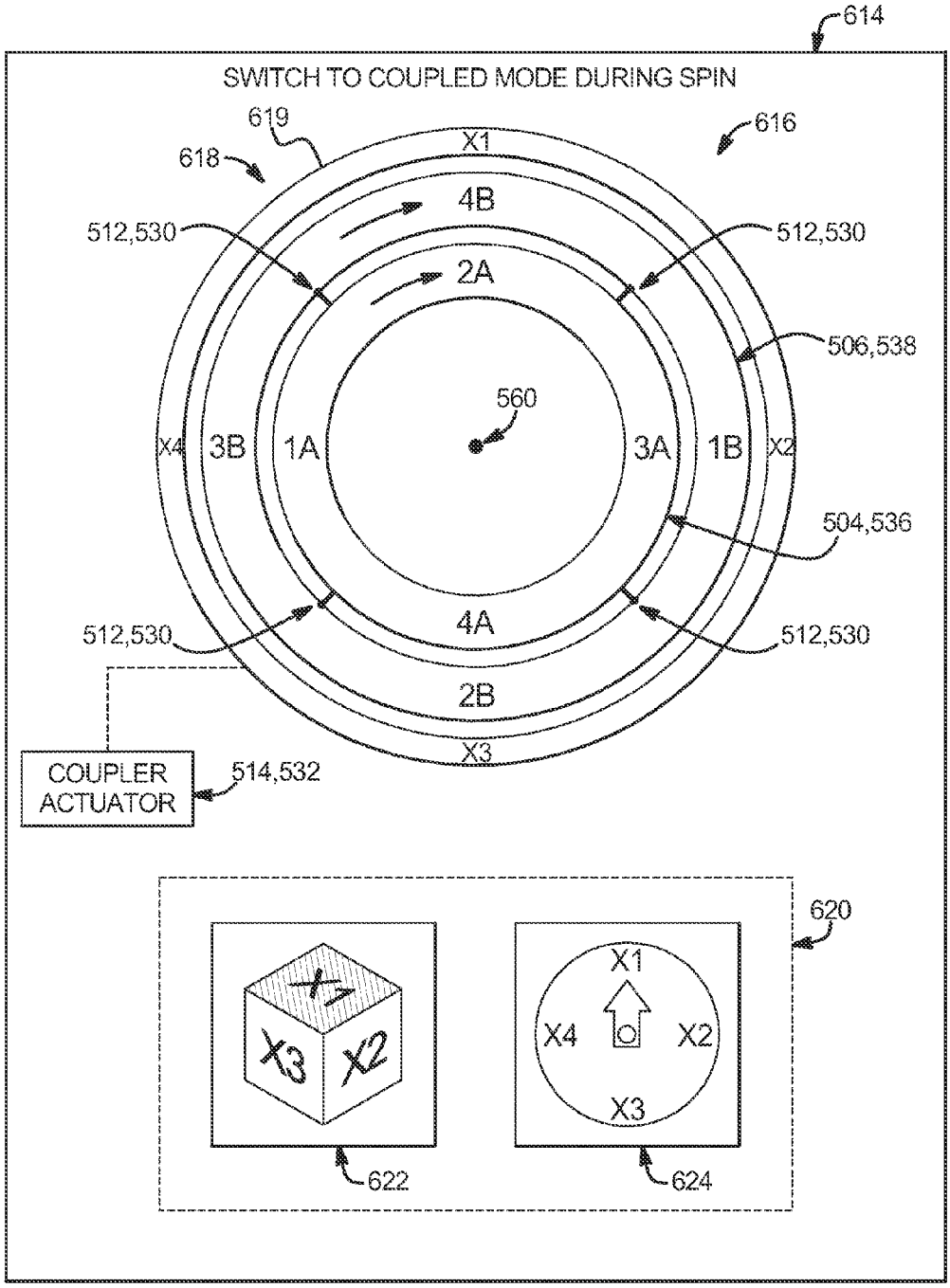
FIG. 30 is a top, schematic view of one example of one embodiment of the gaming system illustrating another indicator system.

As illustrated in FIG. 30, in one embodiment the gaming system 614 includes: (a) an assembly 616, which includes indicator system 618 in addition to all of the components, structure, elements and functions of gaming system 558; and (b) an outcome generator 620. In one embodiment, the indicator system 618 includes a circular support 619 which bears a plurality of markers or symbols which, in this example, are symbols X1, X2, X3, and X4. Depending upon the embodiment, the circular support 619 may or may not rotate relative to the housing 502, 520. After the rotors 506, 538 and 504, 536 come to a stop (or while they are spinning together as one unit), the symbols of the rotors align with one of the symbols of the circular support 619 due to the game symbol aligner. At some point, while the rotors are spinning, or after they have stopped, the outcome generator 620 generates an outcome or one of the symbols X1, X2, X3 or X4 of the indicator system 618.

As illustrated in FIG. 30, the outcome generator 620 can include a die 622 with a different symbol on each side, a spinner 624 which spins and eventually points to a symbol, or any other suitable symbol generator or outcome generator. Each outcome generator 620 and 622, in this example, indicates X1. The indication of X1 corresponds to the X1 symbol on the circular support 619 of the indicator system 618. Accordingly, the generation of symbol X1 indicates symbols 2A and 4B of the rotors. The combination of symbols 2A and 4B is a game outcome which may satisfy a winning condition, as described below.

In one embodiment, the gaming system 614 includes a plurality of light sources, such as light emitting diodes (LEDs) supported by the circular support 618. Each light source is located at or adjacent to one of the symbols X1 X2, X3 or X4 on the circular support 619. The gaming system 614 controls the illumination of the light sources. In one embodiment, the gaming system 614 switches on each light source for a period of time and then switches it off, and the gaming system 614 performs such switching for all of the light sources in sequence, resulting in a chasing sequence. When a designated event occurs or a designated signal is received, the gaming system 614 stops the chasing sequence and illuminates one of the light sources. The illuminated light source illuminates one of the symbols X1, X2, X3 or X4. The illuminated symbol indicates the combination of game symbols on the rotors which are in line with the illuminated symbol.

Figure 31:
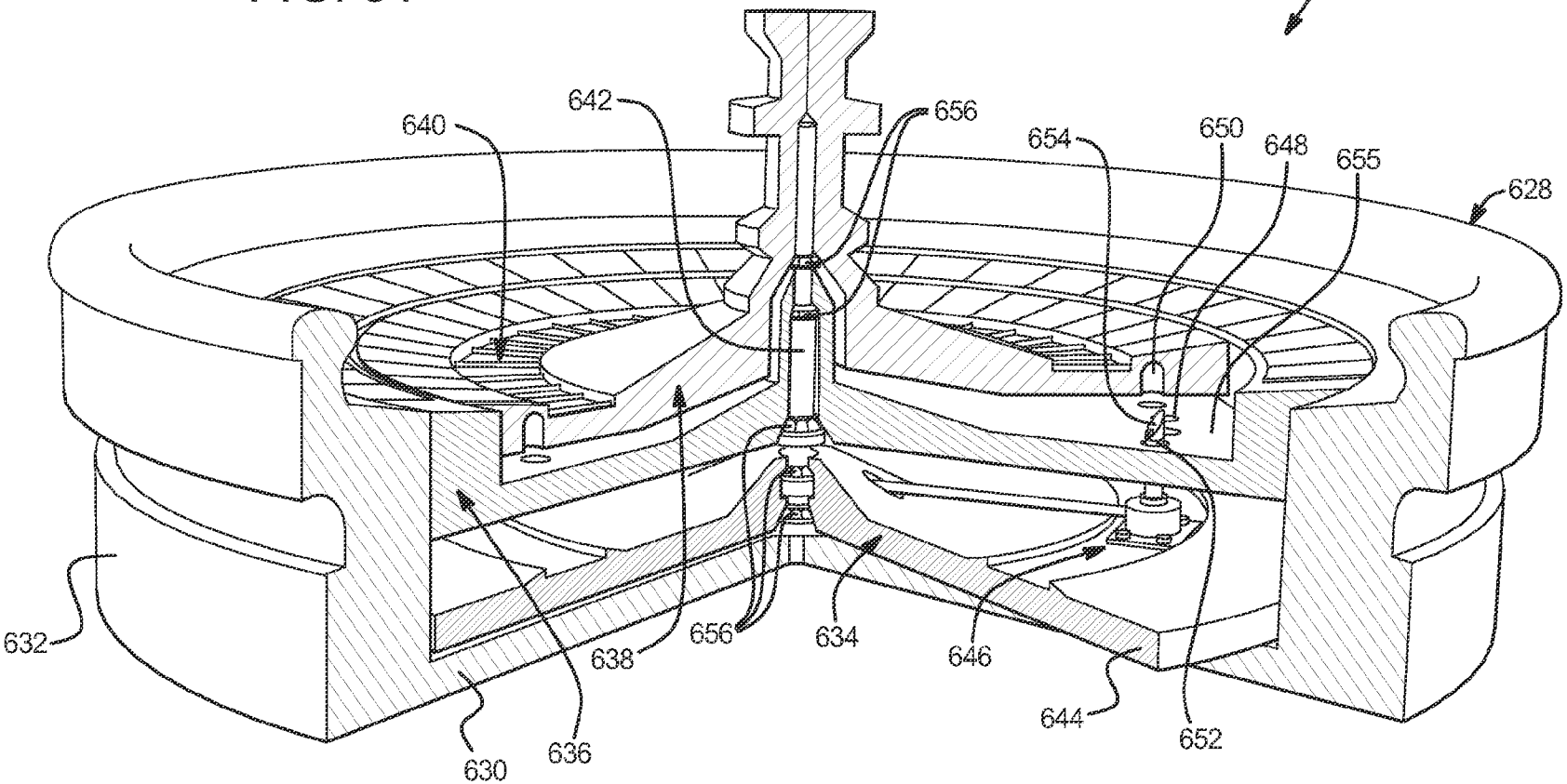
FIG. 31 is a side, perspective, cut-away view of one embodiment of the gaming system.

In one embodiment illustrated in FIG. 31, gaming system 626 includes circular-shaped housing 628. Housing 628 has a base 630 and a cylindrical, vertical side wall 632 which supports the rotor coupler 634, outer rotor 636, inner rotor 638, and the pockets, canoes or ball landings 640. Also, the gaming system 626 includes a spindle 642 about which the rotors 634 and 636 rotate. In the illustrated embodiment, the inner rotor 638 holds or incorporates the ball landings 640.

Referring to FIG. 31, the rotor coupler 634, in this embodiment, includes a rotatable platter or disk 644 which supports a piston assembly 646. The outer rotor 636 defines a plurality of holes 648 which are equally spaced apart about the perimeter of the outer rotor 636. The underside of the inner rotor 638 defines a plurality of notches or detents 650 which are equally spaced apart about the perimeter of the inner rotor 638. The holes 648 and detents 650 are located the same distance from the spindle 642. The piston assembly includes a retractable plunger or stopper 652. The stopper 652 has a flipper 654 with a curved shaped tip. In one embodiment, the stopper 652 includes a spring (not shown) which causes the flipper 654 to be spring activated.

In one embodiment, during the decoupled mode, the flipper end 654 has a retracted position (not shown) which keeps the flipper end 654 beneath the inner rotor 638. When the rotor coupler 634 receives a designated signal, the piston assembly 646 pushes the flipper 654 upward. The flipper 654 then extends through the hole occupied by the stopper 652, and the flipper 654 protrudes from the topside 655 of the outer rotor 636. The contact between the flipper 654 and the inner rotor 638 slows the differential movement between inner and outer rotors 636 and 638. Eventually, the flipper 654 lodges into one of the detents 650. As a result, the rotors 636 and 638, and the disk 644, are all coupled to each other. During this coupled mode, the disk 644, rotor 636 and rotor 638 spin or rotate together as one unit.

In one embodiment, the disk 644, rotor 636 and rotor 638 continue to spin indefinitely until a signal or event occurs to decouple the rotor 636 and rotor 638 for the start of another game. In such embodiment, the disk 644 rotates continuously for as long as the game is active. In one embodiment, after the disk 644, rotor 636 and rotor 638 are coupled and therefore rotating together, the rotation slows. In one embodiment, the reduction in rotational speed can progress to the point that rotation stops before the next game begins. In another embodiment, the reduction in rotational speed progresses to the point that rotation stops if a new game is not initiated within a designated amount of time. In one embodiment where the rotational speed of the disk 644 slows, this slowing occurs by the forces of friction. In another embodiment where the rotational speed of the disk 644 slows, this slowing occurs by direct action of an attached motor or drive, not shown.

In one embodiment, the gaming system 626 includes a plurality of friction reducers, such as ball bearing rings 656. The ball bearing rings 656 reduce the friction which is present when the rotors 636 and 638 and disks 644 rotate relative to the spindle 642. Not shown are other types of friction reducing devices, such as other types of mechanical bearings, air bearings, liquid floatation, electro-magnet suspension, a suitable combination of the foregoing, or any other suitable device or mechanism.

In one embodiment not fully illustrated, the gaming system 626 includes two or more annular cylinders, stacked longwise one atop of the other with the common spindle 642 going through all of the annuli. The bearings or friction reducing mechanisms 656 are located between each cylinder and the common spindle 642, between the cylinders themselves, or between the lowest cylinder and the base 630 out of which, or through which, the central spindle 642 is located. The topmost cylinder is connected to the inner most rotor 638 through a set of spokes angling upward from the cylinder to beneath the rotor. The next lower cylinder supports the next closest rotor also by a set of spokes. The set of spokes is configured to attach any one of the rotors to its associated cylinder, and each set of spokes is configured to sweep through a conic area, where none of the conic areas of the different sets of spokes intersect.

Figure 32:
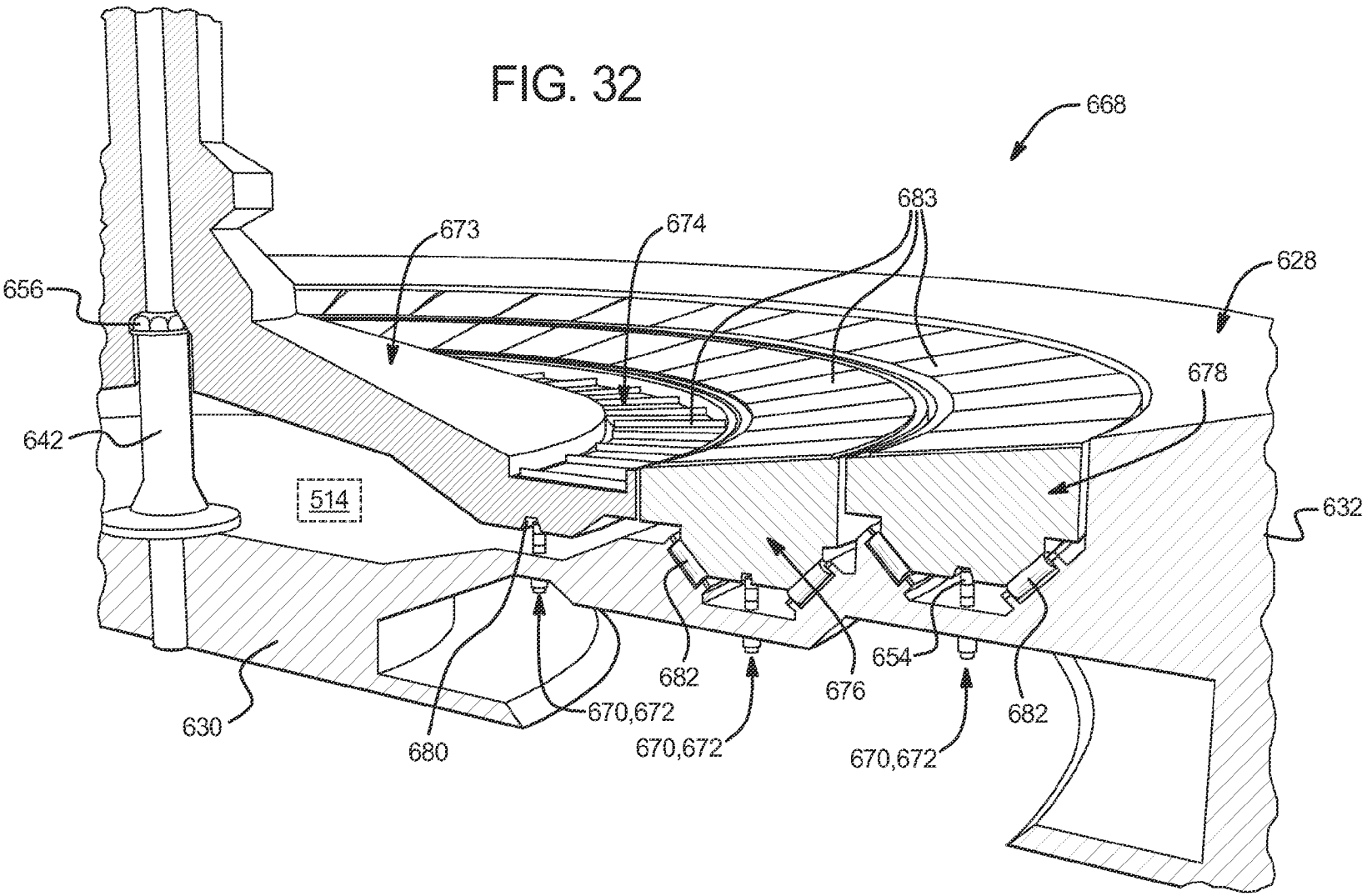
FIG. 32 is a fragmentary, side, perspective, cut-away view of another embodiment of the gaming system.

In one embodiment illustrated in FIG. 32, the gaming system 668 includes a rotor coupler system 670. The coupler system 670 includes a plurality of piston assemblies 672. Each one of the piston assemblies 672 has a retractable stopper 652 and a flipper 654.

In one embodiment, each flipper 654 is spring loaded or spring activated. In another embodiment, each flipper 654 has a degree of pliability. For example, the material of the pliable flipper 654 could be a pliable material which partially gives way, resulting in a less abrupt interlock.

The stopper 652 extends into one of the holes 648 which couples the rotatable disk 644 to the outer rotor 636. As such, the disk 644 and outer rotor 636 rotate together as one unit during the decoupled mode.

The gaming system 668 includes a rotatable ball landing support 673. The ball landing support 673 includes a plurality of pockets, canoes or ball landings 674 which are equally spaced about the perimeter of the ball landing support 673. In one embodiment not shown, a first ball landing is of a different geometry than a second ball landing on the same rotor. In one variation, the first ball landing is of an appreciably different angular width than that of a second ball landing. In one embodiment, each ball landing 674 has a plurality of retaining walls configured to retain a ball within the ball landing 674. The underside of the ball landing support 673 defines a plurality notches or detents 680 which are equally spaced apart about the perimeter of the ball landing support 673. Likewise, the underside of the inner rotor 676 defines a plurality notches or detents (not shown) which are equally spaced apart about the perimeter of the inner rotor 676. Also, the underside of the outer rotor 678 defines a plurality notches or detents (not shown) which are equally spaced apart about the perimeter of the outer rotor 678.

In addition, the gaming system 668 includes a plurality of roller bearings 682 situated under each one of the rotors 676 and 678. In the decoupled mode, the rotors 676 and 678 and the ball landing support 672 spin independent of one another in the same or different directions and at the same or different speeds. When a designated event occurs, or when a designated input is received by the coupler actuator 514, each one of the pistons 672 outwardly projects the flipper 654. Because the flippers 654 are extendable through the action of a solenoid and retractable based on a retraction springs, they interchangeably move upward and downward as they pass by the detents 680 until eventually each flipper 654 extends into one of the detents to form of stop position. In an alternate embodiment, the flippers 654 are extendable and retractable through the use of a bi-directional solenoid which extends the flippers 654 when electrical current flows in one direction and retracts the flippers 654 when the electrical current flows in the opposite direction. After each of the flippers 654 is lodged into a detent, the rotors 676 and 678 and the ball landing support 673 stop moving. The fixed position of the pistons 672 maintains the alignment of the segments 683 of the ball landing support 673 and rotors 676 and 678.

In one embodiment, the each one of the rotor 676 and 678 lies on it's own track with it's own bearings of any suitable type, including roller bearings, ball bearings, gas or liquid bearings, or any other suitable kind of friction reducing device. In this embodiment, rotor 676 does not require any structural support from rotor 678, and rotor 678 does not require any structural support from rotor 676. In other words, the housing 628 provides full support for each rotor 676 and 678.

Figure 33:
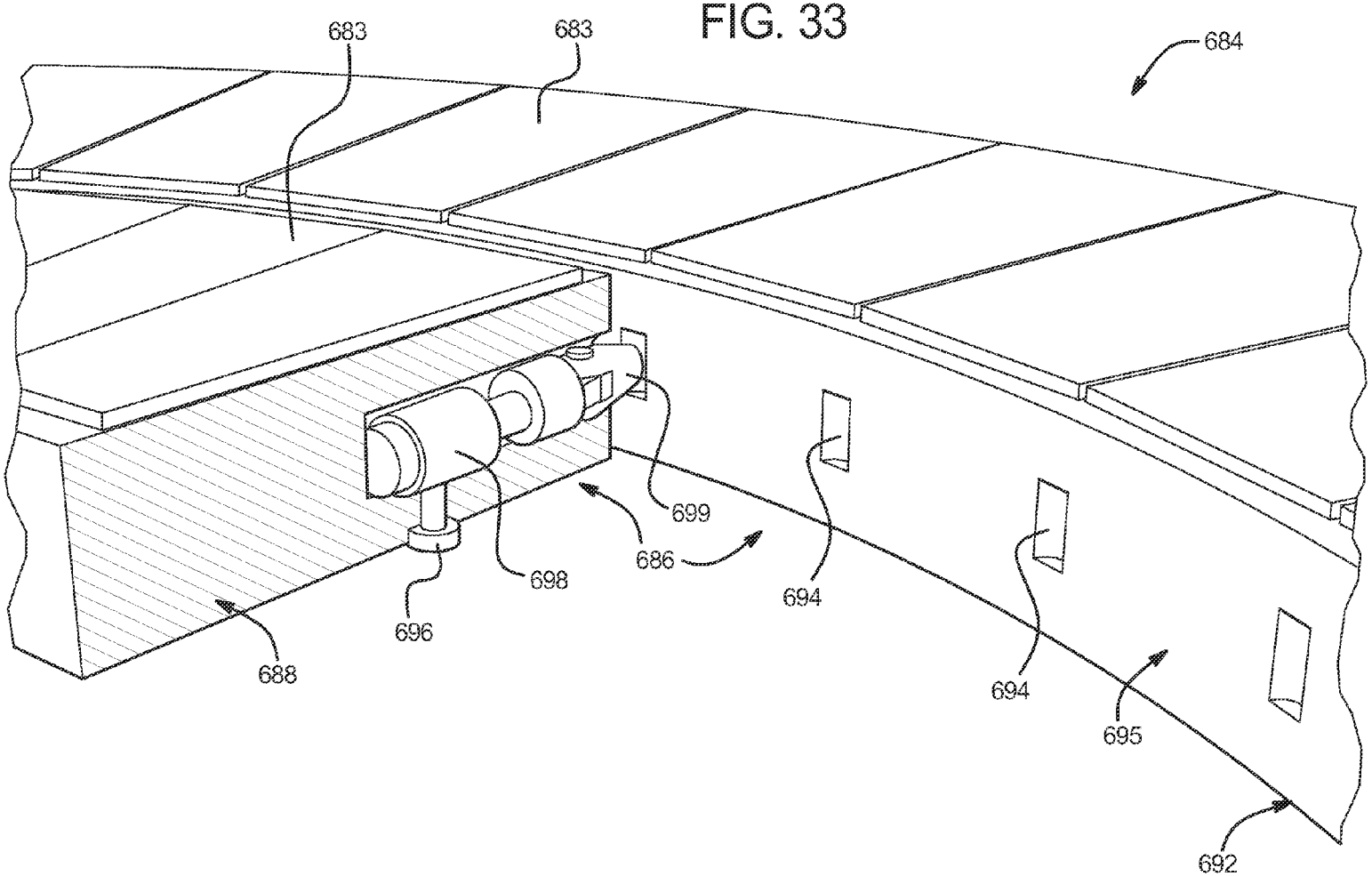
FIG. 33 is a fragmentary, side, perspective, view of another embodiment of the gaming system.

In one embodiment illustrated in FIG. 33, the gaming system 684 includes all of the components, structure, elements and functions of gaming system 668 except that gaming system 684 replaces the rotor coupler system 670 with the rotor coupler system 686. In this embodiment, the inner rotor 688 defines a slot or an opening sized to house or otherwise receives an electronic solenoid-piston assembly 698. The outer rotor 692 defines a plurality of equally spaced apart detents or slots 694 positioned along the inner, vertical wall 695 of the outer rotor 692. In one embodiment, the solenoid-piston assembly 698 includes an infrared sensor 696. When the sensor 696 receives a signal, the sensor actuates the solenoid-piston assembly 698 to extend the spring-loaded flipper head 699. The friction caused by the force of the flipper head 699 against the vertical wall 695 slows the rotor 692. Eventually the flipper head 699 lodges into one of the detents 694. As a result, the rotors 688 and 692 are coupled together, and the two rotors rotate as one unit in a coupled mode.

In one embodiment, the sensor 696 reads or receives light generated by a coupler actuator, and the sensor 696 activates the solenoid-piston assembly 698 based on the received light. In one embodiment, the gaming system 684 includes a power source, such as a battery or voltage generator, to electrically power the solenoid-piston assembly 698. In one embodiment, the solenoid-piston assembly 698 is positioned beneath the ball landing support 673 (illustrated in FIG. 32) rather than being housed within the inner rotor 688.

Figure 34:
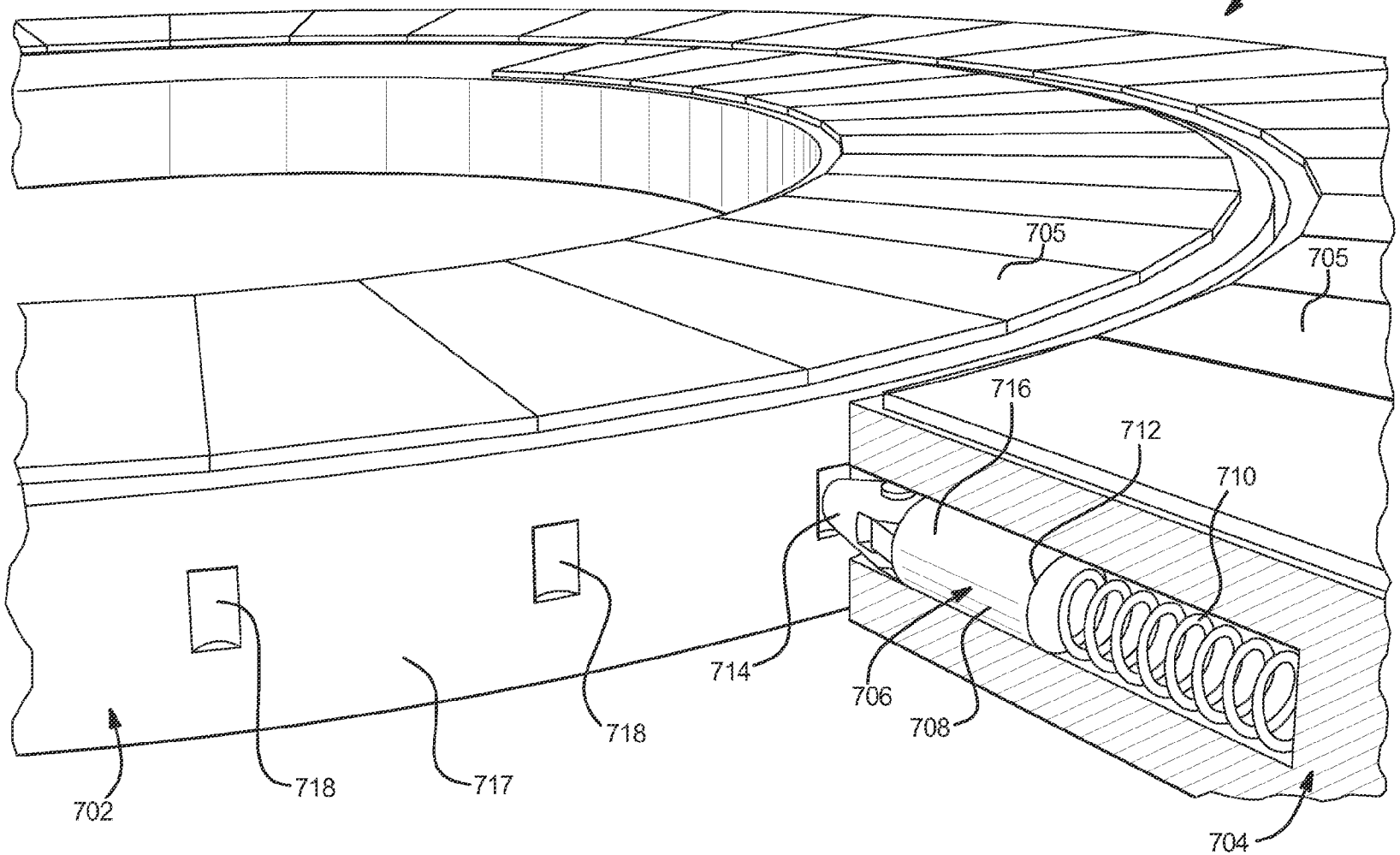
FIG. 34 is a fragmentary, side, perspective view of another embodiment of the gaming system.

In one embodiment illustrated in FIG. 34, the gaming system 700 includes inner rotor 702 and outer rotor 704 without including a coupler actuator. Each rotor 702 and 704 has a plurality of segments 705. In this embodiment, the rotator coupler includes a centripetal device 706. The centripetal device 706 includes a body 708 which has a designated weight, a spring 710 coupled to the outer end 712 of the body 708 and a spring-loaded flipper head 714 coupled to the inner end 716 of the body 708. In one embodiment, the centripetal device 706 is housed within an opening or inner space defined by the outer rotor 704. The outer, vertical wall 717 of the inner rotor 702 defines a plurality of slots or detents which are equally spaced apart about the perimeter of the inner rotor 702. When the game begins, the inner and outer rotors 702 and 704 rotate independent of one another in equal or opposite directions and at the same or different speeds. The combined force of the spring 710 and the centripetal force caused by the weight of the body 708 push the flipper head 714 against the vertical wall 717. The friction between the flipper head 714 and the vertical wall 717 eventually slows the movement of the inner and outer rotors relative to one another. In addition, the lodging and dislodging of the flipper head 714 in and out of the detents 718 also slows the movement of the rotors relative to one another. Eventually, the flipper head 714 lodges itself into one of the detents 718. At that time, the inner and outer rotors 702 and 704 move together as one unit in a coupled mode. The position of the centripetal device 706 relative to the detents 718 causes the segments 705 of the rotors 702 and 704 to be aligned with each other.

Figure 35:
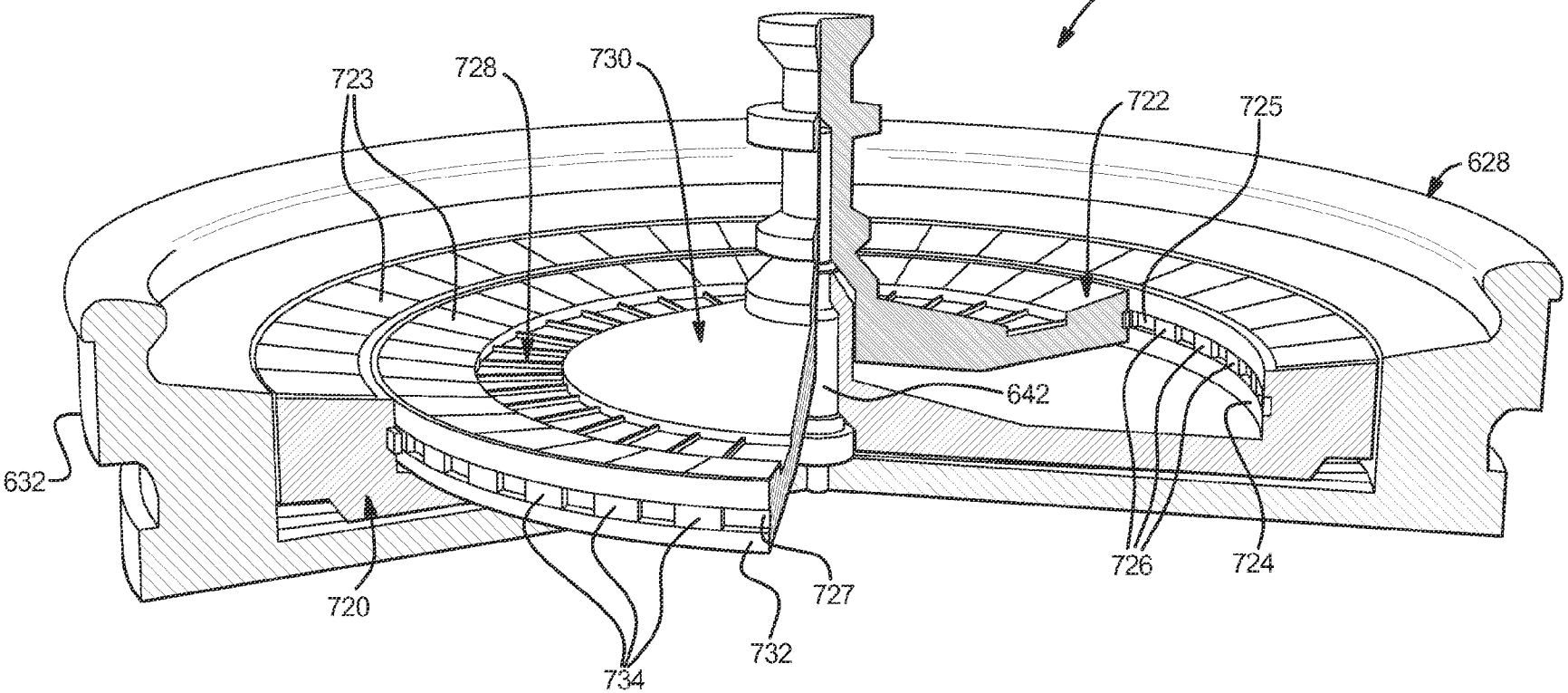
FIG. 35 is a side, perspective, cut-away view of one embodiment of the gaming system.

In one embodiment illustrated in FIG. 35, the gaming system 718 includes an outer rotor 720 and an inner rotor 722. Each rotor 720 and 722 has a plurality of segments 723. In this embodiment, the inner, vertical wall 724 of the outer rotor 720 defines a slot 725 sized to receive a plurality of metallic parts or ferrous slugs 726. The inner rotor 722 includes a plurality of ball landings 728 and a dome-shaped or conical cover 730. The outer vertical wall 732 of the inner rotor 722 defines a slot 727 sized to receive and hold a plurality of electro-magnets 734. In one embodiment, the gaming system 718 includes an electrical power source coupled to the electro-magnets 734. The power source is operable to produce a current which magnetizes the electro-magnets 734. In one embodiment, when the game begins, the power source disrupts the current flow to the electro-magnets 734, thereby eliminating the generation of electro-magnetic fields from the electro magnets 734 while the inner and outer rotors 720 and 722 rotate independent of one another in equal or opposite directions and at the same or different speeds. When the gaming system 718 receives a designated signal, the power source causes the electro-magnets 734 to be magnetized. The attraction between the electro-magnets 734 and the ferrous slugs 726 slows the differential movement between the inner and outer rotors 720 until eventually, the rotors have a fixed spatial relationship relative to one another. In other words, the magnetic attraction between the rotors 720 and 722 couples the rotors together. At that time, the inner and outer rotors 720 and 722 rotate as one unit in an aligned fashion. The relative positioning of the electro-magnetic 737 slugs 726 and segments 723 causes the segments of the different rotors 720 and 722 to be aligned.

In one embodiment, the electro-magnets 734 or the ferrous slugs 726 are moveably positioned within the rotors. Each electro-magnet 734 and ferrous slug 726 is movable between a plurality of positions along a radius of the concentrically arranged rotors. In one embodiment, the gaming system includes a spring-resisted solenoid within each rotor. Each solenoid within a rotor is configured to move an electro-magnet 734 (or ferrous slug 726) between: (a) a first position which is closer to the adjacent rotor; and (b) a second position which is further from the adjacent rotor. In another embodiment, the centripetal force caused by the spinning of the rotors causes the electro-magnets 734 and ferrous slugs 726 to move inward toward the center of the rotors, which increases the distance between the magnets 734 and the adjacent slugs 726.

In one embodiment, the power source coupled to the electro-magnets 734 is connected to a circuit which has a switch. The switch is located adjacent to at least one of the movable electro-magnets 734. When the rotors are spinning fast enough, the centripetal force forces such electro-magnet 734 against the switch, causing the switch to open. The opened switch stops the current to the electro-magnets 734, which, in turn, stops the magnetic force between the electro-magnets 734 and the slugs 726. As a result, the rotors can achieve the decoupled mode when they are spun relatively fast. As the rotors slow, and the centripetal force decreases, and such electro-magnet 734 releases the switch, causing the switch to close the circuit. As a result, the magnetic force is generated to bring the rotors into the coupled mode.

In one embodiment, the electro-magnets 734 and electrical power source are replaced with earth-based magnets attached to the inner rotor 722. When the game begins, the game operator (whether human or electronic) spins the rotors 720 and 722 with a differential force great enough to cause the rotors to rotate independent of one another in equal or opposite directions and at equal or opposite speeds. Eventually, the magnetic attraction force between the magnets and the ferrous slug 726 positioned on the inner rotor 722 slows the differential movement between the rotors. Eventually, the force causes the rotors to rotate as one unit with a fixed spatial relationship relative to one another. At that time, the rotors 720 and 722 are magnetically coupled to each other.

In one embodiment not shown, the rotors of the gaming system are interlocked with each other through a tongue and groove connection. In this embodiment, the rotors remain interlocked during the coupled mode and during the decoupled mode. In one example, the inner rotor has a circular ball bearing ring attached to its outer, vertical wall. The inner, vertical wall of the outer rotor has a disk or circular edge which is carried by the bearing ring. In this interlocked connection, the rotors can be rotated relative to one another during the decoupled mode. Various devices, such as the rotor couplers described above, can be used to stop the rotors from rotating relative to each other to establish the coupled mode described above.

In one embodiment not shown, the rotors of the gaming system are each connected to an independent coaxial column, similar to a coaxial dock mechanism coupled to independently moving hands of a dock. For each rotor, the connection between its associated coaxial column and such rotor can be a solid disk, a set of spokes or any other suitable type of structure.

In one embodiment, the gaming system includes a betting system which enables the player to place one or more wagers on one or more of the rotors. The following is an example paytable for the example gaming systems illustrated in FIGS. 21-30:

| Indicated Combination | | | | | | |
|---|---|---|---|---|---|---|
| Outcome Outer Rotor | Outcome Inner Rotor | Win Added to Wager | Total Paid | Hit % | Odds | Payback |
| 4B | 4A | 4 | 5 | 6.2500% | 16.0 to 1 | 31.2500% |
| 3B | 3A | 3 | 4 | 6.2500% | 16.0 to 1 | 25.0000% |
| 2B | 2A | 2 | 3 | 6.2500% | 16.0 to 1 | 18.7500% |
| 1B | 1A | 1 | 2 | 6.2500% | 16.0 to 1 | 12.5000% |
| | TOTALS: | | | 25.0000% | 4.0 to 1 | 87.5000% |

In one embodiment, as in a Roulette game, the betting system enables the player to place a player-specific-colored chip onto a felt or other surface of a betting table. The placement of the chip indicates the specific bet, such as a bet on red or a bet on the number 17.

In another embodiment, the betting system includes a symbol combination bet area. In one example, the symbol combination bet area enables the player to place a wager on a combination of symbols which might appear across two or more concentrically positioned rotors. For example, the symbol combination bet area enables the player to place a wager which pays a combination award if the symbols of the indicated symbol combination of the selected rotors are of the same color or of the same number. The following is another example paytable for a gaming system having three concentrically positioned rotors involving European-style Roulette with only one pocket marked as a non-zero number:

| 3 Rotor Combination Outcome | Qualifying Condition | Win Added to Wager | Total Paid | Hit % | Odds | Payback |
|---|---|---|---|---|---|---|
| Triplet Zeros | Three 0s | 1,000 | 1,001 | 0.0020% | 50653.0 to 1 | 1.9762% |
| Triplet | Three of a kind (other than 0) | 100 | 101 | 0.0711% | 1407.0 to 1 | 7.1783% |
| Pair Zeros | Pair 0s | 50 | 51 | 0.2132% | 469.0 to 1 | 10.8740% |
| Straight | ANY-order straight: [0, 1, 2] [1, 2, 3] . . . [34, 35, 36] | 25 | 26 | 0.4146% | 241.2 to 1 | 10.7792% |
| Pair | Pair (other than 0) | 5 | 6 | 7.6758% | 13.0 to 1 | 46.0545% |

-continued

| 3 Rotor Combination Outcome | Qualifying Condition | Win Added to Wager | Total Paid | Hit % | Odds | Payback |
|---|---|---|---|---|---|---|
| Color Match | All red or all black (no matching numbers) | Push | 1 | 19.2220% | 5.2 to 1 | 19.2220% |
| TOTALS: | | | | 27.5986% | 3.6 to 1 | 96.0842% |

In this example, a player places a single wager for a combination award. The single wager provides the player with the opportunity to win if any one of the combination outcomes occurs. The game operator spins the three rotors, and they spin independent of each other in the decoupled mode for a period of time. At the same time, the game operator causes a ball to roll on top of the moving rotors. Then, the rotor coupler interlocks the three rotors so that the symbols of the three rotors are aligned with each other. The three rotors spin together as one unit for a period of time, during which the ball rolls across the ball landing pockets. In one example, eventually, the ball lands in a pocket which is in line with Black 17—Black 17—Black 24.

In this example, if a combination outcome satisfies more than one qualifying condition, the player receives the higher of the awards corresponding to such conditions. For example, Black 17—Black 17—Black 24 is both a pair and a color match. Therefore, the award is five because five, which corresponds to the pair, is higher than a push, which corresponds to the color match.

In one embodiment, the betting system includes a bet collection device, such as a collector which accepts a fifty cent coin. The betting system requires the player to deposit currency in the bet collection device to activate a bet placed on symbol combination bet area described above. In one embodiment, the gaming system includes at least one such bet collection device for each player betting station.

In one embodiment, the betting system includes an on-table betting terminal. At least one betting station at each player position has a video screen or other display device with a touch screen, hard buttons or other suitable input devices. In one embodiment, the betting station has a mechanism for accepting player wagers, such as currency or a ticket-in ticket-out (TITO) ticket. The betting station also has a mechanism for displaying to the player, the amount of wagers registered with the betting system. In one embodiment, the betting station has a mechanism which pays any winnings or remaining wagers registered with the betting system. Depending upon the embodiment, the payout mechanism may include a currency dispenser or a TITO dispenser.

In one embodiment, the betting system includes an off-table betting station. In this embodiment, the betting system is located on a Roulette betting table or other medium which is located apart from the rotors. In one embodiment, the betting station is not physically connected to the rotors. For example, the betting station can be operatively coupled to the rotors by a data network, such as a local area network, a local intranet or the Internet. Such betting station could exist off-premise, such as at a special betting parlor, on a home computer or on other devices, such as mobile phone, or personal digital assistant (PDA) or other suitable devices.

In one embodiment, the gaming system includes: (a) an inner rotor which has a plurality of ball landings; (b) an indicia rotor coupled to the inner rotor, wherein the indicia rotor has or displays indicia or a plurality of symbols; and (c) an outer rotor adjacent to the inner rotor.

In one embodiment, the gaming system includes: (a) an inner rotor which has a plurality of ball landings, wherein the inner rotor is not coupled to an indicia rotor; and (b) an outer rotor adjacent to the inner rotor.

In one embodiment, the gaming system includes: (a) an inner rotor; (b) an outer rotor which has a plurality of ball landings; and (c) an indicia rotor coupled to the outer rotor, wherein the indicia rotor has or displays indicia or a plurality of symbols.

In one embodiment, the gaming system includes: (a) an outer rotor which has a plurality of ball landings, wherein the outer rotor is not coupled to an indicia rotor; and (b) an inner rotor adjacent to the inner rotor.

In one embodiment, the gaming system includes: (a) an inner rotor; (b) an outer rotor; (c) an intermediate rotor positioned between the inner and outer rotors, wherein the intermediate rotor has a plurality of ball landings; and (d) an indicia rotor coupled to the intermediate rotor, wherein the indicia rotor has or displays indicia or a plurality of symbols.

In one embodiment, the gaming system includes: (a) an inner rotor; (b) an outer rotor; and (c) an intermediate rotor positioned between the inner and outer rotors, wherein the intermediate rotor has a plurality of ball landings, and the intermediate rotor is not coupled to an indicia rotor.

In one embodiment, every rotor of the gaming system has or displays: (a) a plurality of ball landings; and (b) indicia or a plurality of symbols.

In one embodiment, the gaming system includes one or more components, elements, functions or structural characteristics of any of the embodiments described above. In another embodiment, the gaming system includes all of the components, elements, functions and structural elements of the embodiments described above which are combinable in a suitable fashion for the performance of a wagering game.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

What is claimed is:

1. A gaming system comprising:

at least one display device;

at least one processor; and at least one memory device storing a plurality of instructions which, when executed by the at least one processor, cause the at least one processor to operate with the at least one display device, for a play of a game, to:

(a) display a plurality of rotors, the rotors sharing a common axis of rotation, one of the rotors being positioned within a perimeter of another one of the rotors, each of the rotors being associated with a plurality of symbols;

(b) display a plurality of the rotors rotating independent of each other in a decoupled mode;

(c) after an occurrence of a designated triggering condition, cause a change from the decoupled mode to a coupled mode;

(d) thereafter, display the plurality of the rotors coupled to each other in the coupled mode;

(e) for each of the rotors, indicate one of the symbols associated with said rotor; and (f) if the indicated symbol of each of a designated quantity of at least two of the rotors is a designated one of the symbols associated with said rotor, provide a designated award.

2. The gaming system of claim 1, wherein the designated quantity of the rotors is all of the rotors.

3. The gaming system of claim 1, wherein each of the rotors is associated with a same plurality of symbols.

4. The gaming system of claim 3, wherein the designated one of the symbols associated with each of the rotors is a same one of the symbols.

5. The gaming system of claim 1, wherein the designated award is a progressive award.

6. The gaming system of claim 1, wherein the plurality of instructions, when executed by the at least one processor, cause the at least one processor to display a plurality of landings, each of the landings being associated with at least one of the symbols of each of the rotors when the rotors are coupled to each other in the coupled mode, and for each of the rotors, indicate one of the symbols associated with said rotor by indicating one of the landings.

7. A method of operating a gaming system, said method comprising:

causing at least one processor to execute a plurality of instructions stored in at least one memory device to operate with at least one display device, for a play of a game, to:

(a) display a plurality of rotors, the rotors sharing a common axis of rotation, one of the rotors being positioned within a perimeter of another one of the rotors, each of the rotors being associated with a plurality of symbols;

(b) display a plurality of the rotors rotating independent of each other in a decoupled mode;

(c) after an occurrence of a designated triggering condition, cause a change from the decoupled mode to a coupled mode;

(d) thereafter, display the plurality of the rotors coupled to each other in the coupled mode; and (e) for each of the rotors, indicate one of the symbols associated with said rotor; and if the indicated symbol of each of a designated quantity of at least two of the rotors is a designated one of the symbols associated with said rotor, providing a designated award for said play of the game.

8. The method of claim 7, wherein the designated quantity of the rotors is all of the rotors.

9. The method of claim 7, wherein each of the rotors is associated with a same plurality of symbols.

10. The method of claim 9, wherein the designated one of the symbols associated with each of the rotors is a same one of the symbols.

11. The method of claim 7, wherein the designated award is a progressive award.

12. The method of claim 7, which includes causing the at least one processor to execute the plurality of instructions to operate with the at least one display device to display a plurality of landings, each of the landings being associated with at least one of the symbols of each of the rotors when the rotors are coupled to each other in the coupled mode, and for each of the rotors, indicate one of the symbols associated with said rotor by indicating one of the landings.

13. The method of claim 7, which is provided through a data network.

14. The method of claim 13, wherein the data network is an internet.

15. A non-transitory computer readable medium storing a plurality of instructions which, when executed by at least one processor, cause the at least one processor to:

for a play of a game:

(a) cause at least one display device to display a plurality of rotors, the rotors sharing a common axis of rotation, one of the rotors being positioned within a perimeter of another one of the rotors, each of the rotors being associated with a plurality of symbols;

(b) cause the at least one display device to display a plurality of the rotors rotating independent of each other in a decoupled mode;

(c) after an occurrence of a designated triggering condition, cause a change from the decoupled mode to a coupled mode;

(d) thereafter, cause the at least one display device to display the plurality of the rotors coupled to each other in the coupled mode;

(e) for each of the rotors, indicate one of the symbols associated with said rotor; and (f) if the indicated symbol of each of a designated quantity of at least two of the rotors is a designated one of the symbols associated with said rotor, provide a designated award.

16. The non-transitory computer readable medium of claim 15, wherein the designated quantity of the rotors is all of the rotors.

17. The non-transitory computer readable medium of claim 15, wherein each of the rotors is associated with a same plurality of symbols.

18. The non-transitory computer readable medium of claim 17, wherein the designated one of the symbols associated with each of the rotors is a same one of the symbols.

19. The non-transitory computer readable medium of claim 15, wherein the designated award is a progressive award.

20. The non-transitory computer readable medium of claim 15, wherein the plurality of instructions, when executed by the at least one processor, cause the at least one processor to cause the at least one display device to display a plurality of landings, each of the landings being associated with at least one of the symbols of each of the rotors when the rotors are coupled to each other in the coupled mode, and for each of the rotors, indicate one of the symbols associated with said rotor by indicating one of the landings.

* * * * *